US012648647B2

(12) United States Patent
Mullet et al.

(10) Patent No.: US 12,648,647 B2
(45) Date of Patent: Jun. 9, 2026

(54) RETRACTABLE WHEEL SYSTEM

(71) Applicant: Current Products Company, LLC, Pensacola, FL (US)

(72) Inventors: Willis Jay Mullet, Gulf Breeze, FL (US); Richard Scott Hand, Pensacola, FL (US); Daniel Widmer, Pensacola, FL (US)

(73) Assignee: CURRENT PRODUCTS COMPANY, LLC, Pensacola, FL (US)

( * ) Notice: Subject to any disclaimer, the term of this patent is extended or adjusted under 35 U.S.C. 154(b) by 179 days.

(21) Appl. No.: 18/408,779

(22) Filed: Jan. 10, 2024

(65) Prior Publication Data

US 2024/0225290 A1 Jul. 11, 2024

Related U.S. Application Data

(60) Provisional application No. 63/438,204, filed on Jan. 10, 2023.

(51) Int. Cl.
*A47C 7/00* (2006.01)

(52) U.S. Cl.
CPC ..... *A47C 7/006* (2013.01)

(58) Field of Classification Search
CPC ..... B60B 33/06; B60B 33/063; A47C 7/006
USPC ..... 248/98, 129
See application file for complete search history.

(56) References Cited

U.S. PATENT DOCUMENTS

| | | | | |
|---|---|---|---|---|
| 349,907 A | | 9/1886 | Shults | |
| 2,143,098 A | | 1/1939 | Aage | |
| 2,908,031 A | | 10/1959 | Millett | |
| 3,000,668 A | | 9/1961 | Croy | |
| 3,072,436 A | | 1/1963 | Moore | |
| 3,096,536 A | | 7/1963 | Rabelos | |
| 3,174,797 A | | 3/1965 | Neufeld | |
| 3,216,049 A | | 11/1965 | Nevison | |
| 3,337,266 A | | 8/1967 | Burns | |
| 3,567,280 A | | 3/1971 | Bradshaw | |
| 3,633,242 A | * | 1/1972 | Wasofsky | B60B 33/06 16/34 |
| 3,699,609 A | | 10/1972 | Spatz | |

(Continued)

FOREIGN PATENT DOCUMENTS

| | | | | |
|---|---|---|---|---|
| EP | 1327400 B1 | | 4/2014 | |
| FR | 2686833 A1 | * | 8/1993 | B60B 33/0063 |

(Continued)

OTHER PUBLICATIONS

Haute Juice—Set of 4 Chrome Tubular Cantilever Wire Vintage Arm Chairs Dining Chairs—Mar. 10, 2015.

*Primary Examiner* — Rodney B White
(74) *Attorney, Agent, or Firm* — Christopher A. Proskey; BrownWinick Law Firm

(57) ABSTRACT

In one or more embodiments, a chair is provided having a frame, a seat operably connected to the frame, a backrest operably connected to the frame, and a retractable wheel assembly positioned within the frame, among other components. The retractable wheel assembly is configured to facilitate retraction of a wheel into the frame when a downward force is applied to the chair. In one or more arrangements, the retractable wheel assembly is configured to facilitate extension of a wheel below the frame in absence of a downward force.

43 Claims, 55 Drawing Sheets

(56) References Cited

U.S. PATENT DOCUMENTS

| | | | | | |
|---|---|---|---|---|---|
| 3,801,122 | A * | 4/1974 | Shoemaker | A47C 7/006 | 297/269.1 |
| 4,700,430 | A * | 10/1987 | Raftery | A47B 91/06 | 16/42 R |
| 4,703,974 | A | 11/1987 | Brauning | | |
| 4,911,500 | A | 3/1990 | Saiger | | |
| 4,938,530 | A | 7/1990 | Snyder | | |
| 5,001,808 | A * | 3/1991 | Chung | B60B 33/021 | 16/33 |
| 5,108,149 | A | 4/1992 | Ambasz | | |
| 5,335,966 | A | 8/1994 | Vogtherr | | |
| 5,366,231 | A | 11/1994 | Hung | | |
| 5,370,445 | A | 12/1994 | Golynsky | | |
| 5,407,249 | A | 4/1995 | Bonutti | | |
| 5,971,475 | A | 10/1999 | Lawson | | |
| 6,089,666 | A * | 7/2000 | Rosko | A47D 1/00 | 297/463.2 |
| 6,264,007 | B1 | 7/2001 | Norton | | |
| 6,419,319 | B1 * | 7/2002 | Sakurai | B60B 33/001 | 297/344.12 |
| 6,473,935 | B1 | 11/2002 | Cherukuri | | |
| 7,021,712 | B2 | 4/2006 | Spendlove | | |
| 7,096,533 | B2 | 8/2006 | Griepentrog | | |
| 7,641,284 | B2 | 1/2010 | Jones | | |
| 7,815,259 | B2 | 10/2010 | Fookes | | |
| D659,444 | S | 5/2012 | James | | |
| 8,256,845 | B2 | 9/2012 | Wang | | |
| 9,738,116 | B1 * | 8/2017 | Rivera, Jr. | A47C 11/00 | |
| 9,861,542 | B2 * | 1/2018 | Christian | A61G 5/1072 | |
| 9,980,583 | B2 * | 5/2018 | Rivera, Jr. | B60B 33/006 | |
| 10,327,970 | B2 * | 6/2019 | Christian | A47C 3/18 | |
| 10,376,062 | B2 * | 8/2019 | Rivera, Jr. | B60B 33/063 | |
| 11,166,559 | B1 * | 11/2021 | Kadoch | B60B 33/04 | |
| 11,794,521 | B2 * | 10/2023 | Keich | B60B 33/0002 | |
| 12,022,959 | B2 | 7/2024 | Mullet | | |
| 12,319,088 | B2 * | 6/2025 | Keich | B60B 33/0002 | |
| 2005/0099048 | A1 * | 5/2005 | Schneider | A47C 3/0252 | 297/344.1 |
| 2008/0252124 | A1 | 10/2008 | Chen | | |
| 2009/0195040 | A1 | 8/2009 | Birkbeck | | |
| 2010/0237680 | A1 | 9/2010 | Pedersen | | |
| 2013/0001994 | A1 | 1/2013 | Wu | | |

FOREIGN PATENT DOCUMENTS

| | | | | | |
|---|---|---|---|---|---|
| GB | 889897 | A * | 2/1962 | B60B 33/06 | |
| GB | 1370940 | A * | 10/1974 | B60B 33/00 | |
| GB | 2496516 | A | 5/2013 | | |
| JP | 2000016003 | A * | 1/2000 | A47C 7/006 | |
| WO | 1993004613 | A1 | 3/1993 | | |
| WO | WO-02052987 | A1 * | 7/2002 | A47B 91/06 | |

* cited by examiner

RETRACTABLE WHEEL SYSTEM

CROSS-REFERENCE TO RELATED APPLICATIONS

This application claims priority to U.S. Provisional Application No. 63/438,204 entitled RETRACTABLE WHEEL SYSTEM, and filed on Jan. 10, 2023, the entirety of which is hereby incorporated by reference herein, including any figures, tables, drawings, or other information. This application is related to U.S. patent application Ser. No. 17/955,866 and filed on Sep. 29, 2022 and titled SEATING SYSTEM, which claims priority to U.S. Provisional Application No. 63/251,360 titled SEATING SYSTEM and filed on Oct. 1, 2021, the entirety of each of which is hereby incorporated by reference herein, including any figures, tables, drawings, and other information.

FIELD OF THE DISCLOSURE

This disclosure relates generally to furniture. More specifically, and without limitation, this disclosure is directed to chairs with retractable wheel systems.

OVERVIEW OF THE DISCLOSURE

Many chairs can be uncomfortable to use for extended periods of time due to their inability to properly support an occupant in both upright and reclined positions. Many chairs, such as office chairs, have backrests with reclining mechanisms to permit an occupant to sit with the backrest of the chair in a reclined position. However, such reclining mechanisms tend to be bulky external devices which are not aesthetically pleasing and, as such, may not be desirable for use in certain settings (e.g., in a dining room setting).

Further, many chairs are difficult to move from place to place because they must be picked up by a user to be moved. If such chairs are heavy, they may be impossible to move by some users. Some chairs, such as office chairs, have wheels attached to the frame which allow those chairs to be more easily moved. However, these wheels may cause the chair to be unstable when a user is sitting in the chair and move too easily while the user is seated. Further, these wheels tend to be difficult to take apart and are therefore difficult to clean.

Therefore, for all the reasons stated above, and the reasons stated below, there is a need in the art for a chair seating system having a compact reclining mechanism concealed within the chair that is configured to support an occupant in upright and reclined positions. There is also a need in the art for a chair seating system having easy to clean wheels which aid in the system's movement without causing instability.

It is an object of the disclosure to provide a chair seating system that improves upon the prior art.

Another object of the disclosure is to provide a chair seating system having a compact internal reclining mechanism configured to support an occupant in upright and reclined positions.

Yet another object of the disclosure is to provide a chair seating system having retractable wheels.

Another object of the disclosure is to provide a chair seating system having retractable wheels that are easy to clean.

Yet another object of the disclosure is to provide a chair seating system that is strong, robust, and durable.

Another object of the disclosure is to provide a chair seating system that is comfortable.

Yet another object of the disclosure is to provide a chair seating system that is easy and intuitive to use.

Another object of the disclosure is to provide a chair seating system that is easy to manufacture.

Yet another object of the disclosure is to provide a chair seating system that is cost effective.

Another object of the disclosure is to provide a chair seating system that is high quality.

Yet another object of the disclosure is to provide a chair seating system that has a long useful life.

Another object of the disclosure is to provide a chair seating system that is aesthetically pleasing.

These and other objects, features, or advantages of the disclosure will become apparent from the specification, figures, and claims.

SUMMARY OF THE DISCLOSURE

Figure 1:
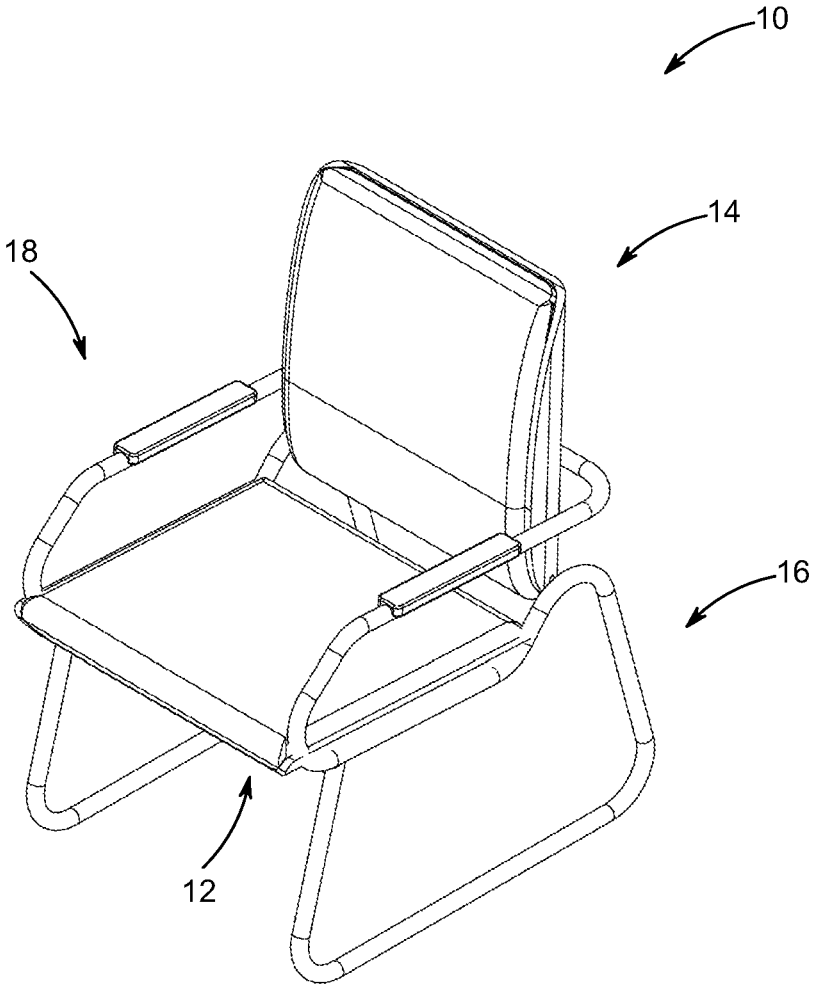
FIG. 1 is a front perspective view of a chair in accordance with one or more arrangements, the view showing the chair having a seat, a backrest, a frame, and arm covers.
Figure 2:
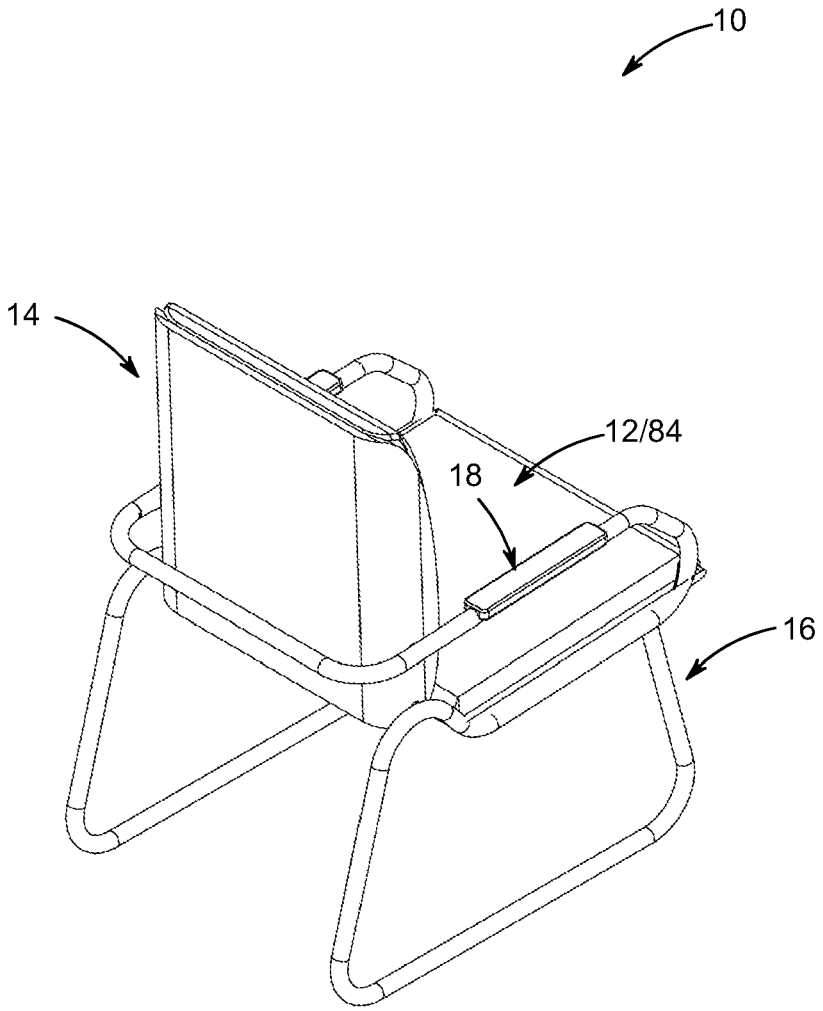
FIG. 2 is a back perspective view of a chair in accordance with one or more arrangements, the view showing the chair having a seat, a backrest, a frame, and arm covers.
Figure 3:
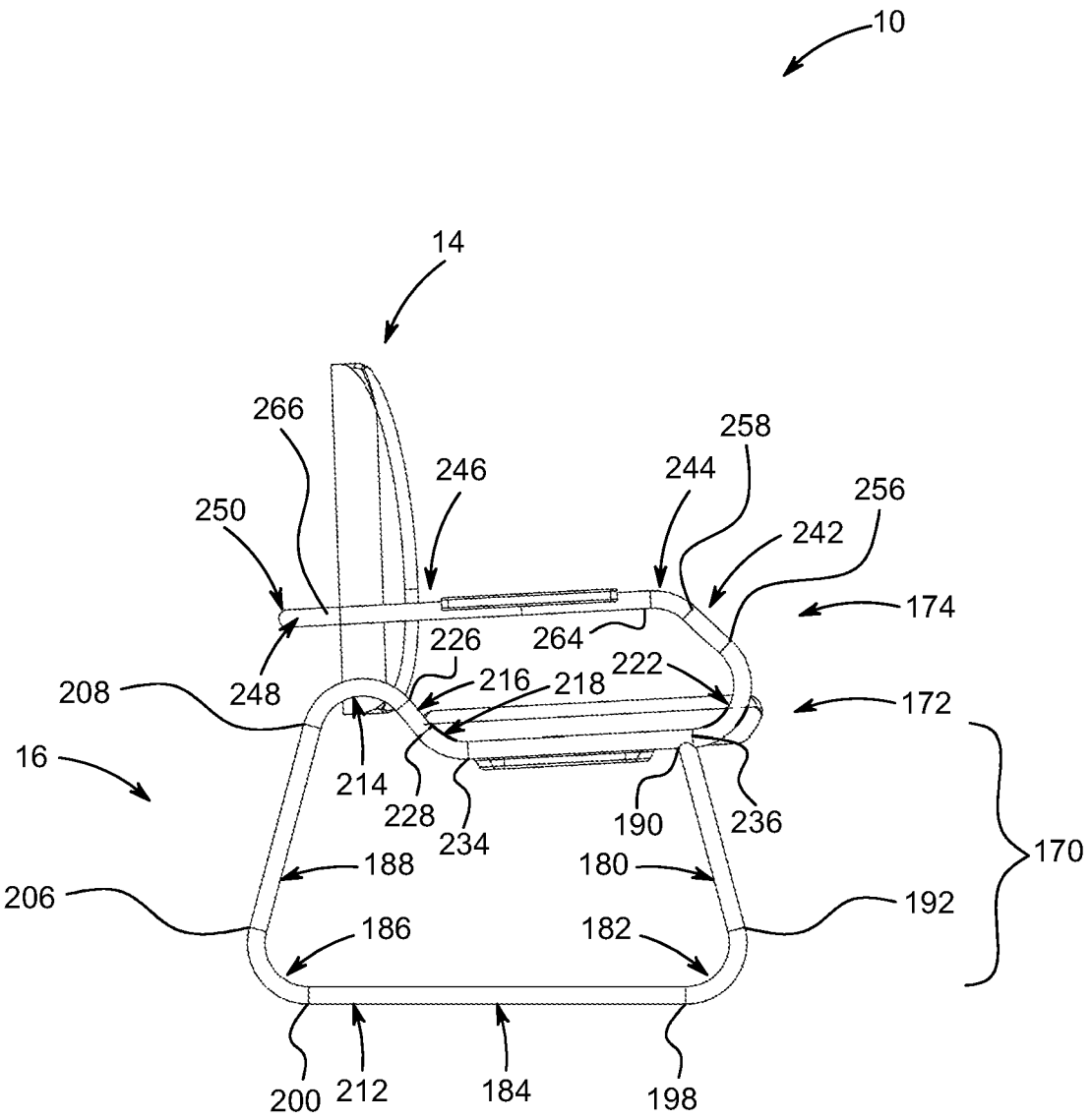
FIG. 3 is a right elevation view of a chair in accordance with one or more arrangements, the view showing the chair having a seat, a backrest, and a frame; the view also showing the frame having a base section, a seat support section, and an arm support section. The view showing the chair in an upright position.
Figure 4:
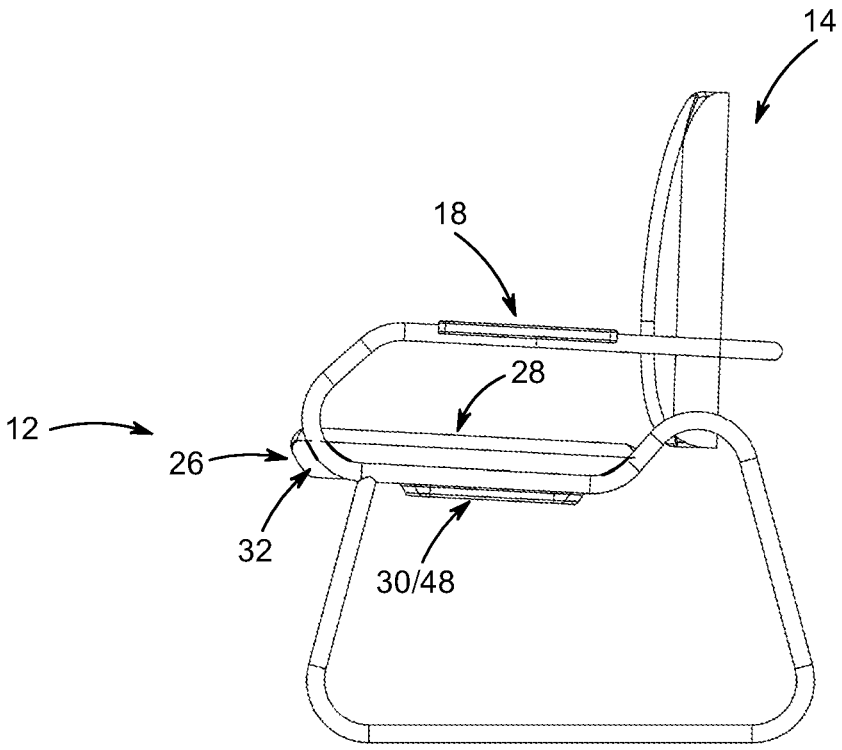
FIG. 4 is a left elevation view of a chair in accordance with one or more arrangements, the view showing the chair having a backrest, arm covers, and a seat assembly; the view also showing the lower support member, cushion, and upper seat member of the seat assembly.
Figure 5:
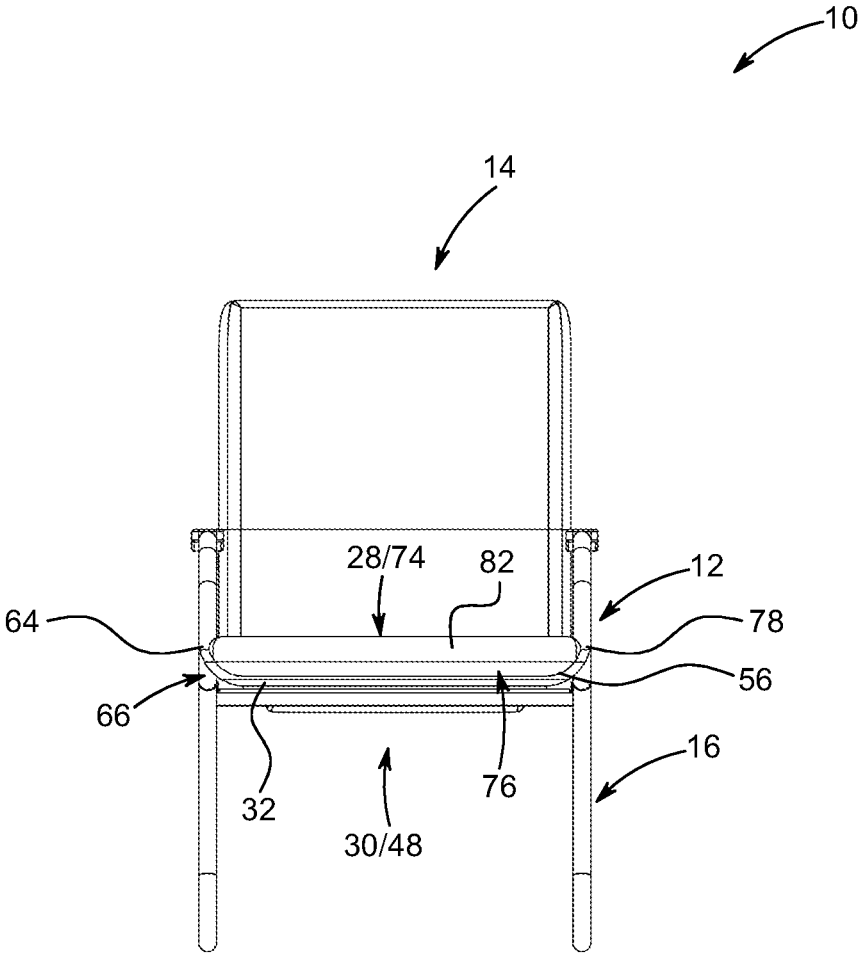
FIG. 5 is a front elevation view of a chair in accordance with one or more arrangements, the view showing the chair having a seat assembly with an upper seat member, a cushion, a backrest, and a frame.
Figure 6:
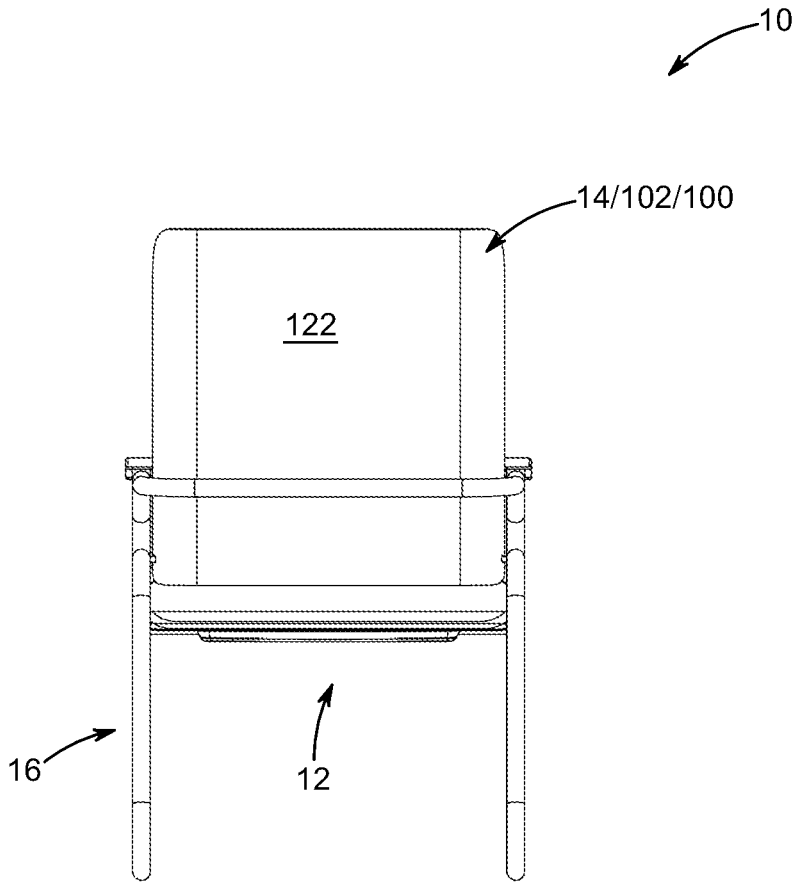
FIG. 6 is a back elevation view of a chair in accordance with one or more arrangements, the view showing the chair having a frame, a backrest, and a backrest support assembly; the view also showing the backrest support assembly having a rear support member and rear surface.
Figure 7:
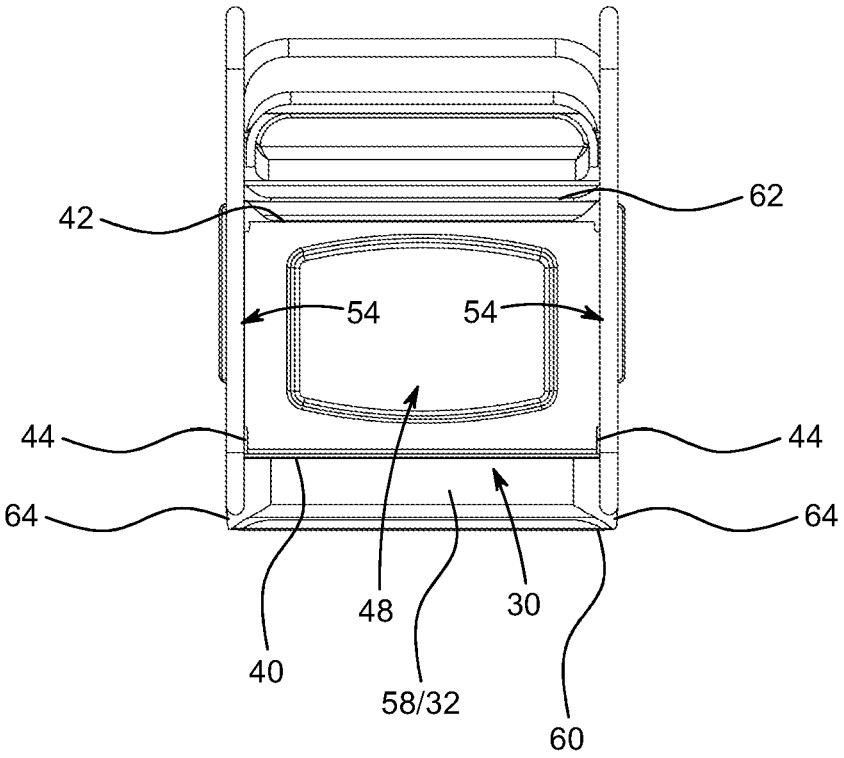
FIG. 7 is a bottom elevation view of a chair in accordance with one or more arrangements, the view showing the chair having an upper seat member with a front edge, a backrest edge, and side edges. The view also showing a lower seat member with a front edge, a backrest edge, side edges, center indent, and connection members.
Figure 8:
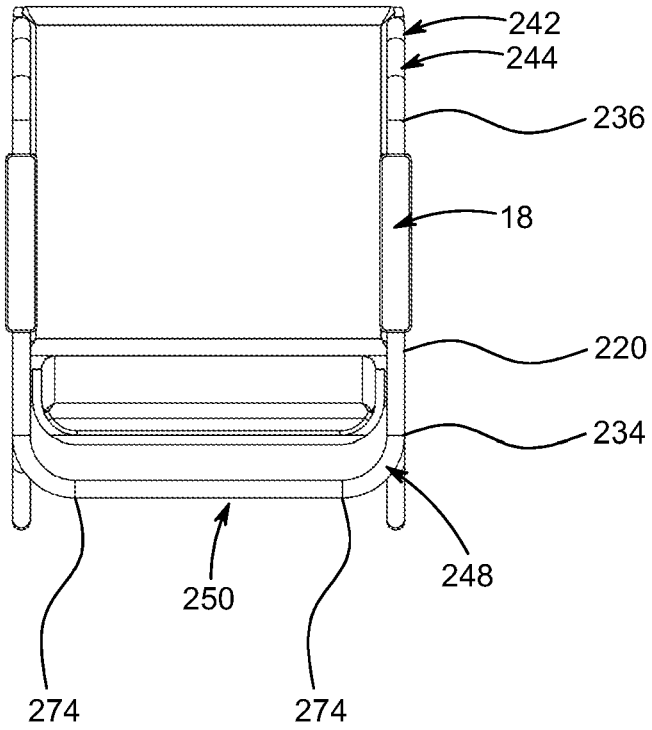
FIG. 8 is a top elevation view of a chair in accordance with one or more arrangements, the view showing the chair having an armrest and arm support section with a front sloped section, front bend, rear bend, and rear crossbar.
Figure 9:
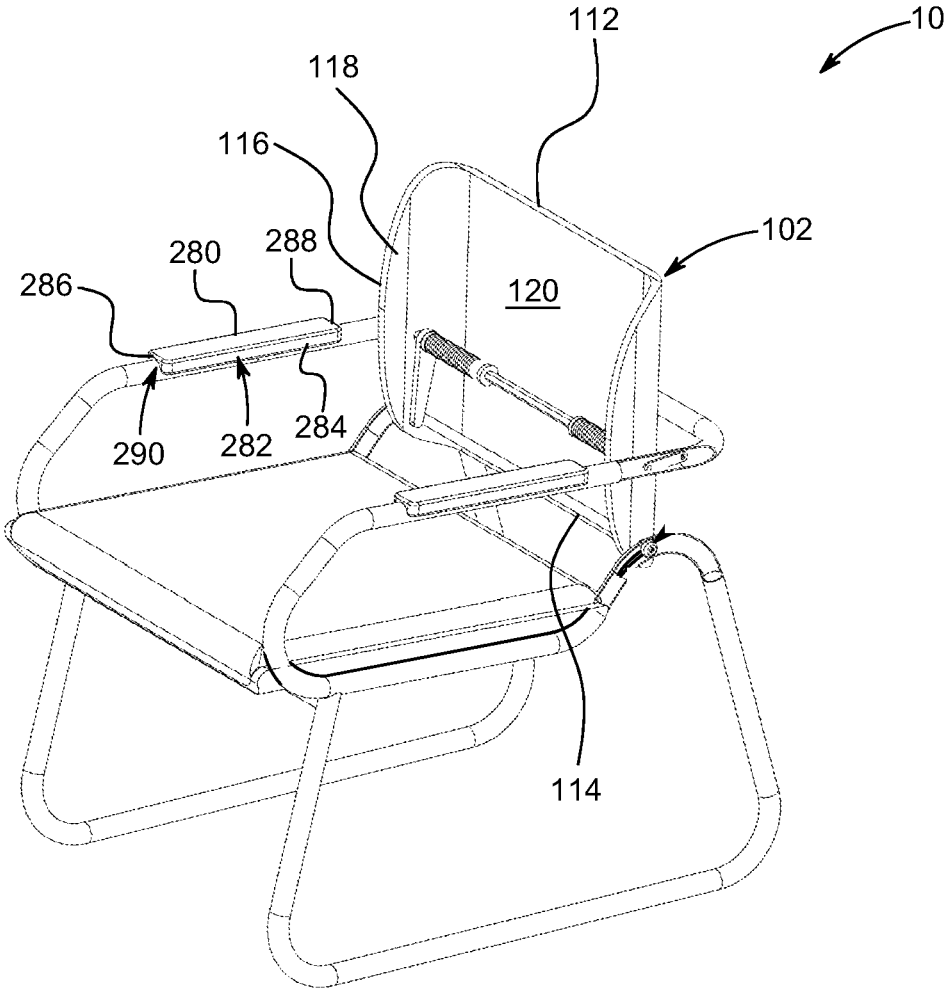
FIG. 9 is a front perspective view of a chair in accordance with one or more arrangements, the view showing the chair having arm covers with a top, a bottom, opposing sides, a front end, a backrest end, and a recessed cylindrical channel. The view also showing the chair having a rear support member, the view showing the dining chair in an upright position.
Figure 10B:
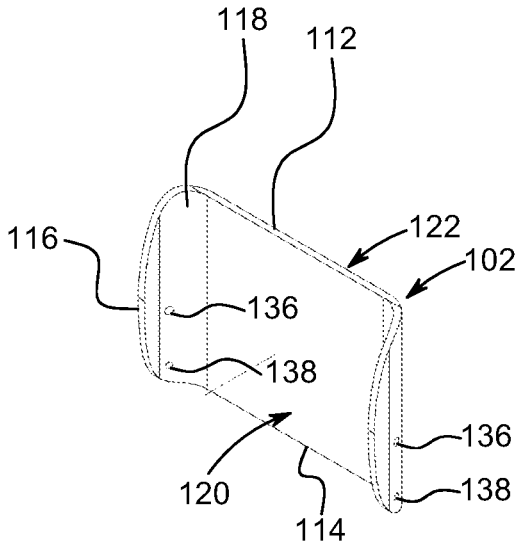
FIG. 10B is a front perspective view of the rear support member, the view showing components of the rear support member in accordance with one or more arrangements.
Figure 10A:
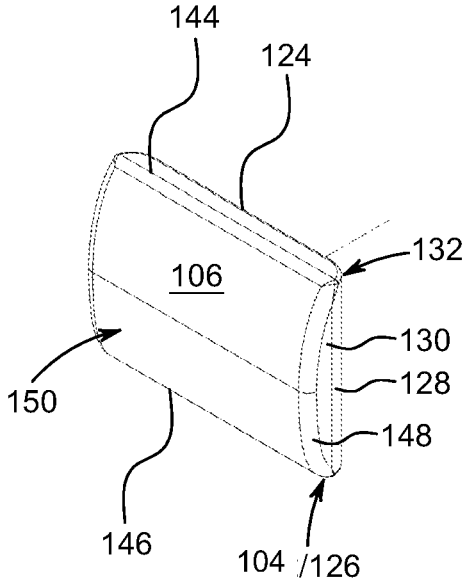
FIG. 10A is a front perspective view of the front support member, the view showing components of the front support member in accordance with one or more arrangements.
Figure 11:
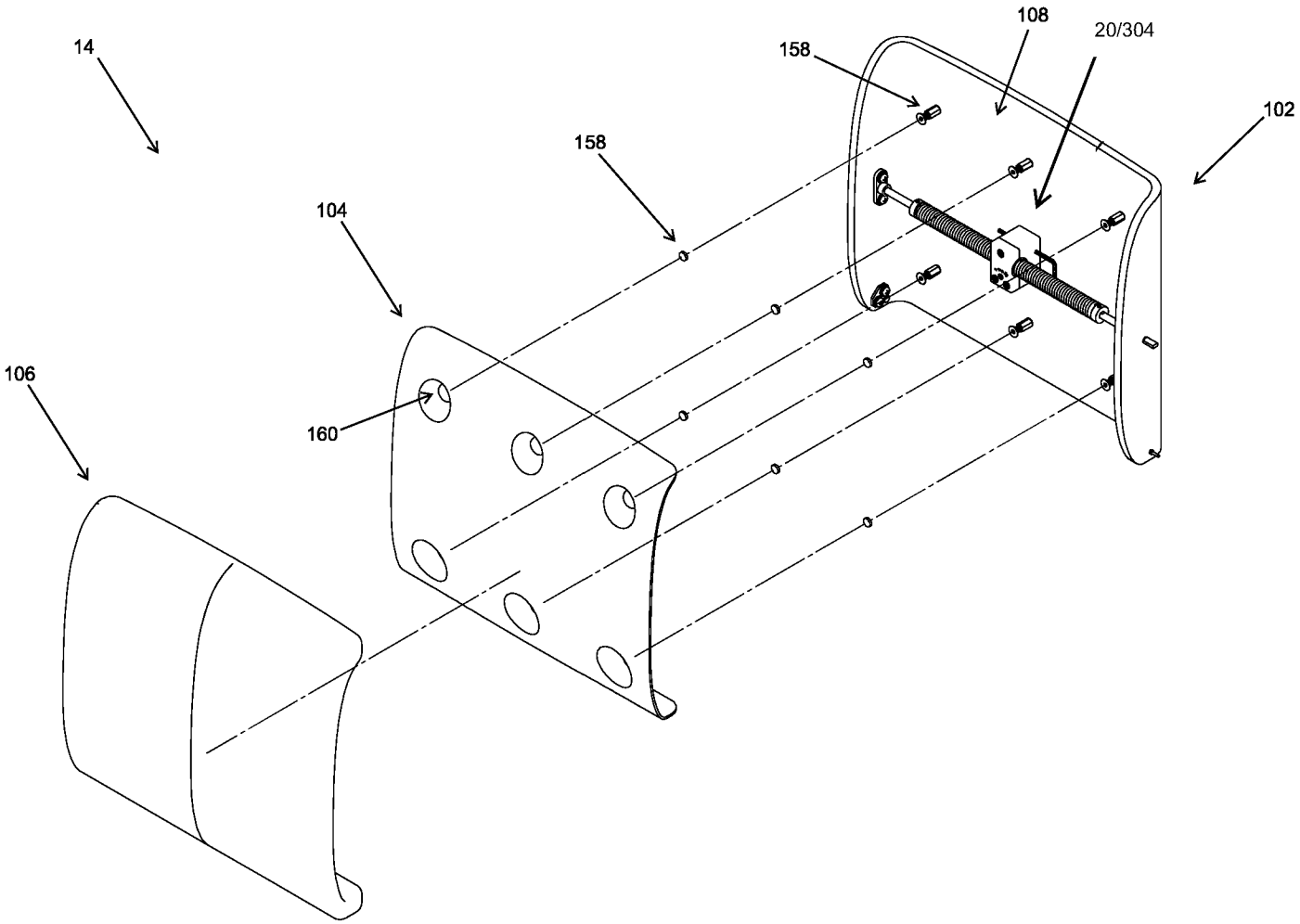
FIG. 11 is an exploded perspective view of the reclining mechanism of the chair. The view also showing the cushion of the chair.
Figure 12:
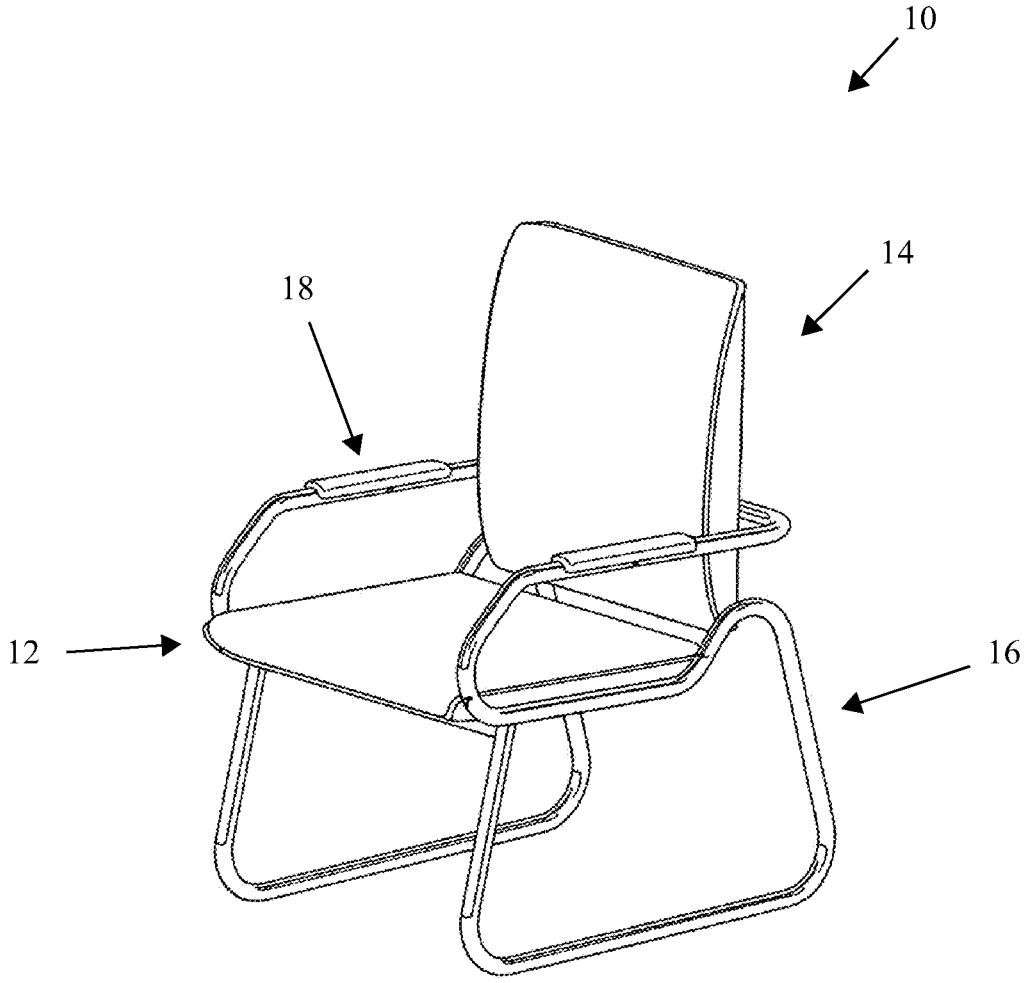
FIG. 12 is a front perspective view of a chair in accordance with one or more arrangements, the view showing the chair having a backrest, a frame, a seat, and arm covers. The view also showing the chair in an upright position.
Figure 13:
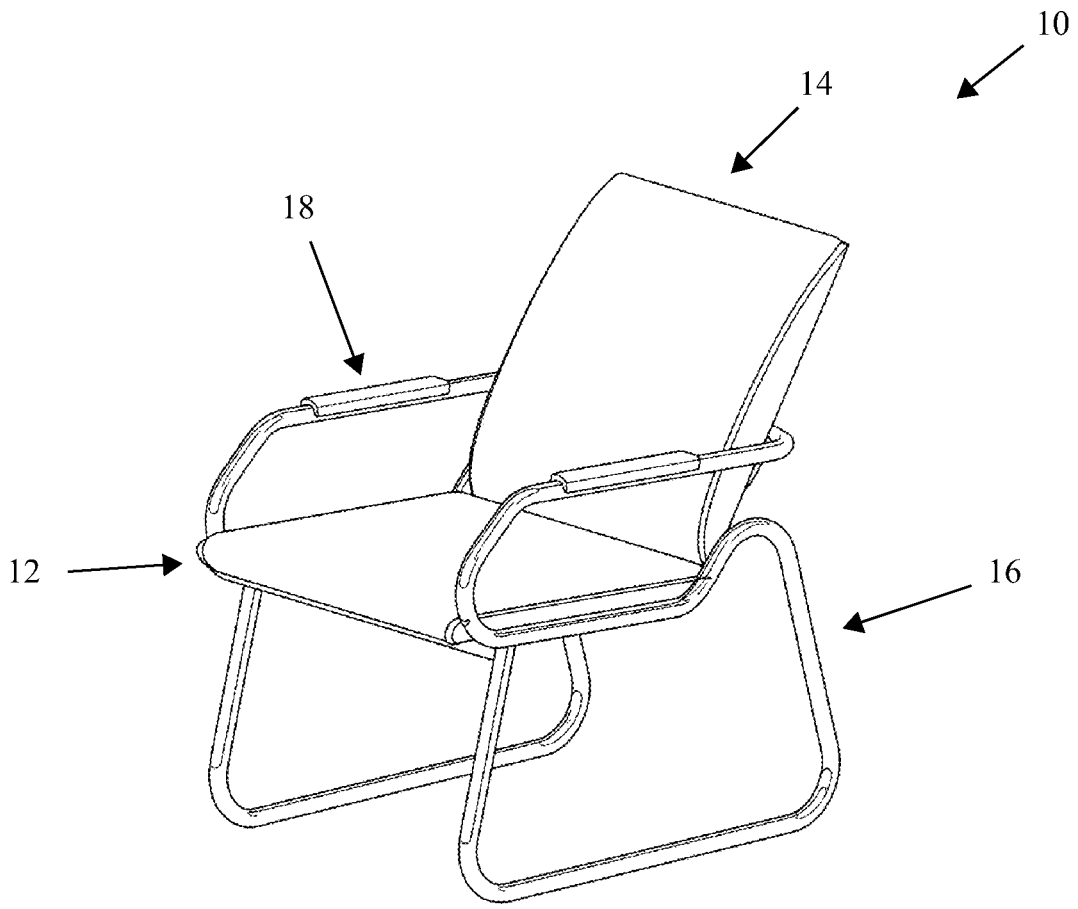
FIG. 13 is a front perspective view of a chair in accordance with one or more arrangements, the view showing the chair having a backrest, a seat, a frame, and arm covers. The view also showing the chair in a reclined position.
Figure 14:
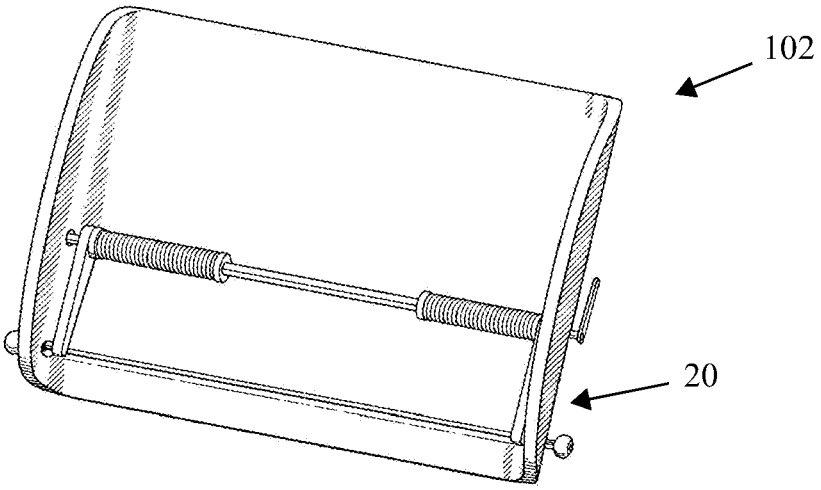
FIG. 14 is a front perspective view of a chair in accordance with one or more arrangements, the view showing the chair having a backrest and a reclining mechanism. The view also showing the chair in a reclined position.
Figure 15:
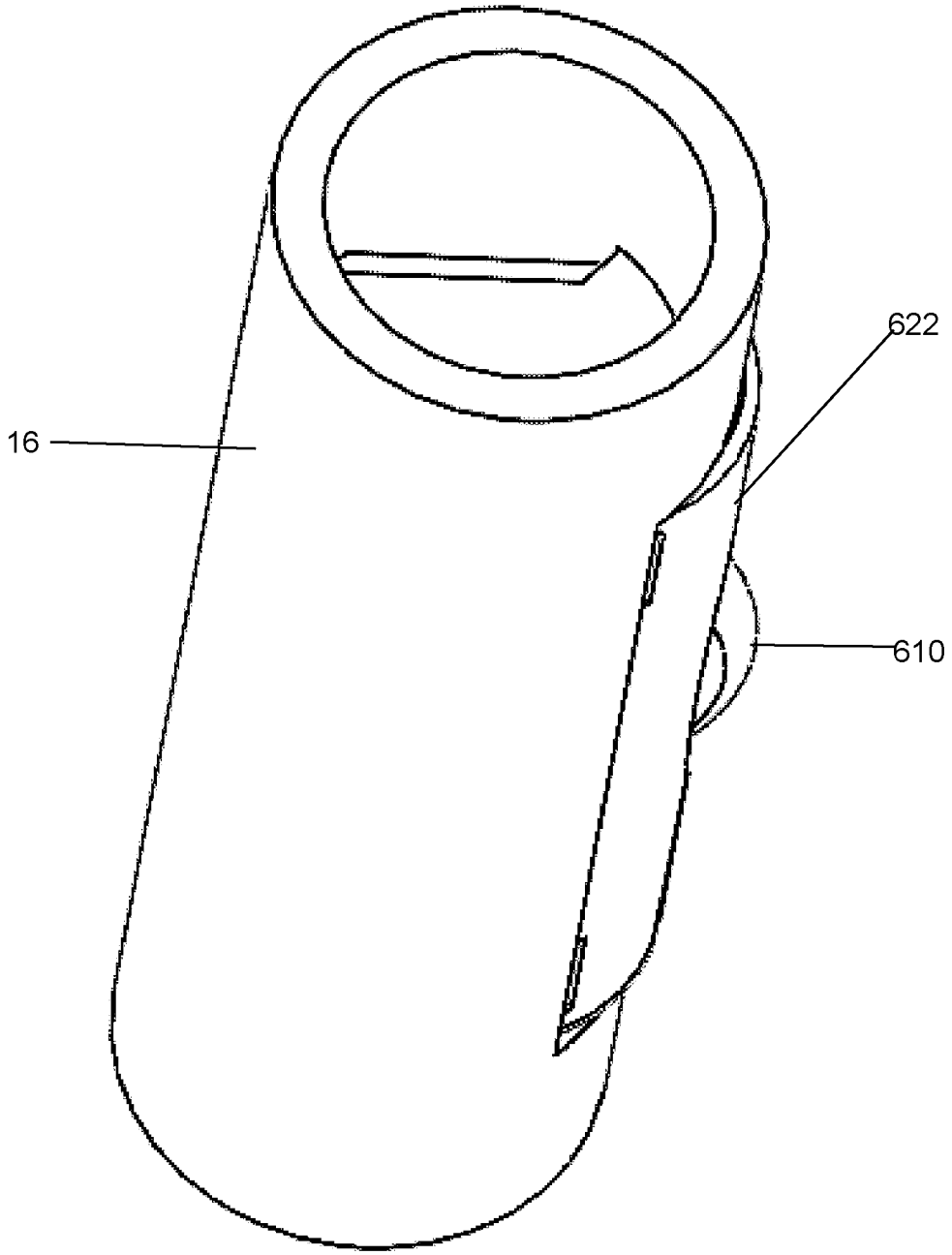
FIG. 15 is a section view of the frame of a chair in accordance with one or more arrangements, the view showing the frame of the chair having a wheel and a carrier.
Figure 16A:
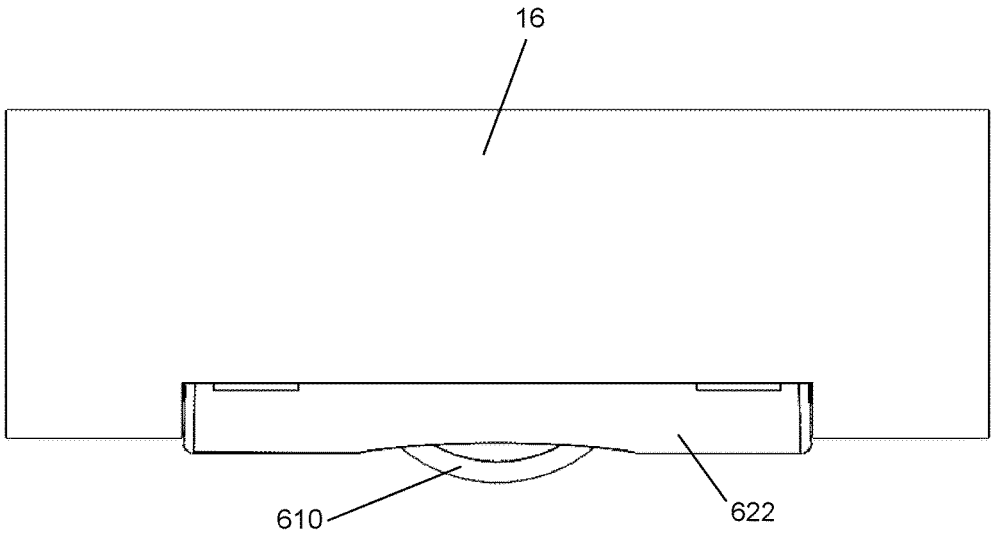
FIG. 16A is a side elevation view of the frame of a chair in accordance with one or more arrangements, the view showing the frame of the chair having a wheel and a carrier.
Figure 16B:
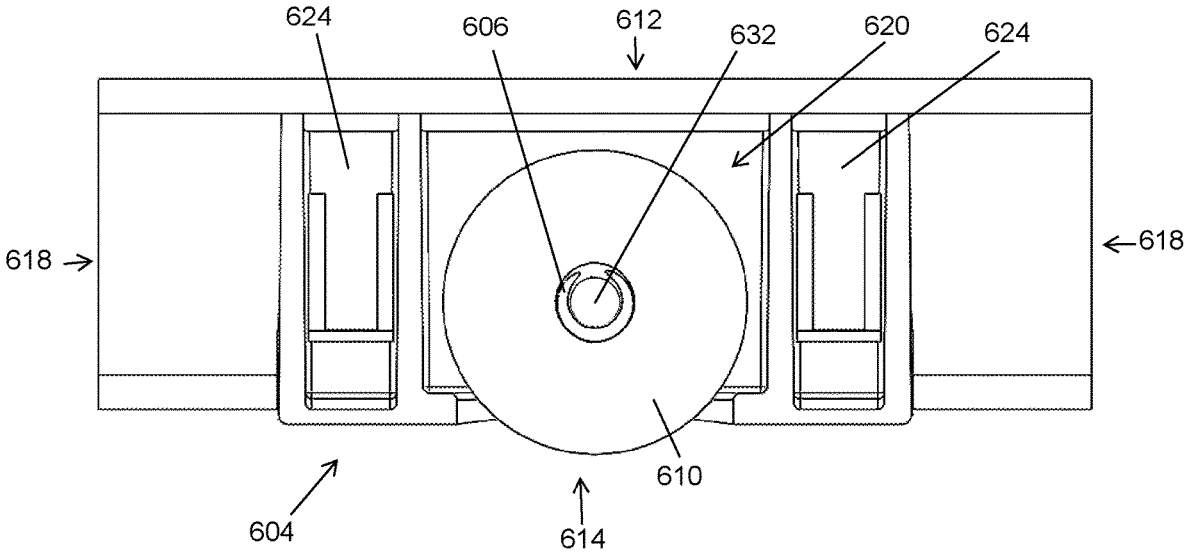
FIG. 16B is a section view of the frame of a chair in accordance with one or more arrangements, the view showing the frame of the chair having a wheel and a carrier with engagement members and a spring.
Figure 17A:
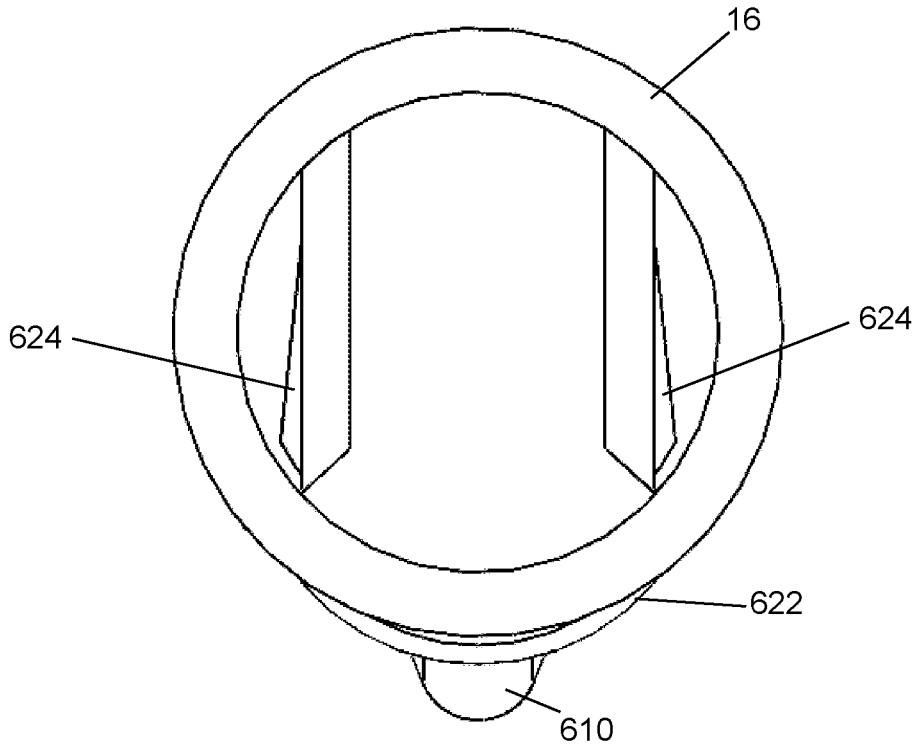
FIG. 17A is a section view of the frame of a chair in accordance with one or more arrangements, the view showing the frame of the chair having a wheel and a carrier.
Figure 17B:
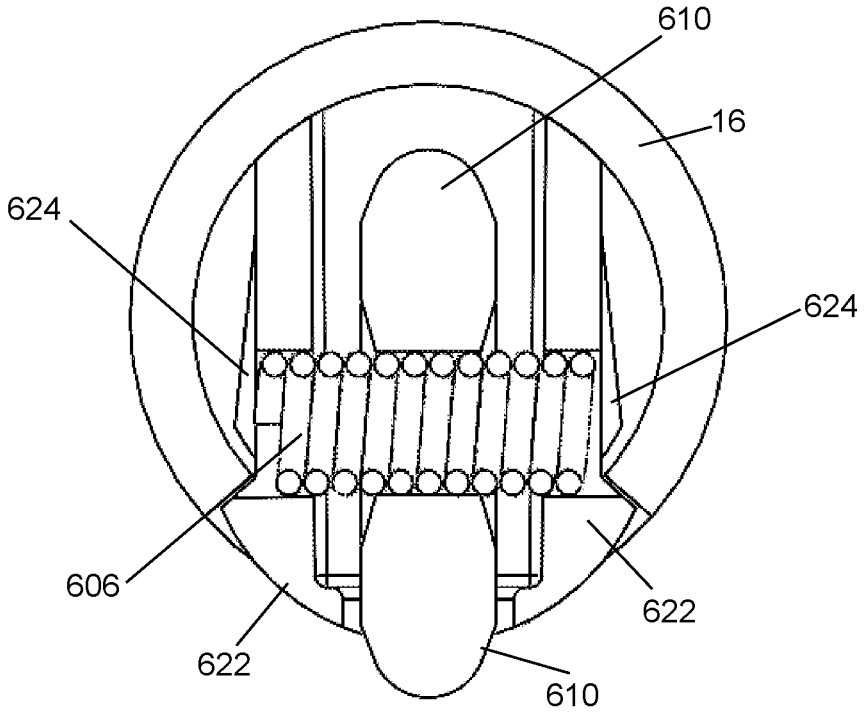
FIG. 17B is a section view of the frame of a chair in accordance with one or more arrangements, the view showing the frame of the chair having a wheel and a carrier with engagement members and a spring.
Figure 18A:
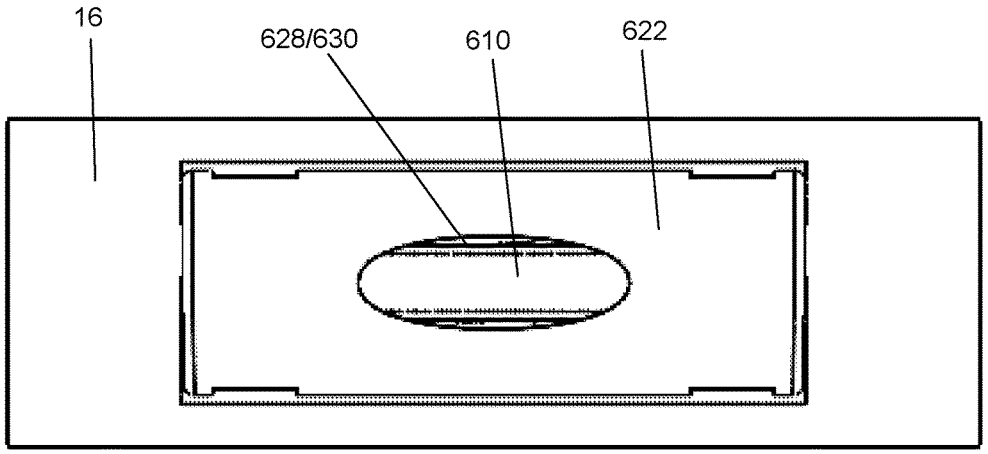
FIG. 18A is a bottom elevation view the frame of a chair in accordance with one or more arrangements, the view showing the frame of the chair having a bottom plate of a carrier and a wheel.
Figure 18B:
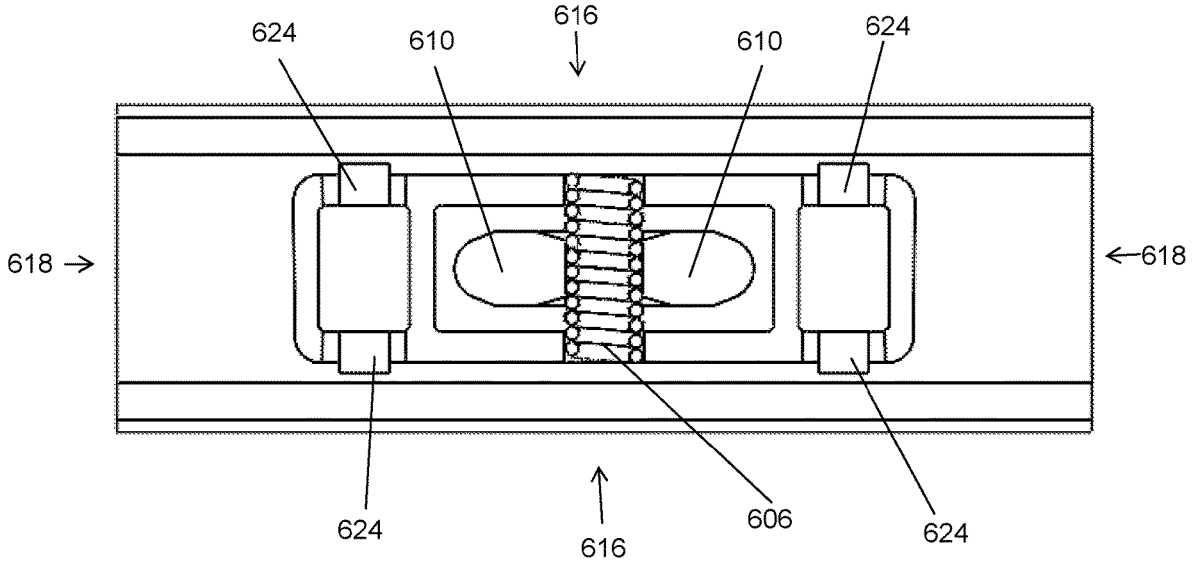
FIG. 18B is a bottom elevation view of the frame of a chair in accordance with one or more arrangements, the view showing the frame of the chair having a wheel and a carrier with engagement members and a spring.
Figure 19:
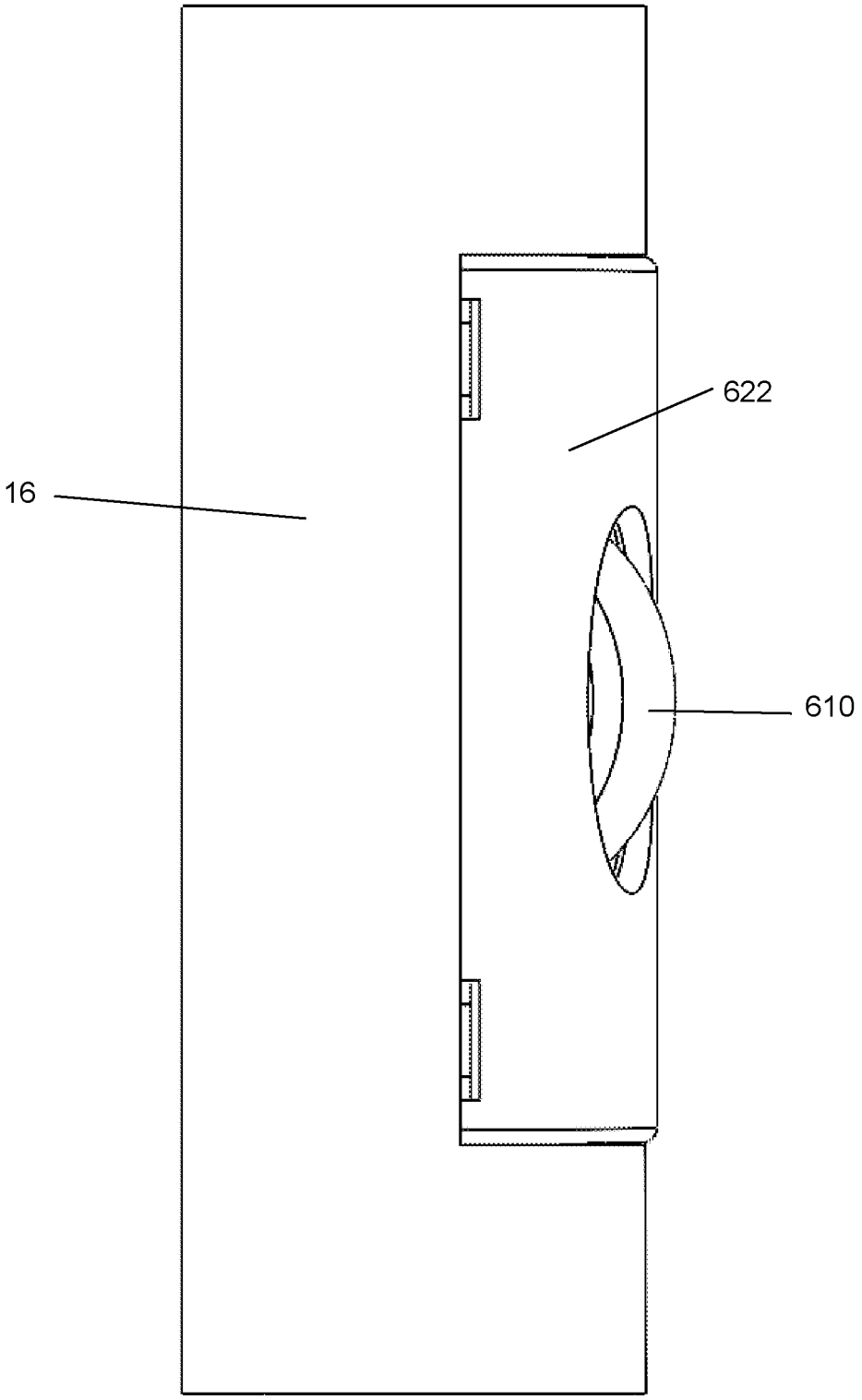
FIG. 19 is a side elevation view of the frame of a chair in accordance with one or more arrangements, the view showing the frame of the chair having a wheel.
Figure 20:
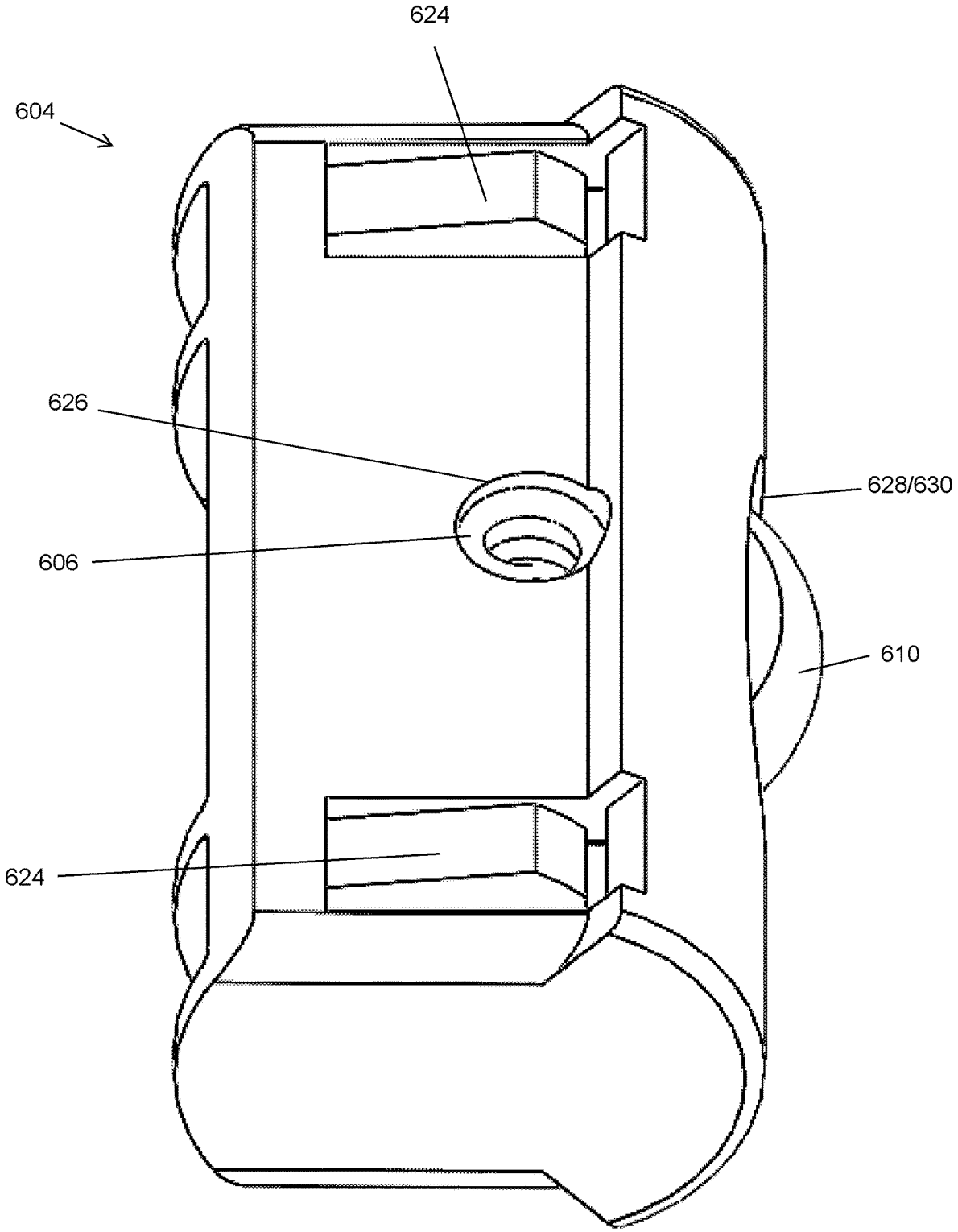
FIG. 20 is a side elevation view of a carrier of a chair in accordance with one or more arrangements, the view showing the carrier of the chair having engagement members and a spring.
Figure 21A:
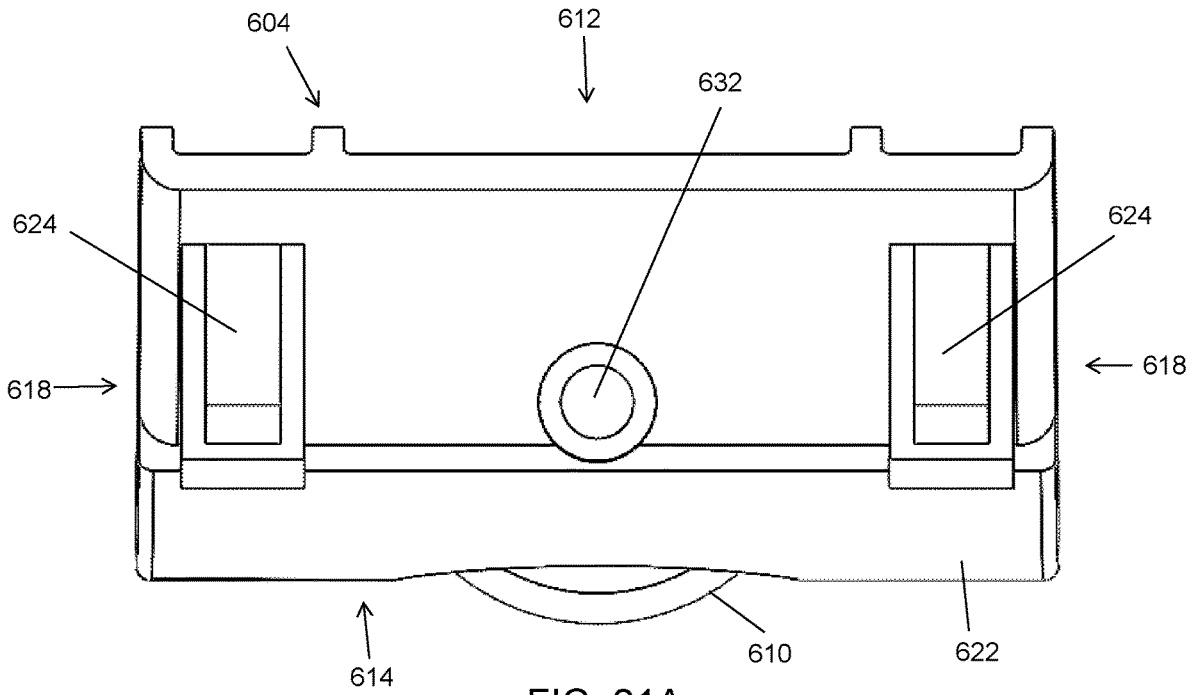
FIG. 21A is a side elevation view of a carrier of a chair in accordance with one or more arrangements, the view showing the carrier of the chair having engagement members.
Figure 21B:
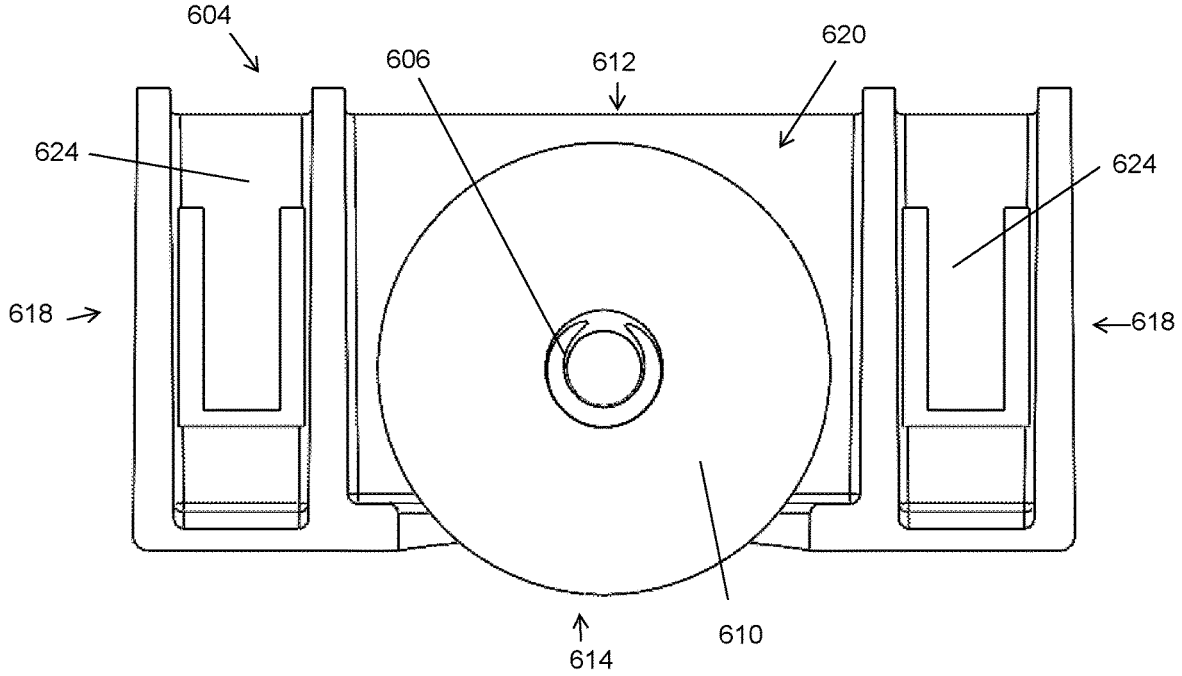
FIG. 21B is a section view of a carrier of a chair in accordance with one or more arrangements, the view showing the carrier of the chair including a wheel.

In one or more embodiments, a chair seating system is provided having a frame, a seat operably connected to the frame, and a backrest operably connected to the frame. The chair seating system having a retractable wheel assembly wherein the retractable wheel assembly has a wheel and wherein the retractable wheel assembly is configured to move the wheel between an extended position and a retracted position. The retractable wheel assembly is also configured to move the wheel to the retracted position when a downward force is applied to the chair seating system. Further, the retractable wheel assembly is configured to move the wheel to the extended position in the absence of the downward force.

In one or more embodiments, the chair seating system has a retractable wheel assembly wherein the retractable wheel assembly has a wheel and a spring and wherein the retractable wheel assembly is configured to extend the wheel below the frame when in a resting state.

In one or more embodiments, the frame of the chair seating system has a wheel compartment. In one or more embodiments, the chair seating system has a retractable wheel assembly wherein the retractable wheel assembly has a wheel and a spring and wherein the frame is configured to receive the retractable wheel assembly. In one or more embodiments, the wheel of the retractable wheel assembly is configured to retract into the frame when a downward force is applied to the chair seating system.

In one or more embodiments, the frame of the chair seating system has a wheel compartment. In one or more embodiments, the chair seating system has a retractable wheel assembly wherein the retractable wheel assembly has a wheel and a spring and wherein the frame is configured to receive the retractable wheel assembly. In one or more embodiments, the retractable wheel assembly is configured to facilitate extension of the wheel below the frame. In one or more embodiments, the retractable wheel assembly is configured to facilitate retraction of the wheel into the frame when a downward force is applied to the chair seating system.

DETAILED DESCRIPTION OF THE DISCLOSURE

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, backrest, side, height, length, width, upper, lower, interior, exterior, inner, outer, and the like as may be used herein, merely describe points of reference and do not limit the present invention to any particular orientation or configuration.

As used herein, "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s).

As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof, unless expressly indicated otherwise. For example, if an embodiment of a system is described at comprising an article, it is understood the system is not limited to a single instance of the article unless expressly indicated otherwise, even if elsewhere another embodiment of the system is described as comprising a plurality of articles.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected, or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually, or sequentially, to provide looping or other series of operations aside from single operations described below. It should be presumed that any embodiment or method having features and functionality described below, in any workable combination, falls within the scope of example embodiments.

As used herein, various disclosed embodiments may be primarily described in the context of chairs. However, the embodiments are not so limited. It is appreciated that the embodiments may be adapted for use in other applications which may be improved by the disclosed structures, arrangements and/or methods. The system is merely shown and described as being used in the context of chairs for ease of description and as one of countless examples.

System 10

With reference to the figures, a chair seating system 10 (or simply system 10) is presented. The system 10 is formed of any suitable size, shape, and design and is configured to hold and support an occupant in a seated position as well as facilitate movement between an upright position and a reclined position. In the arrangement shown, as one example, system 10 includes the following component pieces: a seat 12, a backrest 14, a frame 16, arm covers 18, and a reclining mechanism 20, among other components.

Seat 12

Seat 12 is formed of any suitable size, shape, and design and is configured to provide a surface for seating of an occupant thereupon. In the arrangement shown, as one example, seat 12 includes a seat assembly 26 and a cushion 28 among other components. In this example arrangement, seat assembly 26 is configured to operably connect with frame 16 and support cushion 28 on a top surface of seat assembly 26.

Seat Assembly 26

Seat assembly 26 is formed of any suitable size, shape, and design and is configured to provide a surface for seating of an occupant thereupon. In the arrangement shown, as one example, seat assembly 26 includes a lower support member 30 and an upper seat member 32.

Lower support member 30 is formed of any suitable size, shape, and design and is configured to operably connect with frame 16 and support upper seat member 32. In the arrangement shown, as one example, lower support member 30 has a generally rectangular planar shape extending between a front edge 40, a back edge 42, and opposing side edges 44. In this example arrangement, lower support member 30 has an outer perimeter positioned in an upper plane and a center indent 48, in which lower support member 30 extends downward to a lower plane. Center indent 48 forms a recess in an upper surface of lower support member 30 to accommodate flexing of webbing 70 (not shown) of upper seat member 32. Center indent 48 also provide structural rigidity to seat assembly 26.

In this example arrangement, lower support member 30 includes flanges extending outward from opposing side edges 44 to form connection members 54. In one or more arrangements, connection members 54 are configured engage frame 16 in a manner to hold seat 12 in place on the frame 16. Additionally or alternatively, in one or more arrangements, connection members 54 and frame 16 may include holes (not shown) to facilitate connection of connection members 54 of seat 12 to frame 16, for example using bolts. However, embodiments are not so limited. Rather, it is contemplated that in various arrangements, connection members 54 may be attached to frame 16 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Upper seat member 32 is formed of any suitable size, shape, and design and is configured to operably connect with lower support member 30 and cushion 28 and provide a surface to support cushion 28. In the arrangement shown, as one example, upper seat member 32 has a generally rectangular planar shaped top 56 and bottom 58 and extends between a front edge 60, a backrest edge 62, and opposing side edges 64. In this example arrangement, upper seat member 32 has contoured side portions 66 that curve upward proximate to opposing side edges 64. However, the embodiments are not so limited. Rather, it is contemplated that in various arrangements, various portions of upper seat member 32 may be contoured for comfort and/or aesthetic appearance.

In one or more arrangements, upper seat member 32 is connected to lower support member 30 by fasteners (not shown) through holes (not shown) in lower support member 30. However, the embodiments are not so limited. Rather, it is contemplated that in various arrangements, upper seat member 32 may be attached to lower support member 30 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

In one or more arrangements, upper seat member 32 has a rectangular opening 68 (not shown) in a center portion of upper seat member 32 and webbing 70 extending across opening 68. Webbing 70 provides a strong seating base while offering some give to provide a more comfortable seating surface.

Cushion 28

Cushion 28 is formed of any formed of any suitable size, shape, and design and is configured to comfortably support an occupant sitting thereon. In the arrangement shown, as one example, cushion 28 has a generally cuboid shape having a top 74, a bottom 76, and sides 78. In this example arrangement, cushion 28 includes a foam core 82 covered by upholstery material 84 on at least one side.

Foam Core 82

Foam core 82 is formed of any suitable size, shape, and design and is configured to provide comforting support when seated upon. In one or more arrangements, foam core 82 is also configured to prevent water from becoming trapped within the foam core 82. For instance, in some various arrangements, foam core 82 may be comprised of one or more foams (e.g., reticulated foam, polyurethane foam, open cell rubber and/or any other foam material), feathers, fibers, polyester, batting and/or any other fill material for cushions.

Upholstery Material 84

Upholstery material 84 is formed of any formed of any suitable size, shape, and design and is configured to provide a comfortable seating surface and aesthetically pleasing appearance. In some various arrangements, upholstery material 84 may include but is not limited to, for example, natural materials such as cotton, silk, wool, linen, and/or leather, or synthetic material such as polyester, polypropylene, nylon, acrylic, rayon, vinyl, and/or synthetic leathers, and/or any other upholstery material.

In one or more arrangements, bottom 76 of cushion 28 is attached to a top 56 of upper seat member 32 of seat assembly 26. It is contemplated that in various arrangements, cushion 28 may be attached to upper seat member 32 using various methods or means including but not limited to, for example, screws, bolts, clamps, pins, rivets, welding, snap connectors, friction fit connectors, stitching, hook and loop connectors, adhesives, chemical bonding, and/or any other process or means that results in a permanent of semi-permanent connection.

Backrest 14

The backrest 14 is formed of any suitable size, shape, and design and is configured to provide a surface to provide backrest support for an occupant seated on seat 12. In the arrangement shown, as one example, backrest 14 includes a backrest support assembly 100 and a cushion 106 among other components.

Backrest Support Assembly 100

Backrest support assembly 100 is formed of any suitable size, shape, and design and is configured to provide a backrest rest surface for an occupant seated on seat 12. In the arrangement shown, as one example, backrest support assembly 100 includes a rear support member 102 and a front support member 104 that form a hollow interior 108 when joined together. However, the arrangements are not so limited. Rather, it is contemplated that in one or more arrangements, backrest support assembly 100 may be of solid construction without hollow interior (e.g., in arrangements omitting reclining mechanism 20 or components thereof in hollow interior 108).

Rear Support Member 102 and Front Support Member 104

Rear support member 102 and front support member 104 are formed of any suitable size, shape, and design and are configured to form a hollow interior 108 and provide a forward surface suitable for operation as a backrest rest. In the arrangement shown, as one example, rear support member 102 has a generally rectangular planar shape having a front surface 120 and a rear surface 122 extending between an upper edge 112, a lower edge 114, and opposing side edges 116. In this example arrangement, rear support member 102 has contoured side portions 118 that curve forward proximate to side edges 116. In the arrangement shown, rear support member 102 includes an upper set of holes 136 and a lower set of holes 138 positioned in side portions 118 to facilitate connection with reclining mechanism 20.

In one or more arrangements, front support member 104 has a front surface 130 and rear surface 132 extending between an upper edge 124, lower edge 126, and opposing side edges 128. In this example arrangement, front support member 104 has a complementary shape to rear support member 102 so that upper edge 124, lower edge 126, and side edges 128 align with upper edge 112, lower edge 114, and opposing side edges 116 of rear support member 102 when front support member 104 and rear support member 102 are connected together. In this example arrangement, rear surface 132 of front support member 104 includes a recess (not shown) to form hollow interior 108 when front support member 104 and rear support member 102 are connected together.

Cushion 106

In the arrangement shown, backrest 14 includes a cushion 106 connected to front surface 130 of front support member 104. Cushion 106 is formed of any formed of any suitable size, shape, and design and is configured to provide a comfortable backrest support surface for an occupant of system 10. In the arrangement shown, as one example, cushion 106 has a generally rectangular shape, when viewed from the front, having a top 144, a bottom 146, opposing sides 148, a front surface 150, and a backrest surface 152 (not shown). In this example arrangement, front surface 150 of cushion 106 has an outward curved shape when viewed from the side. In this example arrangement, cushion 106 includes a foam core 82 covered by upholstery material 84 on at least one side as discussed with reference to cushion 28. As described with reference to cushion 28, cushion 106 may be attached to front support member 104 using various methods or means including but not limited to, for example, screws, bolts, clamps, pins, rivets, welding, snap connectors, friction fit connectors, stitching, hook and loop connectors, adhesives, chemical bonding, and/or any other process or means that results in a permanent of semi-permanent connection.

In one or more arrangements, front support member 104 is connected to rear support member 102 by fasteners (not shown) through holes (not shown) in front support member 104 and/or rear support member 102. However, the embodiments are not so limited. Rather, it is contemplated that in various arrangements, front support member 104 may be attached to rear support member 102 using various methods or means including but not limited to, for example, screws, bolts, clamps, pins, rivets, welding, snap connectors, friction fit connectors, adhesives, chemical bonding, and/or any other process or means that results in a permanent of semi-permanent connection.

Additionally or alternatively, in one or more arrangements front support member 104 and cushion 106 of backrest 14 may be connected to rear support member 102 of backrest 14 by one or more magnetic components 158 (e.g. magnetic and/or ferric materials). Use of magnetic components 158 to facilitate connection between front support member 104 and rear support member 102 may be useful, for example, to facilitate easy removal of front support member 104 and cushion 106 for adjustment or maintenance of system 10. For example, in the arrangement shown, one or more components of reclining mechanism 20 (e.g., a counterbalance assembly 304) are positioned within hollow interior 108. For instance, in one or more arrangements, it may be desirable to facilitate easy removal of front support member 104 and cushion 106 for adjustment of the counterbalance assembly 304 to provide a desired amount of resistance force to backrest 14 when a user reclines.

In one or more arrangements, front support member 104 and/or rear support member 102 have features 160 (e.g., protrusions) configured to hold the magnetic components 158 connected to front support member 104 in close proximity to the magnetic components 158 connected to rear support member 102 when front support member 104 and rear support member 102 are connected together, thereby ensuring a strong magnetic bond.

Frame 16

Frame 16 is formed of any suitable size, shape, and design and is configured to operably connect with and seat 12, backrest 14, and reclining mechanism 20 of system 10 to provide seating for an occupant of system 10. In the arrangement shown, as one example, frame 16 is a tubular chair frame having a base section 170, a seat support section 172, and an arm support section 174, among other components. In the example arrangement shown, frame 16 is formed of cylindrical shaped tube(s). However, the arrangements are not so limited. Rather, it is contemplated that frame 16 may be formed of materials of any type including but not limited to, for example, tubing, pipes, rods, wires, bars, structural stock, and/or any other type of material and may have various shapes including but not limited to, for example, round, triangular, square, pentagonal, hexagonal, heptagonal, octagonal, flat or rectangular, rebar, angled, tee, channel, I-beam, H-beam, wide flange, or any other shape.

Base Section 170

Base Section 170 of frame 16 is formed of any suitable size, shape, and design and is configured to provide stable support of system 10 on a floor. In the arrangement shown, as one example, base section 170 includes front legs 180, lower front corners 182, side bars 184, lower rear corners 186, and rear legs 188, among other components.

In this example arrangement, front legs 180 have a generally elongated tube shape extending from upper ends 190, connected to seat support section 172, to lower ends 192 connected to lower front corners 182. In this example arrangement, lower front corners 182 have a generally elongated tube shape extending from lower ends 192 and curving rearward before connecting to front ends 198 of side bars 184. In this example arrangement, side bars 184 each have an elongated tube shape extending from front end 198, where side bars 184 are connected to lower front corner 182, to a rear end 200, where side bars 184 are connected to lower rear corner 186. In one or more arrangements, side bars 184 may include one or more drain holes 212 positioned in a lower side of side bars 184 to facilitate draining of fluid that enters or condenses inside of frame 16. In this example arrangement, lower rear corners 186 have a generally elongated tube shape extending from rear ends 200 of side bars 184 and curving upward before connecting to lower ends 206 of rear legs 188. In this example arrangement, rear legs 188 have an elongated tube shape extending from lower ends 206, where rear legs 188 are connected to lower rear corners 186, to upper ends 208, where rear legs 188 connect with seat support section 172.

Seat Support Section 172

Seat support section 172 of frame 16 is formed of any suitable size, shape, and design and is configured to support and facilitate connection of frame 16 with seat 12, while operably connecting arm support section 174 to base section 170. In the arrangement shown, as one example, seat support section 172 includes upper rear corners 214, rear sloped sections 216, center corners 218, side bars 220, and upper front corners 222, among other components.

In this example arrangement, upper rear corners 214 have a generally elongated tube shape extending from upper ends 208 of rear legs 188 and curving upward and forward and then downward and forward before connecting to upper ends 226 of rear sloped sections 216.

In this example arrangement, rear sloped sections 216 have a generally elongated tube shape extending downward at an angle from upper ends 226, where rear sloped sections 216 connect to upper rear corners 214 to lower ends 228, where rear sloped sections 216 connect to center corners 218. In this example arrangement, center corners 218 have a generally elongated tube shape extending from lower ends 228 of rear sloped sections 216 and curving forward to rear ends 234 of side bars 220. In this example arrangement, side bars 220 each have an elongated tube shape extending from rear ends 234, where side bars 220 are connected to center corners 218, to a front end 236 of side bars 220, where side bars 220 are connected to upper front corners 222. In this example arrangement, upper front corners 222 have a generally elongated tube shape extending from front ends 236 of side bars 220 and curving upward and forward and then slightly rearward before connecting to lower ends 256 of front sloped section 242 of arm support section 174.

Arm Support Section 174

Arm support section 174 of frame 16 is formed of any suitable size, shape, and design and is configured to provide an arm rest for an occupant seated in seat 12 while operably connecting backrest 14 with frame 16. In the arrangement shown, arm support section 174 includes front sloped sections 242, front bends 244, a pair of arms 246, rear bends 248, and a rear crossbar 250 connected between rear bends 248.

In this example arrangement, front sloped sections 242 each have a contoured elongated shape extending rearward at an angle from a lower end 256, where front sloped sections 242 connect to upper front corners 222 of seat support section 172, to an upper end 258, where front sloped sections 242 connect to front bend 244. In this example arrangement, front bends 244 have a generally elongated tube shape extending from upper end 258 of front sloped sections 242 and curving rearward before connecting to front end 264 of arms 246. In this example arrangement, arms 246 each have an elongated tube shape extending from front end 264 to rear ends 266, where arms 246 are connected to rear bends 248. In this example arrangement, arms 246 include holes 270 (not shown) located proximate to rear ends 266 and extending sideways through arms 246 to facilitate connection with reclining mechanism 20. In this example arrangement, rear bends 248 connect arms 246 to rear crossbar 250. In this example arrangement, rear bends 248 have a generally elongated tube shape extending from rear end 266 of arms 246 and curving inward before connecting to opposing ends 274 of rear crossbar 250. In this example arrangement, rear crossbar 250 has an elongated tube shape extending between the opposing ends 274 to operably connect right and left sides of the frame 16 together.

In one or more arrangements shown, components of frame 16 are illustrated as separate components and/or sections that are connected together. However, the embodiments are not so limited. Rather, it is contemplated that, in one or more arrangements, frame 16 may be formed as a unitary frame, for example, formed by bending a single tube.

Retractable Wheel Assembly 600

In one or more arrangements shown, as examples, frame 16 includes one or more retractable wheel assemblies 600. Retractable wheel assembly 600 is formed of any suitable size, shape, and design and is configured to allow system 10 to roll over the ground when no user is seated in and/or using system 10 and retract when a user is seated in and/or using system 10 to ensure system 10 stays stationary for the user. In the arrangement shown, as one example, retractable wheel assembly 600 is partially or wholly housed within a portion of frame 16. More specifically, retractable wheel assembly 600 is partially or wholly housed within a wheel compartment 602 of frame 16. In the arrangement shown in FIGS. 15-26, as one example, retractable wheel assembly 600 includes a carrier 604, a spring 606, a bearing 608, and a wheel 610.

In the arrangement shown in FIGS. 15-26, as one example, frame 16 is a hollow, tube shaped member and wheel compartment 602 is formed into the lower side of the legs (such as, as one example, side bars 184) of frame 16. Wheel compartment 602 is formed of any suitable size, shape, and design and is configured to house retractable wheel assembly 600 and its components. In the arrangement shown, as one example, wheel compartment 602 is generally rectangular in shape and is configured to receive the carrier 604 of retractable wheel assembly 600. However, wheel compartment 602 is not so limited and it will be understood by those skilled in the art that wheel compartment 602 may be formed of any other size, shape, and configuration in order to receive carrier 604, including being in the shape of an oval, circle, square, triangle, or any other shape or configuration. In the arrangement shown, as one example, wheel compartment 602 may be formed when frame 16 is formed, such as by cutting, machining, or the like to form wheel compartment 602, or wheel compartment 602 may be retrofitted to frame 16 using a similar process. Likewise, retractable wheel assembly 600 may be included in frame 16 immediately after frame 16 is formed or retractable wheel assembly 600 may be retrofitted to frame 16.

In the arrangements shown in FIGS. 15-26, as one example, retractable wheel assembly 600 includes carrier 604. Carrier 604 is formed of any suitable size, shape, and design and is configured to provide a housing for various other components of retractable wheel assembly 600 and facilitate secured engagement with frame 16. In the arrangement shown, as one example, carrier 604 includes a top side 612, a bottom side 614, opposing left and right sides 616 (or simply "sides 616"), and opposing front and back ends 618 (or simply "ends 618"). In the arrangement shown, as one example, carrier 604 includes a hollow area 620, a bottom plate 622 and engagement members 624.

In the arrangement shown, as one example, carrier 604 is a generally elongated member which extends a length between opposing ends 618, a width between opposing sides 616, and a height between bottom side 614 to top side 612. In the arrangement shown, as one example, when viewed from an end 618, carrier 604 forms a generally I-shaped member with convex curvature on top side 612 and bottom side 614. In the arrangement shown, as one example, carrier 604 may be formed of a hard plastic material, however carrier 604 may be formed of any suitable material to provide a housing for various components of retractable wheel assembly 600 such as, by way of example and not limitation, a composite plastics material, a fiberglass material, a metallic material, or any other material. In the arrangement shown as one example, carrier 604 is a unitary member which is formed using a process such as extrusion, molding, additive manufacturing, or the like to for a unitary member. Alternatively, carrier 604 may be formed of several members which are joined together through a process such as adhesion, friction fitting, screwing, welding, or the like.

In the arrangement shown, as one example, carrier 604 also includes an opening 626 extending through carrier 604 from one side 616 to the other side 616. Opening 626 is formed of any suitable size, shape, and design and is configured to allow spring 606 to pass through carrier 604. In the arrangement shown, as one example, opening 626 is generally circular in shape, however opening 626 may be formed of any other shape or configuration to allow spring 606 to pass through carrier 604.

In the arrangement shown, as one example, carrier 604 also includes slot 628 on bottom side 614. Slot 628 is formed of any suitable size, shape, and design and is configured to allow bearing 608 and wheel 610 to extend through bottom side 614 of carrier 604. In the arrangement shown, as one example, slot 628 extends through bottom side 614 of carrier 604 such that bearing 608 and wheel 610 may rest within carrier 604. In the arrangement shown as one example, slot 628 is generally elongated and/or ovular in shape with an additional extension providing a greater width at or near the middle of the elongated slot 628. In the arrangement shown, as one example, slot 628 of carrier 604 is configured to align with slot 630 of bottom plate 622, thereby allowing bearing 608 and wheel 610 to extend through both the bottom side 614 of carrier 604 and bottom plate 622.

In the arrangement shown, as one example, carrier 604 includes bottom plate 622. Bottom plate 622 is formed of any suitable size, shape, and design and is configured to connect to carrier 604 and facilitate engagement with frame 16. In the arrangement shown, as one example, bottom plate 622 is generally rectangular in shape and has a generally convex curvature when viewed from an end 618 or carrier 604. In this way, bottom plate 622 is able to closely and tightly engage with the generally convex bottom side 614 of carrier 604. Bottom plate 622 may be formed separately from carrier 604 and joined to carrier 604 through a process of adhesion, friction fitting, or the like, or bottom plate 622 may be formed as a part of carrier 604.

In the arrangement shown, as one example, bottom plate 622 is sized such that when retractable wheel assembly 600 is attached to frame 16, the edges of bottom plate 622 rest on frame 16, or in other words rest outside of wheel compartment 602, while the remainder of carrier 604 rests within wheel compartment 602. In this way, in the arrangement shown, as one example, bottom plate 622 facilitates engagement with frame 16.

In the arrangement shown, as one example, bottom plate 622 includes a slot 630. Slot 630 is formed of any suitable size, shape, and design and is configured to allow bearing 608 and wheel 610 to extend through bottom plate 622. In the arrangement shown, as one example, slot 630 extends through bottom plate 622 such that bearing 608 and wheel 610 may pass through bottom plate 622. In the arrangement shown, as one example, slot 630 is generally elongated and/or ovular in shape with an additional extension providing a greater width at or near the middle of the elongated slot 630. In the arrangement shown, as one example, slot 630 of bottom plate 622 is configured to align with slot 628 of carrier 604, thereby allowing bearing 608 and wheel 610 to extend through both the bottom side 614 of carrier 604 and bottom plate 622.

In the arrangement shown, as one example, carrier 604 includes engagement members 624. Engagement members 624 are formed of any suitable size, shape, and design and are configured to facilitate engagement with frame 16. In the arrangement shown, as one example, there are four engagement members 624, with two engagement members 624 extending outward from one side 616 of carrier 604, with one engagement member 624 positioned near one end 618 and one engagement member 624 positioned near the other end 618, and two engagement members 624 extending outward from the other side 616 of carrier 604, with one engagement member 624 positioned near one end 618 and one engagement member 624 positioned near the other end 618. However, engagement members 624 are not so limited and any number and layout of engagement members 624 may be used without departing from the scope of the invention. In the arrangement shown, as one example, engagement members 624 may be joined to carrier 604 such as, by way of example and not limitation, through adhesion, screwing, bolting, or the like. Alternatively, engagement members 624 may be formed as a part of carrier 604 such as, by way of example and not limitation, molding, additive manufacturing, or the like.

In the arrangement shown, as one example, engagement members 624 extend outward from sides 616 of carrier 604 a distance sufficient to contact the interior side of frame 16 when carrier 604 is inserted into wheel compartment 602. In the arrangement shown, as one example, when engagement members 624 make contact with the interior sides of wheel compartment 602, carrier 604 is tightly and securely engaged with wheel compartment 602. In this way, in the arrangement shown, as one example, engagement members 624 facilitate the easy removal of carrier 604 from frame 16 for cleaning purposes.

In the arrangement shown, as one example, retractable wheel assembly 600 includes spring 606. Spring 606 is formed of any suitable size, shape, and design and is configured to provide a means for wheel 610 to retract when a user is seated in and/or using system 10. In the arrangement shown, as one example, spring 606 is a helical spring. More specifically, in the arrangement shown in FIGS. 15-26, spring 606 is a hatch spring or a spring of similar type which is configured to generally rest in a compressed position and extend when non-compressive forces are applied to it, such as when a certain amount of force is applied near the center of spring 606 in a direction which is not generally parallel to spring 606. Further, in the arrangement shown, as one example, spring 606 includes a center axis 607.

Figure 22A:
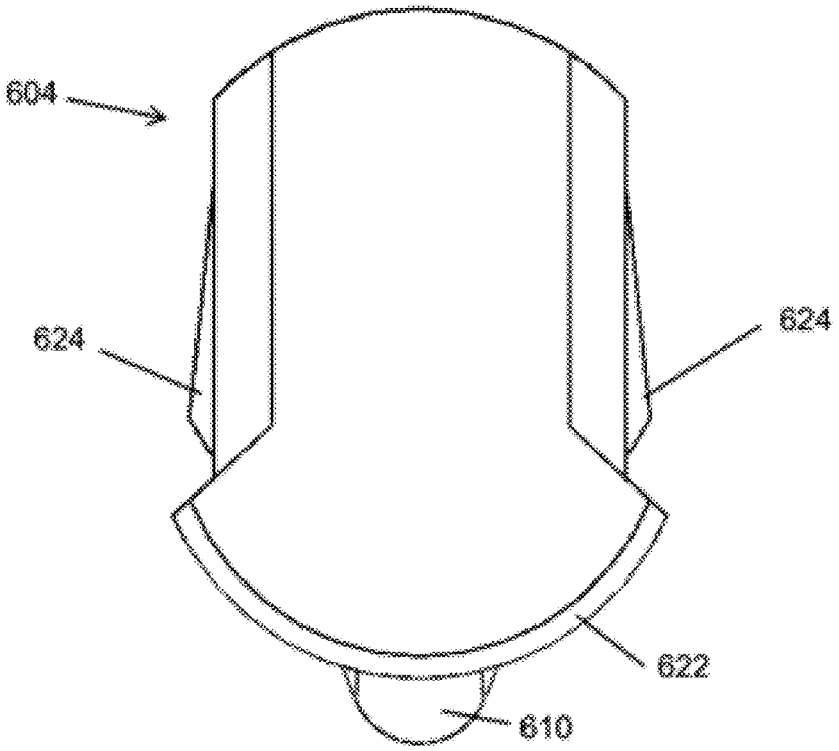
FIG. 22A is a side elevation view of a carrier of a chair in accordance with one or more arrangements.
Figure 22B:
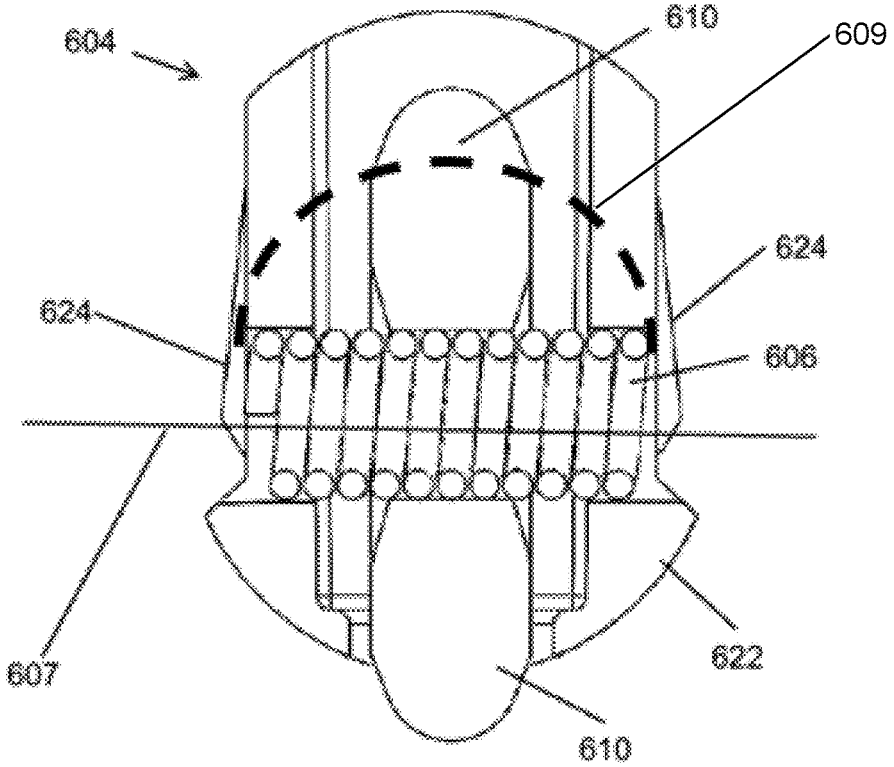
FIG. 22B is a section view of a carrier of a chair in accordance with one or more arrangements, the view showing the carrier with a spring and a dotted line representing the spring when it is laterally compressed.
Figure 23A:
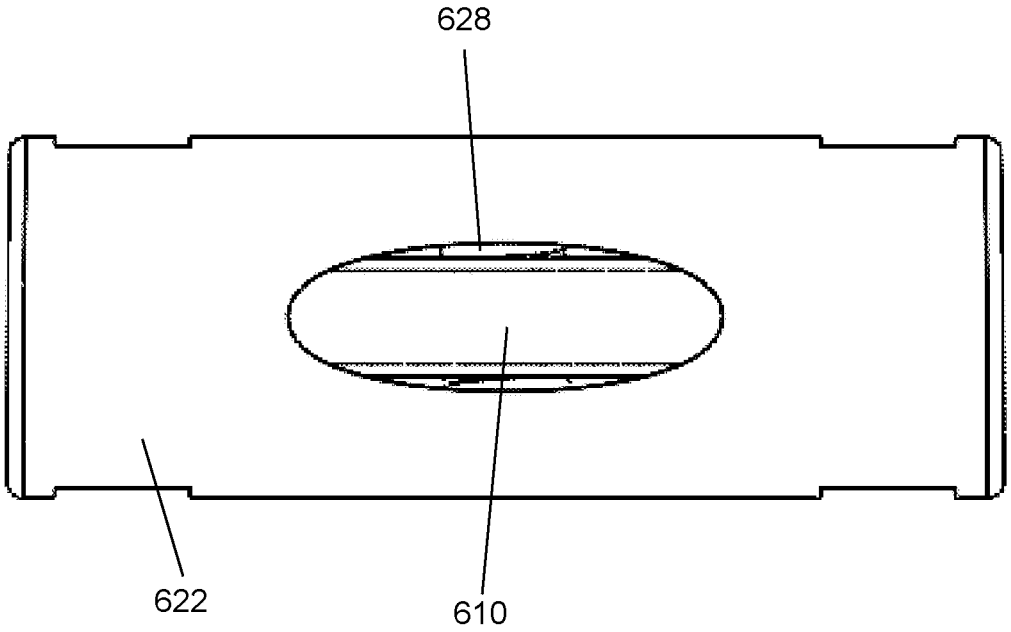
FIG. 23A is a bottom elevation view of a bottom plate of a carrier of a chair in accordance with one or more arrangements.
Figure 23B:
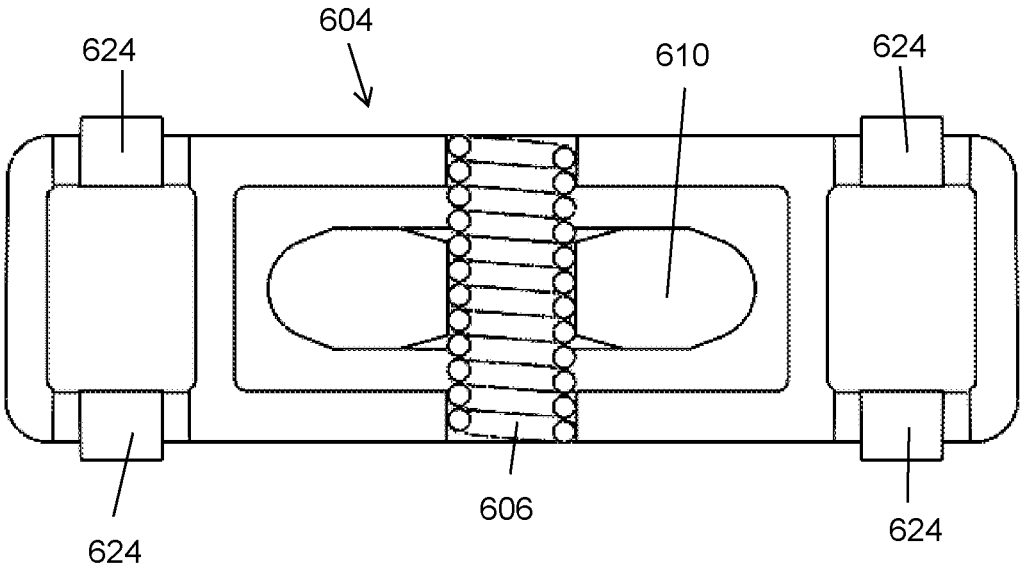
FIG. 23B is a bottom elevation view of a carrier of a chair in accordance with one or more arrangements.
Figure 24:
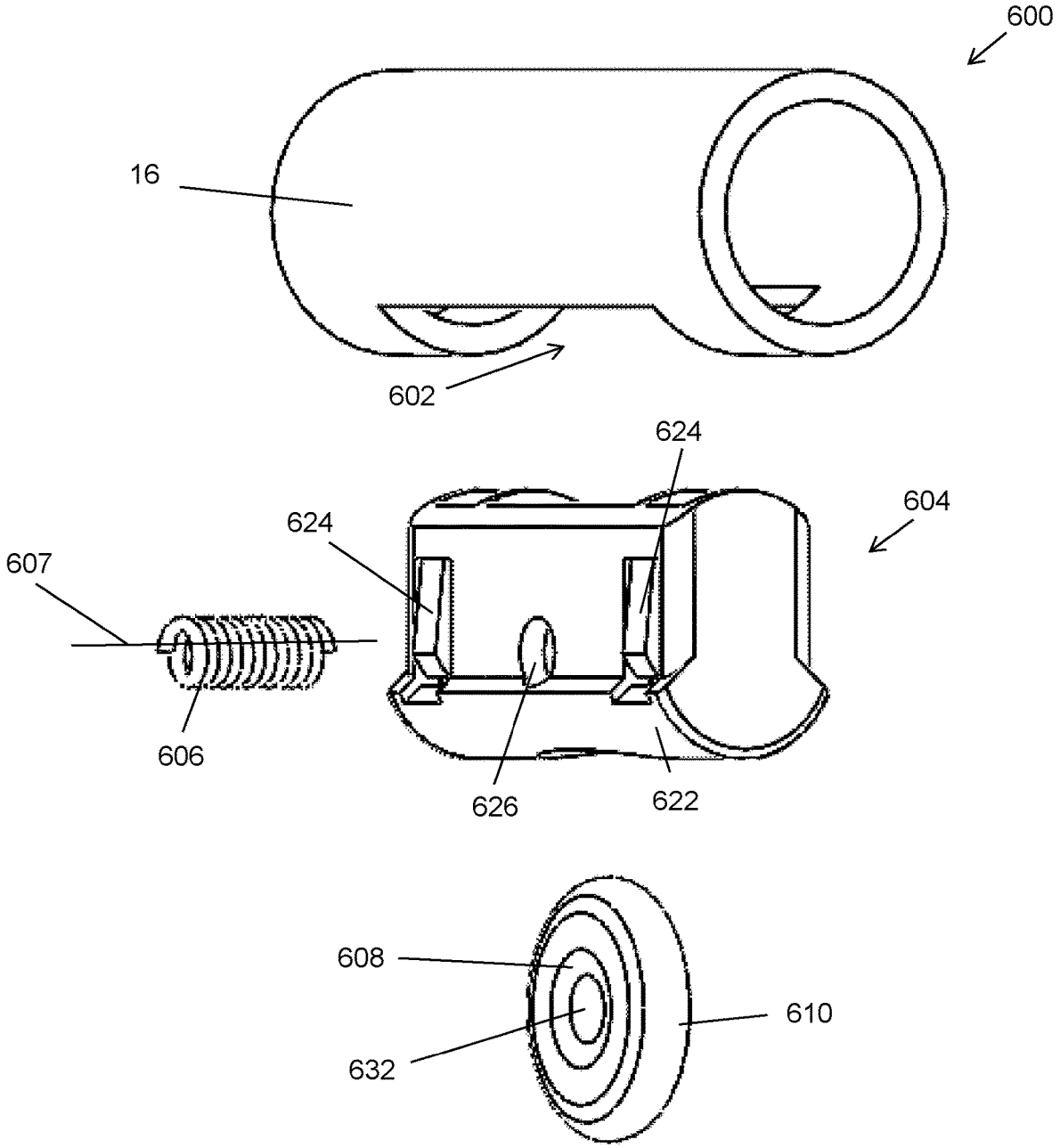
FIG. 24 is an exploded view of a retractable wheel assembly of a frame of a chair in accordance with one or more arrangements, the view showing the retractable wheel assembly having a carrier and a wheel.
Figure 25:
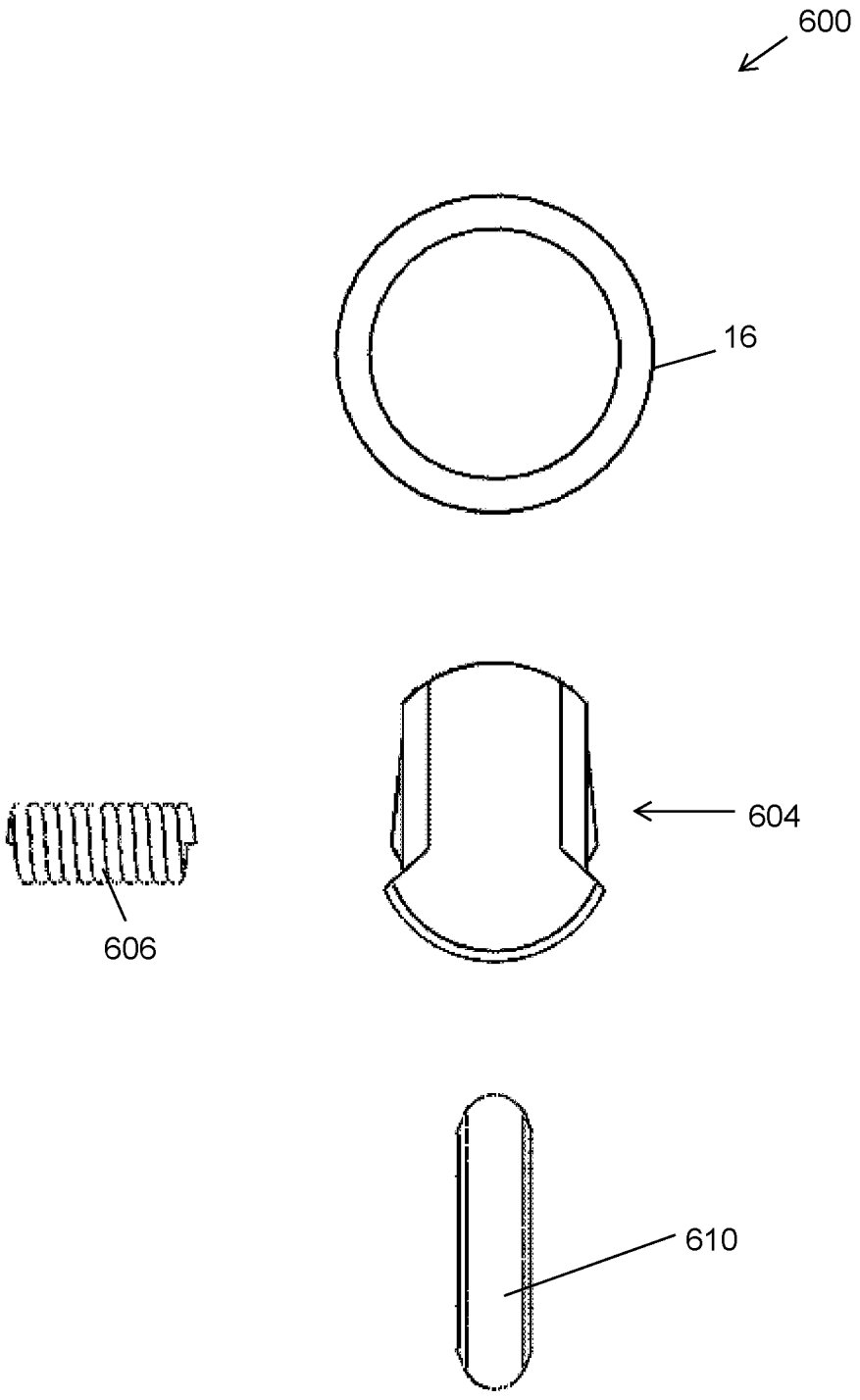
FIG. 25 is an exploded view of a retractable wheel assembly of a frame of a chair in accordance with one or more arrangements.
Figure 26:
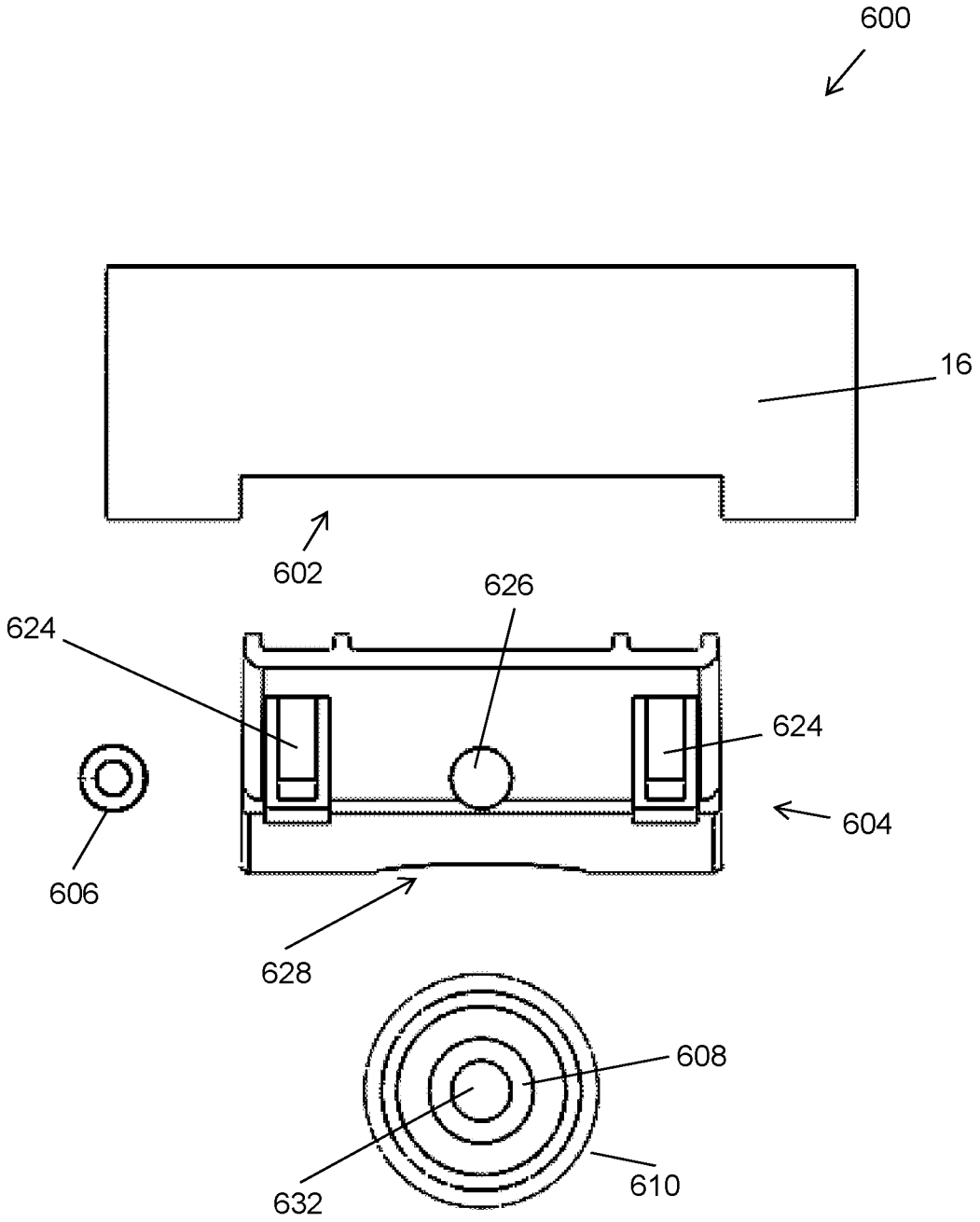
FIG. 26 is an exploded side view of a retractable wheel assembly of a frame of a chair in accordance with one or more arrangements, the retractable wheel assembly having a wheel and a carrier.
Figure 27:
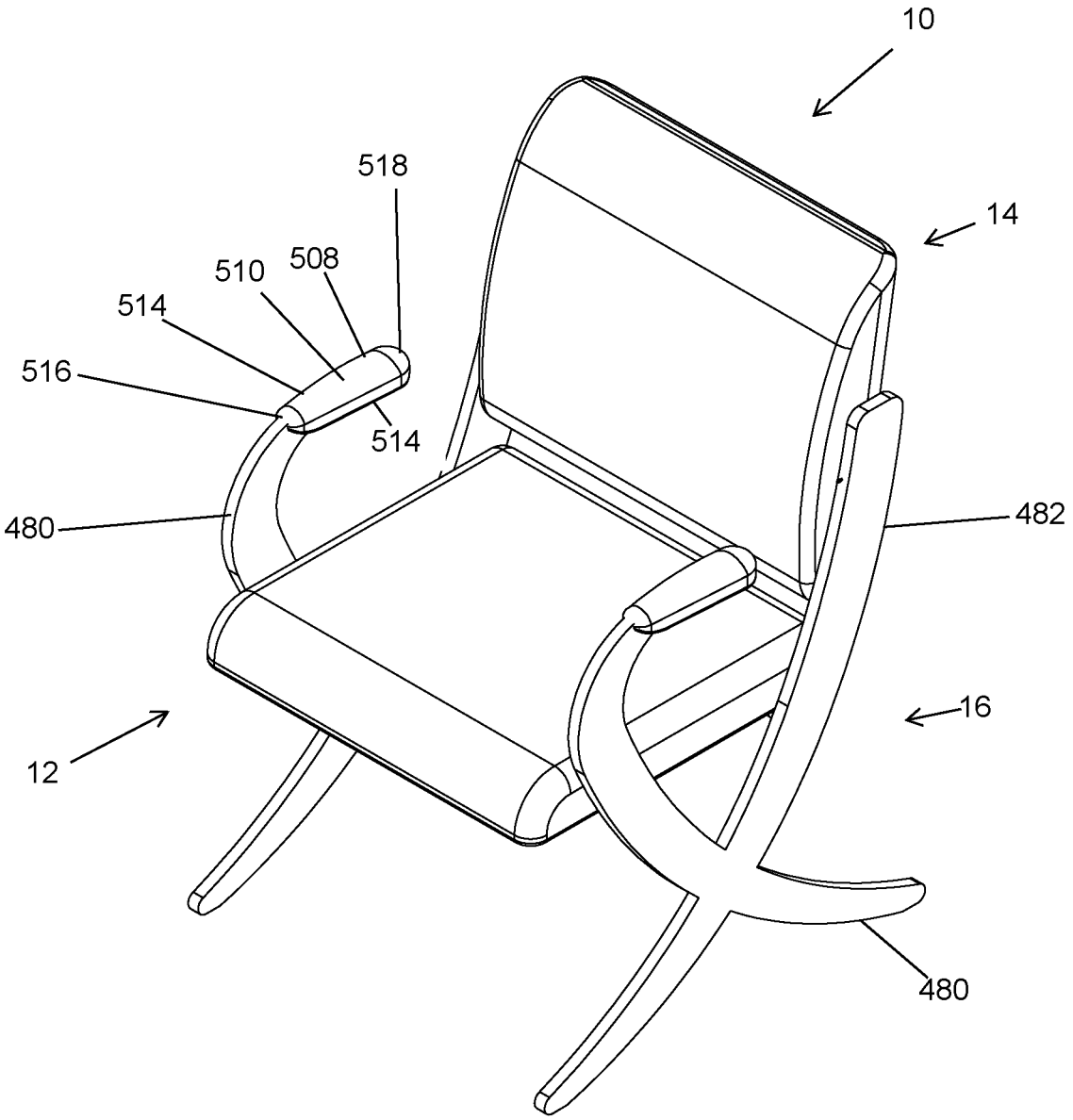
FIG. 27 is a front perspective view of a chair in accordance with one or more arrangements, the view showing the chair having a seat, a backrest, a frame, and arm covers.
Figure 28:
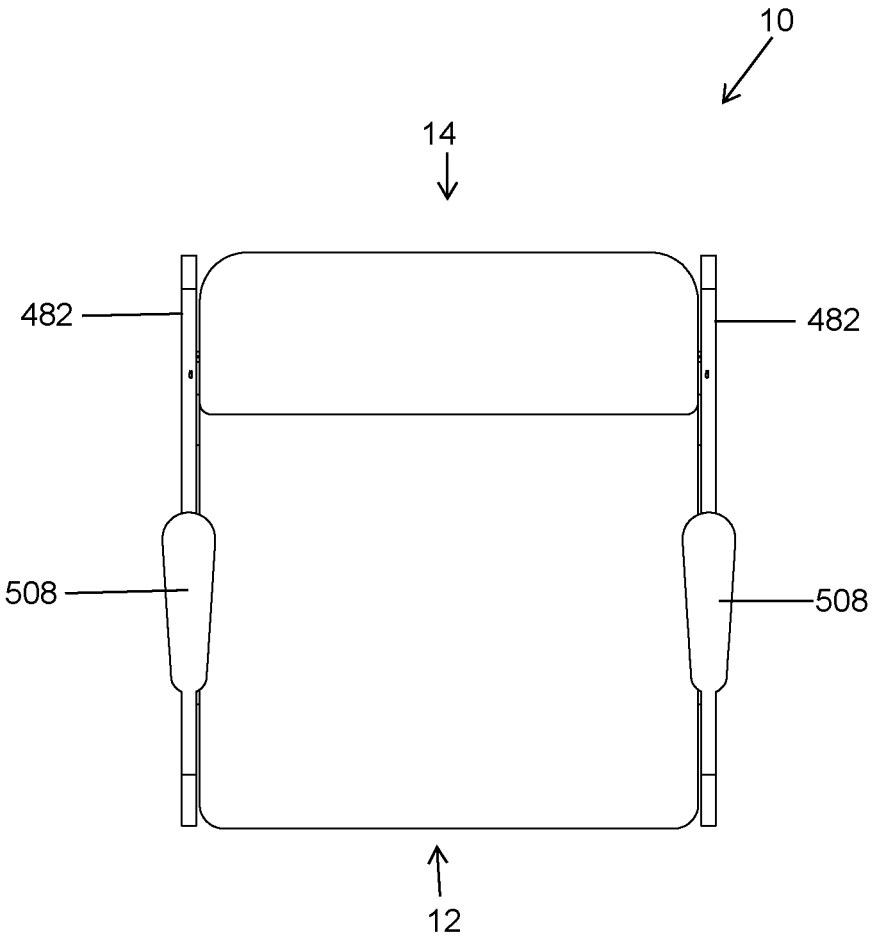
FIG. 28 is a top elevation view of a chair in accordance with one or more arrangements, the view showing the chair having a seat, a backrest, a frame, and arm covers.
Figure 29:
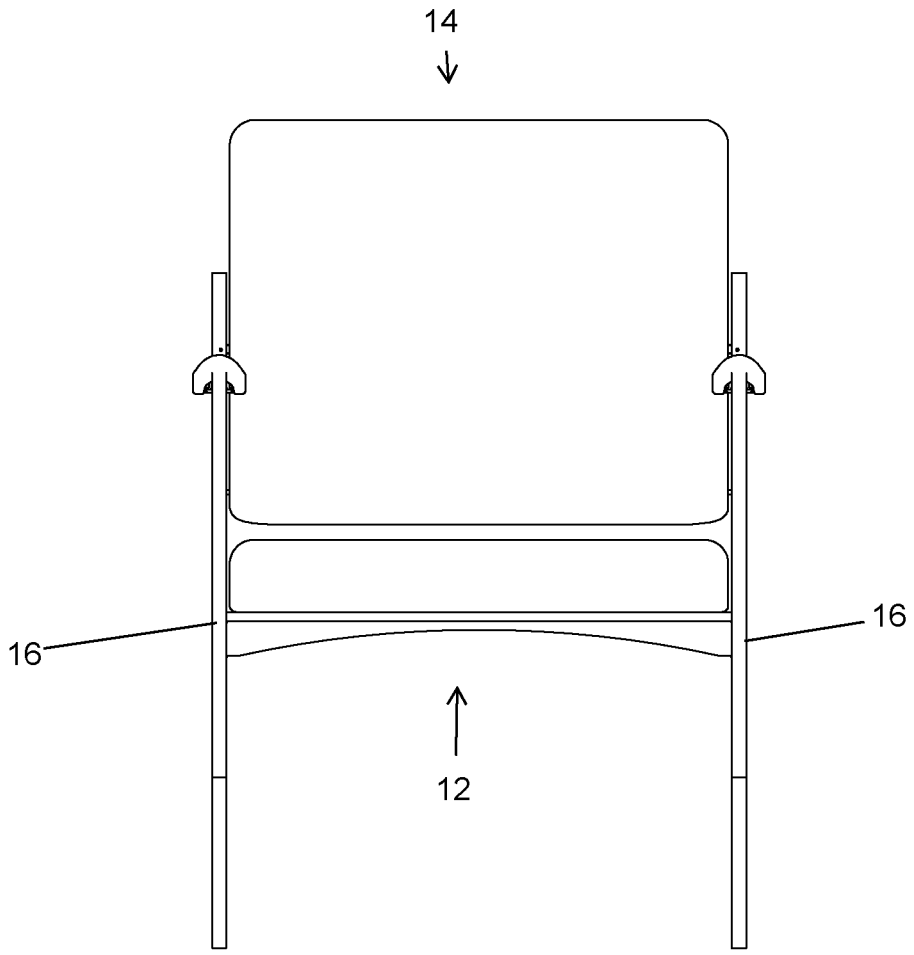
FIG. 29 is a front elevation view of a chair in accordance with one or more arrangements, the view showing the chair having a seat, a backrest, and a frame.
Figure 30:
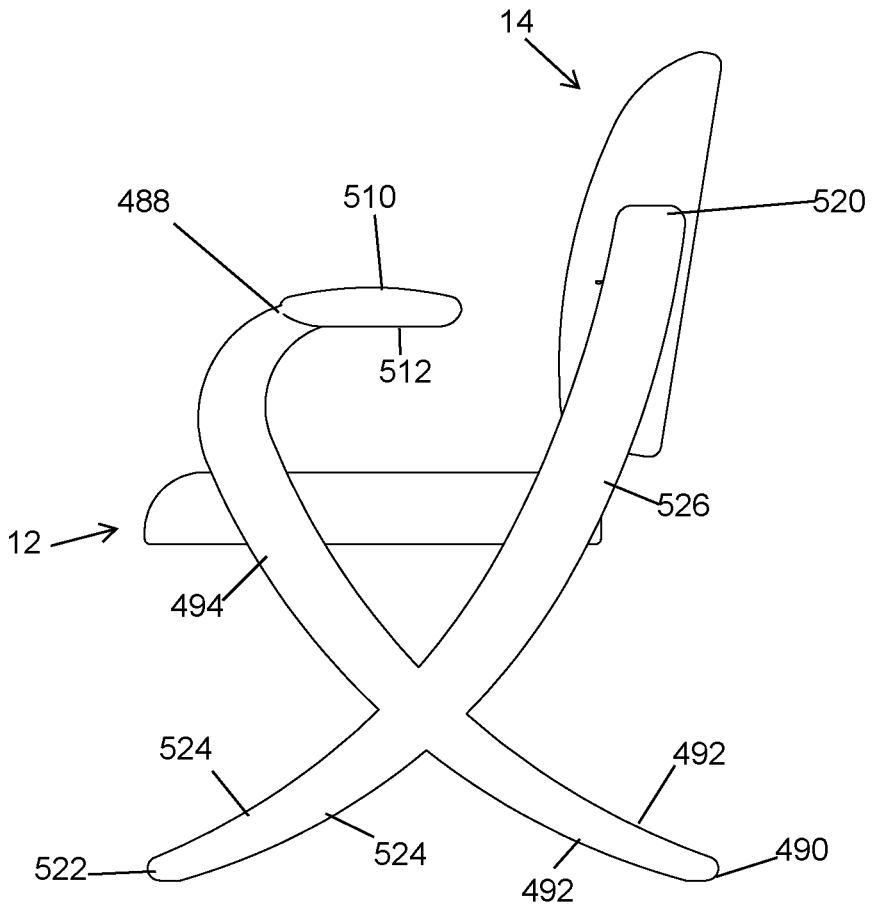
FIG. 30 is a left elevation view of a chair in accordance with one or more arrangements, the view showing the chair having a backrest, arm covers, a frame, and a seat.
Figure 31:
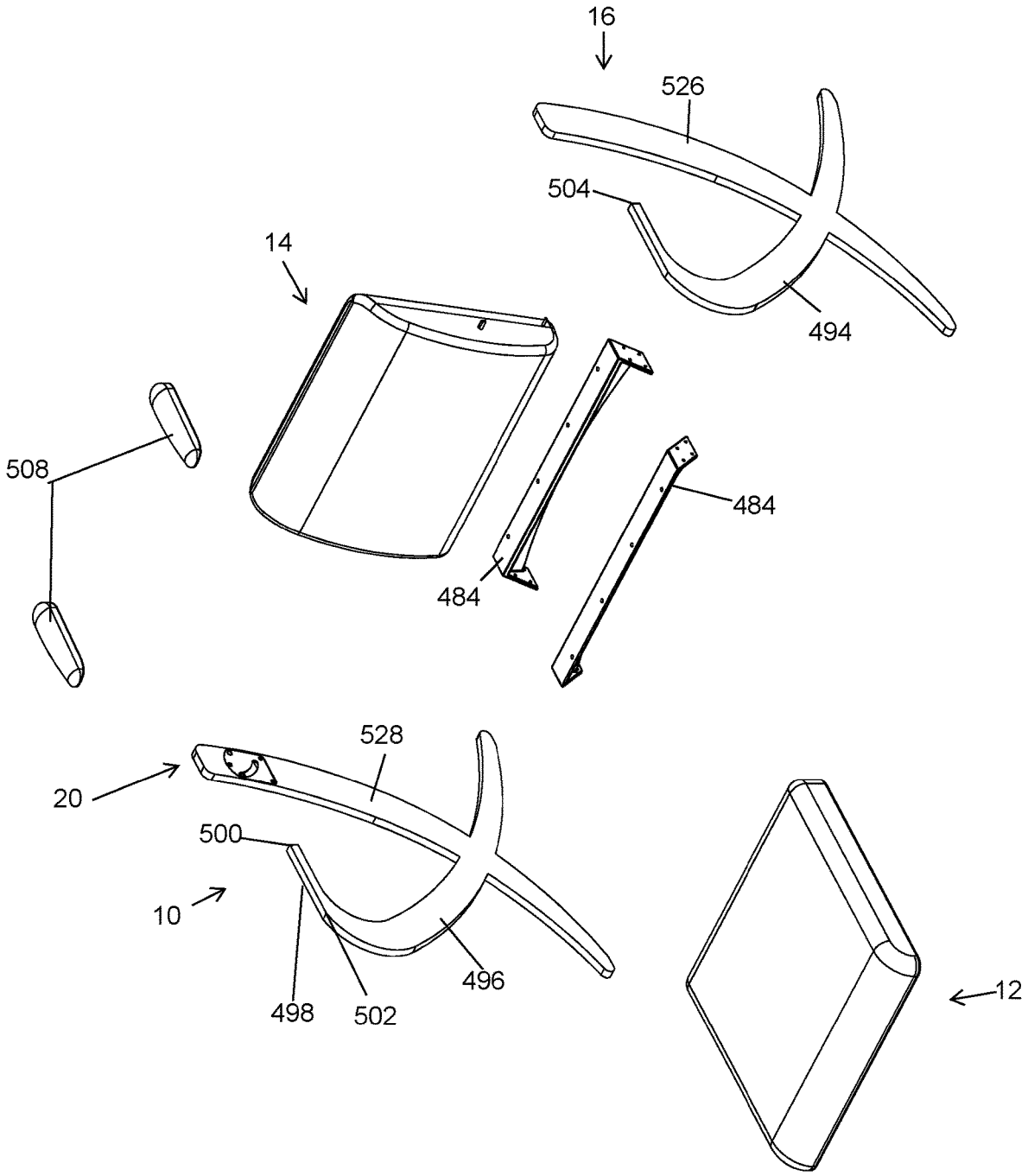
FIG. 31 is an exploded view of a chair in accordance with one or more arrangements, the view showing the chair having first legs, second legs, a seat, a backrest, and arm covers.
Figure 32:
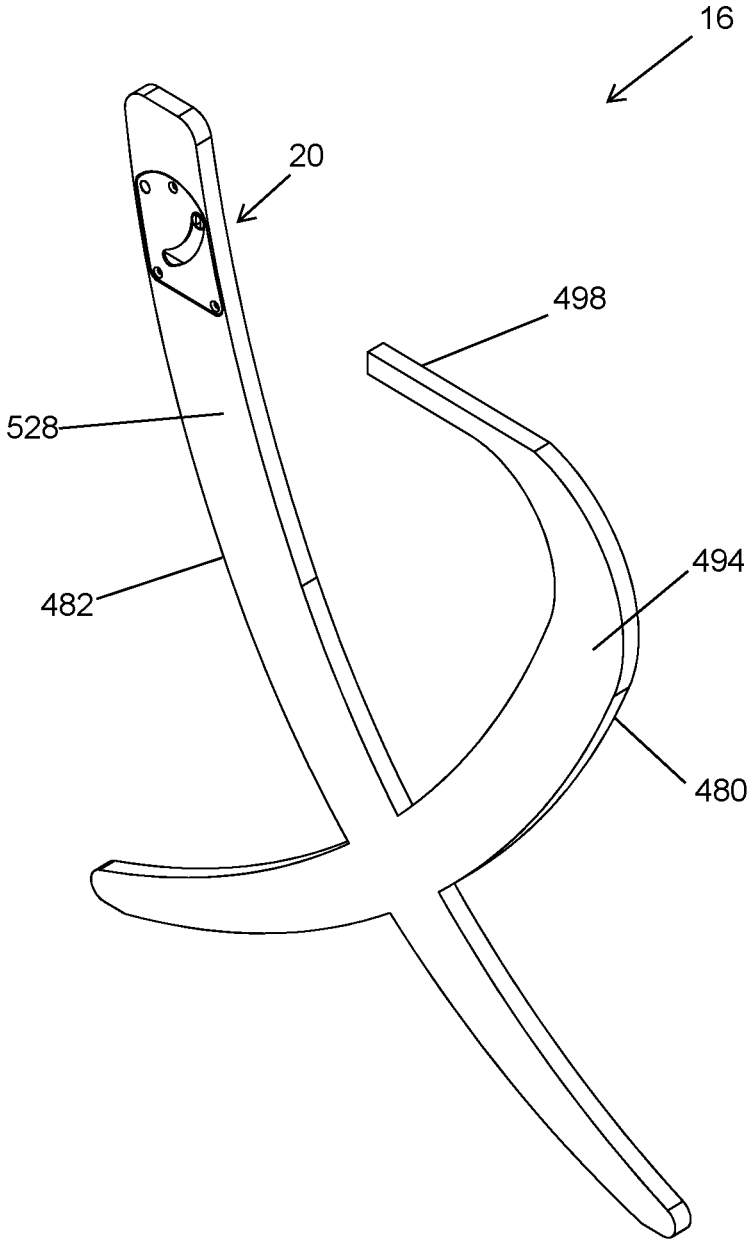
FIG. 32 is a perspective view of a frame of a chair in accordance with one or more arrangements, the view showing the chair having first legs and second legs.
Figure 33:
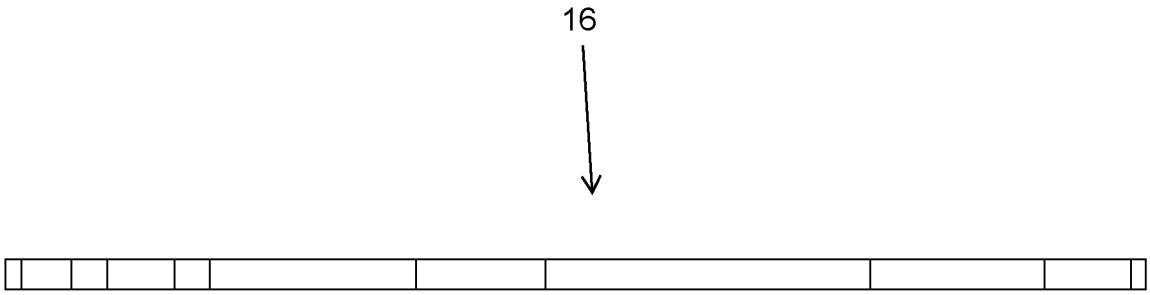
FIG. 33 is an elevation view of a frame of a chair in accordance with one or more arrangements.
Figure 34:
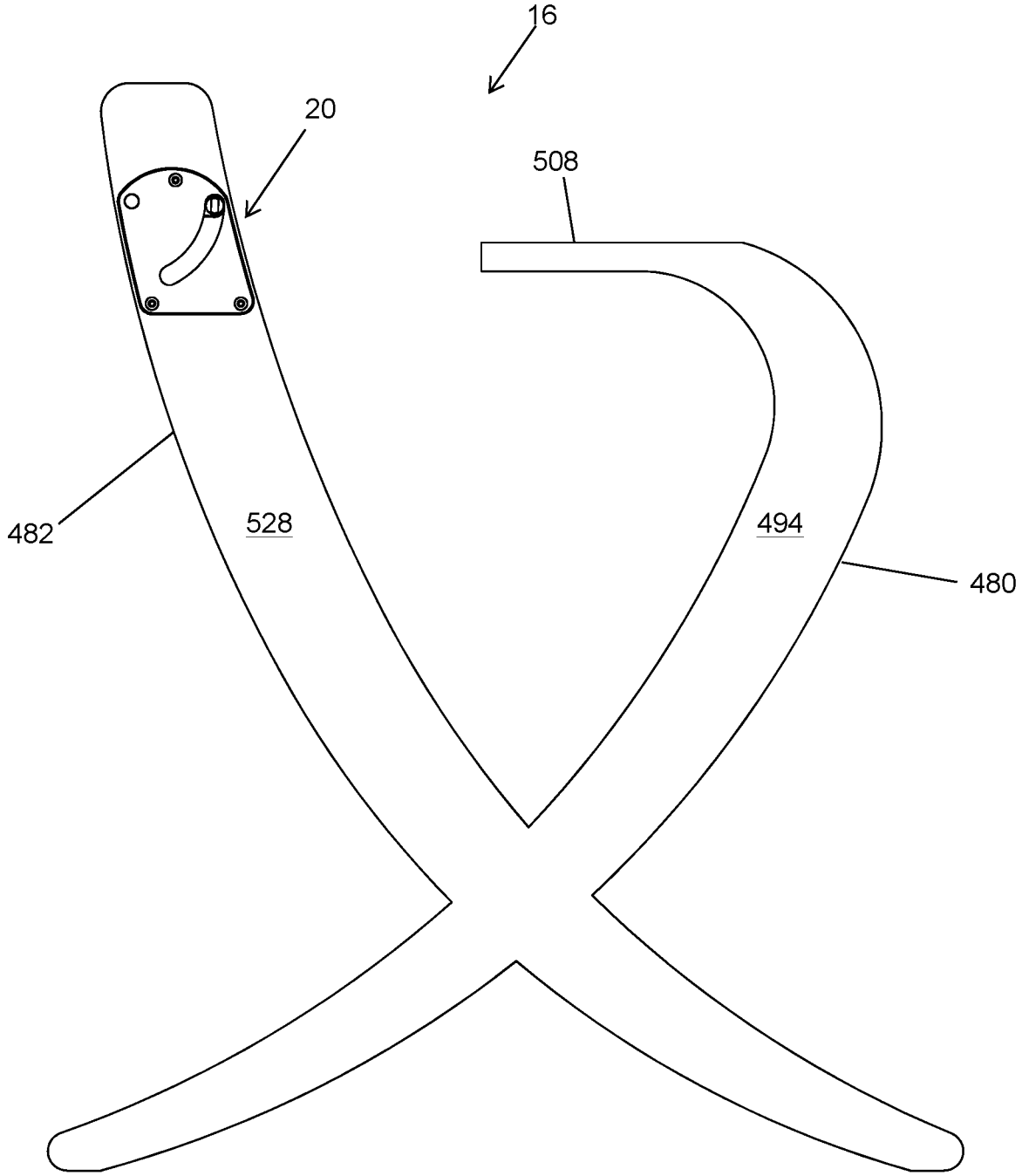
FIG. 34 is a right elevation view of a frame of a chair in accordance with one or more arrangements, the view showing the chair having first legs and second legs.
Figure 35:
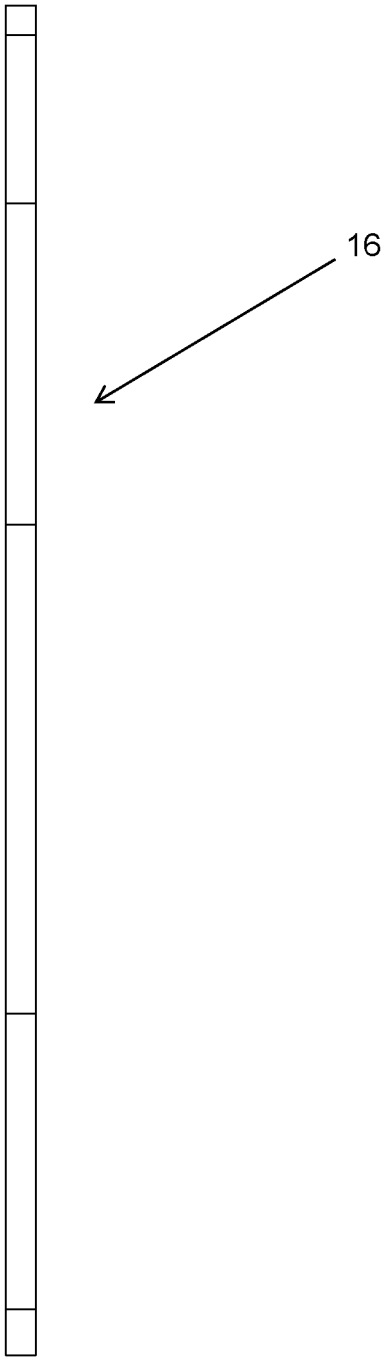
FIG. 35 is an elevation view of a frame of a chair in accordance with one or more arrangements.
Figure 36:
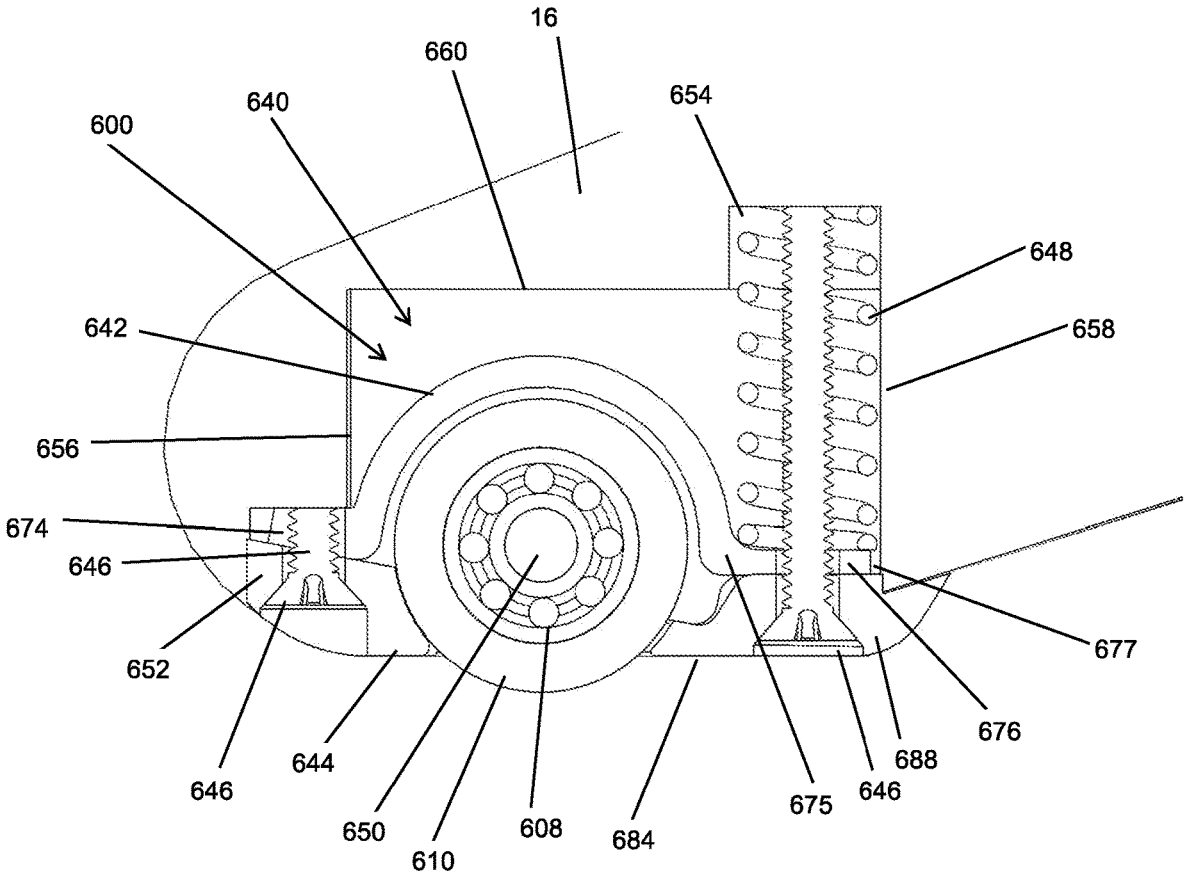
FIG. 36 is a section view of a frame of a chair in accordance with one or more arrangements, the view showing the frame of the chair having a retractable wheel assembly.
Figure 37:
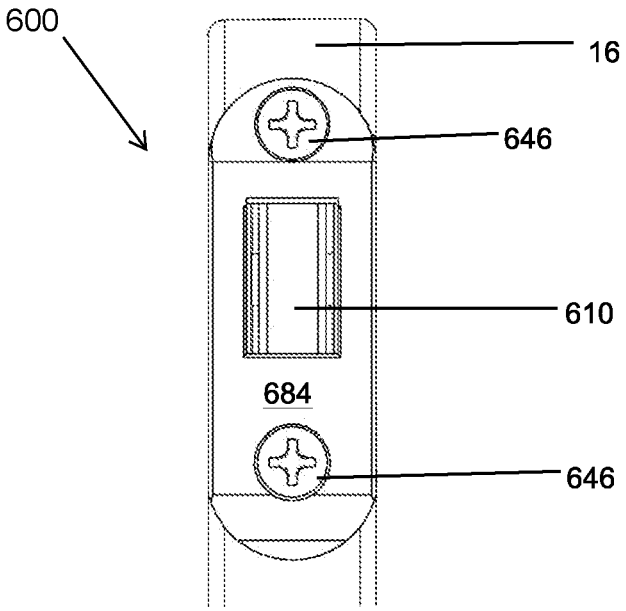
FIG. 37 is a bottom elevation view of a frame of a chair in accordance with one or more arrangements, the view showing the frame of the chair having a retractable wheel assembly with a wheel.
Figure 38:
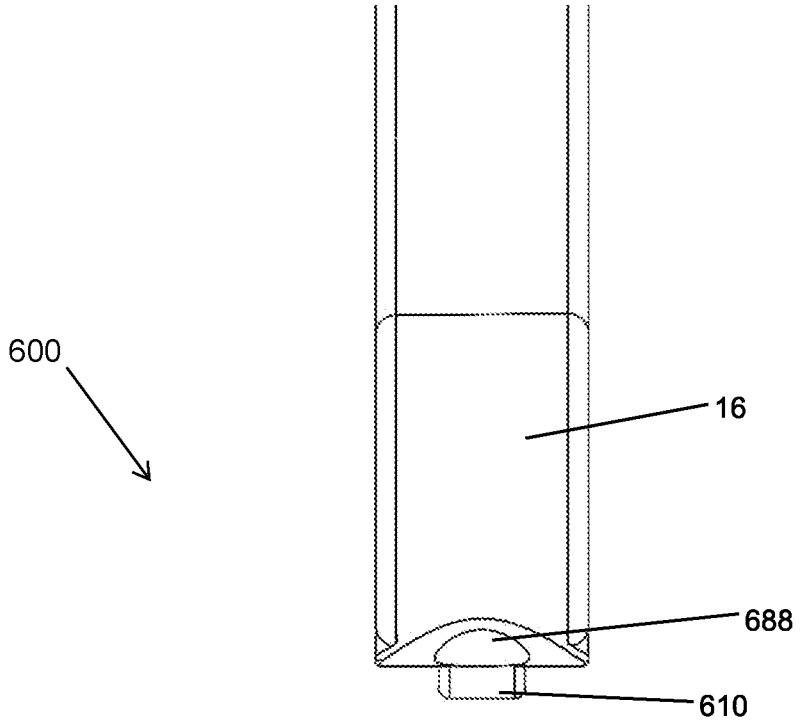
FIG. 38 is a rear elevation view of a frame of a chair in accordance with one or more arrangements, the view showing the frame of the chair having a retractable wheel assembly with a wheel extended.
Figure 39:
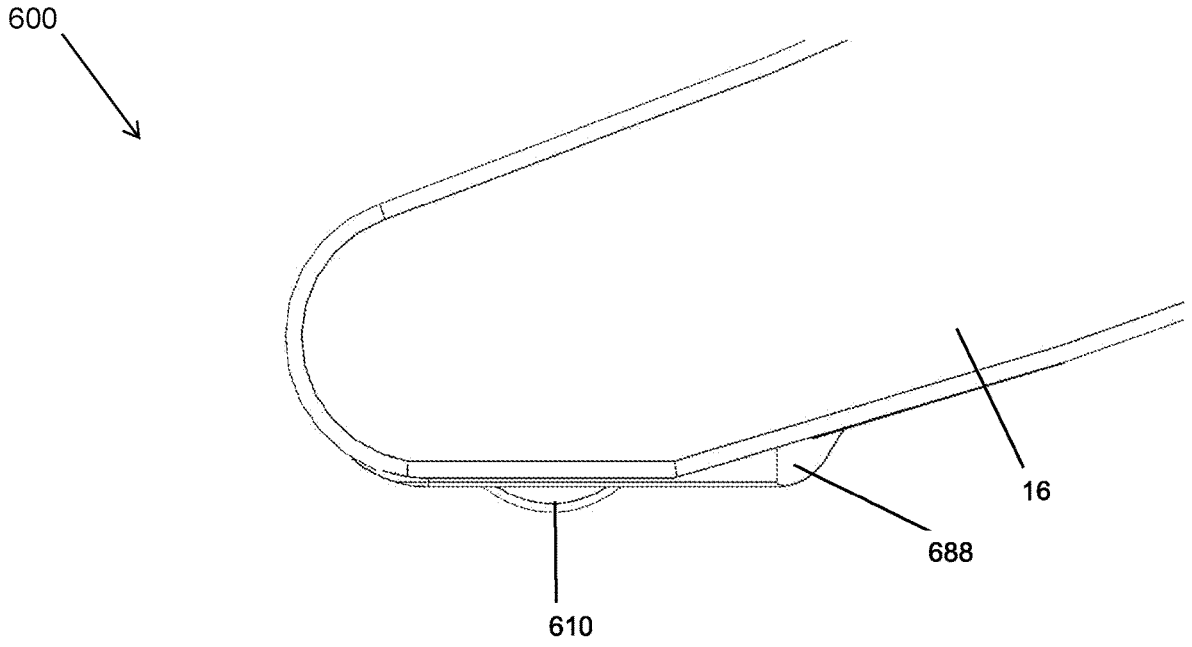
FIG. 39 is a side elevation view of a frame of a chair in accordance with one or more arrangements, the view showing the frame of the chair having a retractable wheel assembly with a wheel extended.
Figure 40:
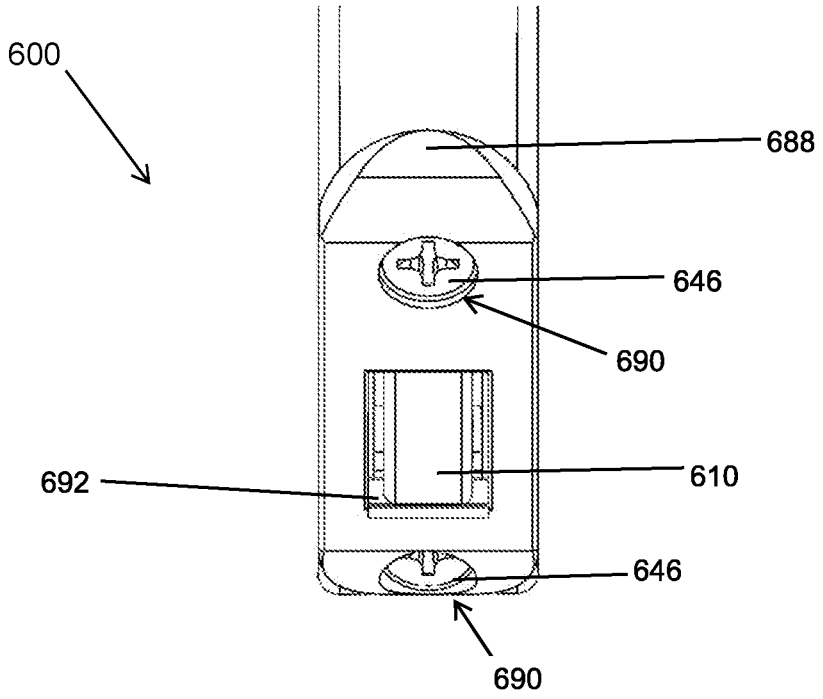
FIG. 40 is a bottom elevation view of a frame of a chair in accordance with one or more arrangements, the view showing the frame of the chair having a retractable wheel assembly with a wheel extended.
Figure 41:
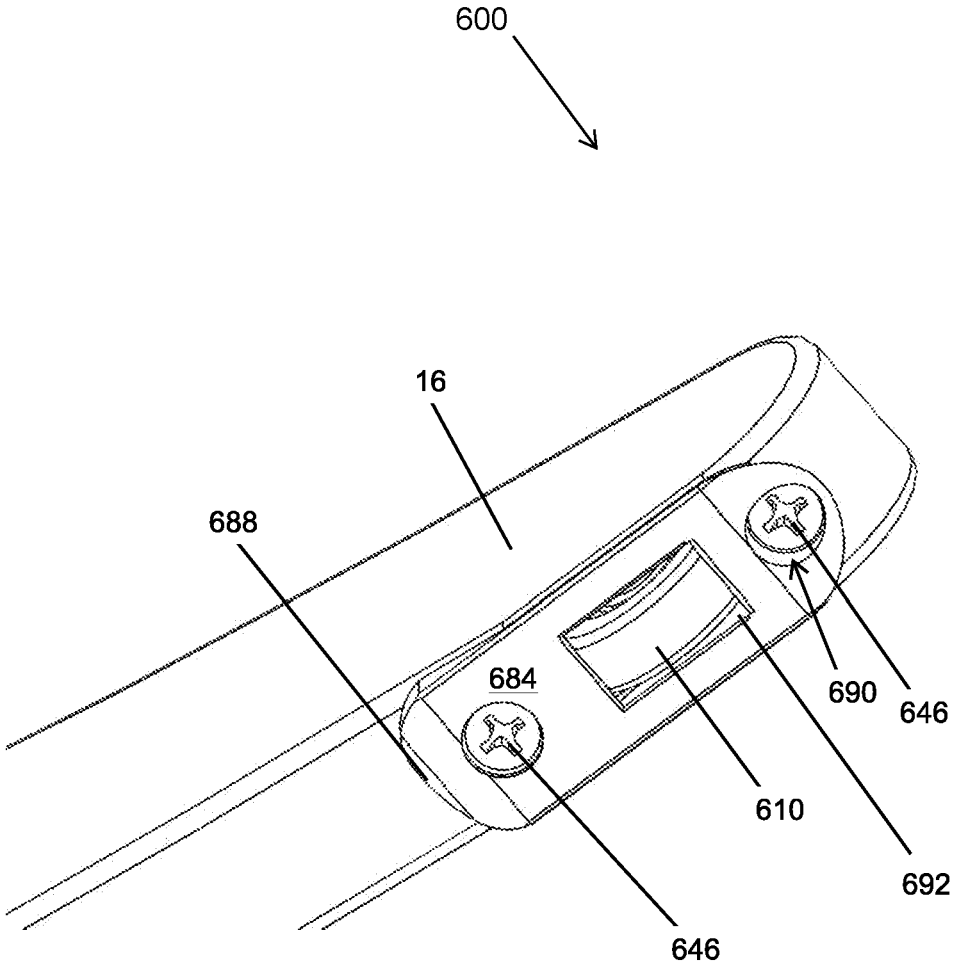
FIG. 41 is a bottom perspective view of a frame of a chair in accordance with one or more arrangements, the view showing the frame of the chair having a retractable wheel assembly with a wheel extended.
Figure 42:
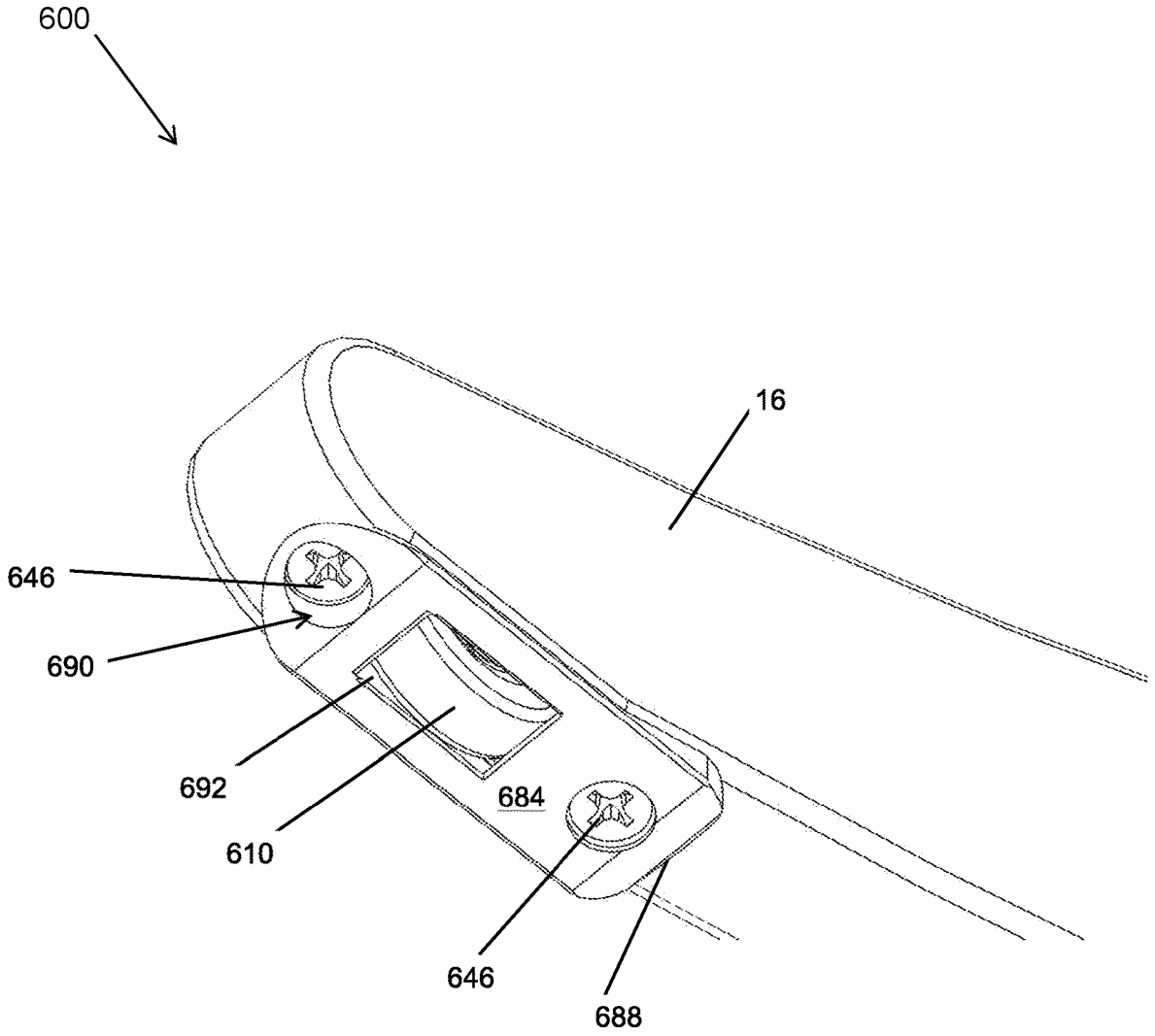
FIG. 42 is a bottom perspective view of a frame of a chair in accordance with one or more arrangements, the view showing the frame of the chair having a retractable wheel assembly with a wheel extended.
Figure 43:
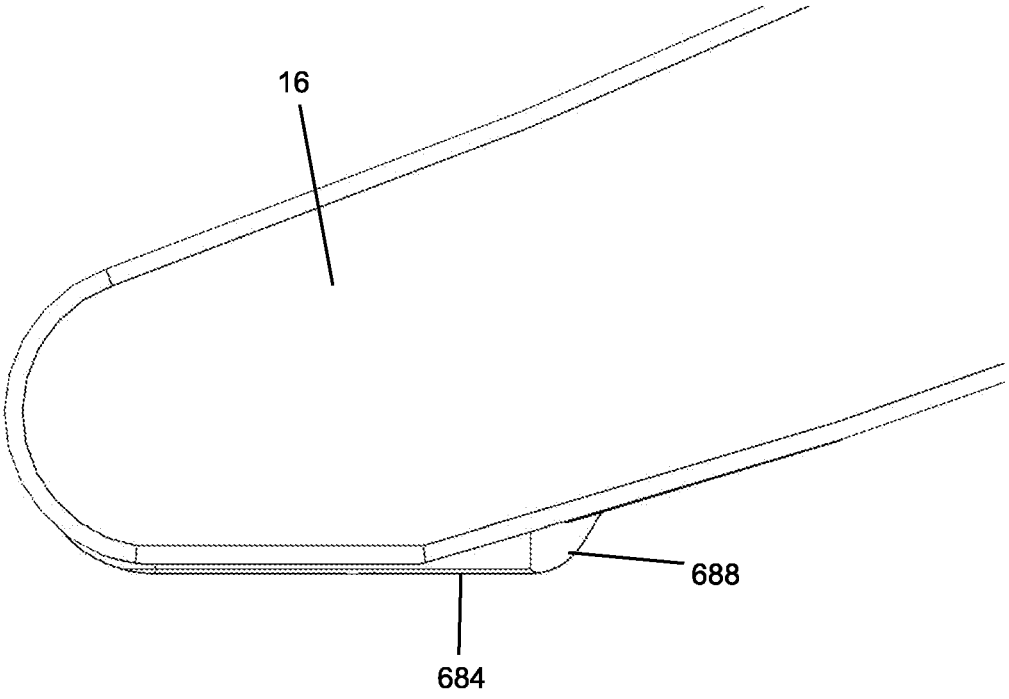
FIG. 43 is a side elevation view of a frame of a chair in accordance with one or more arrangements.
Figure 44:
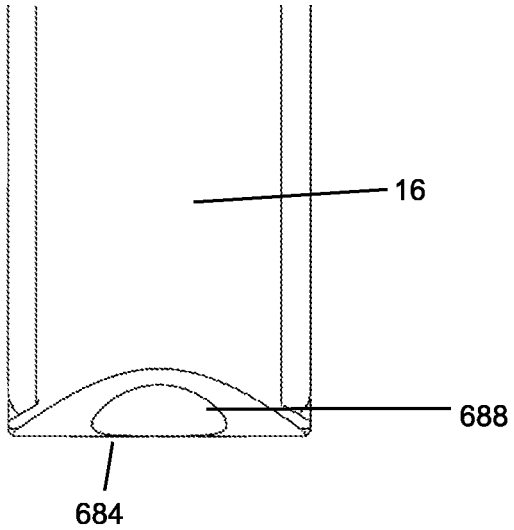
FIG. 44 is a rear elevation view of a frame of a chair in accordance with one or more arrangements.
Figure 45:
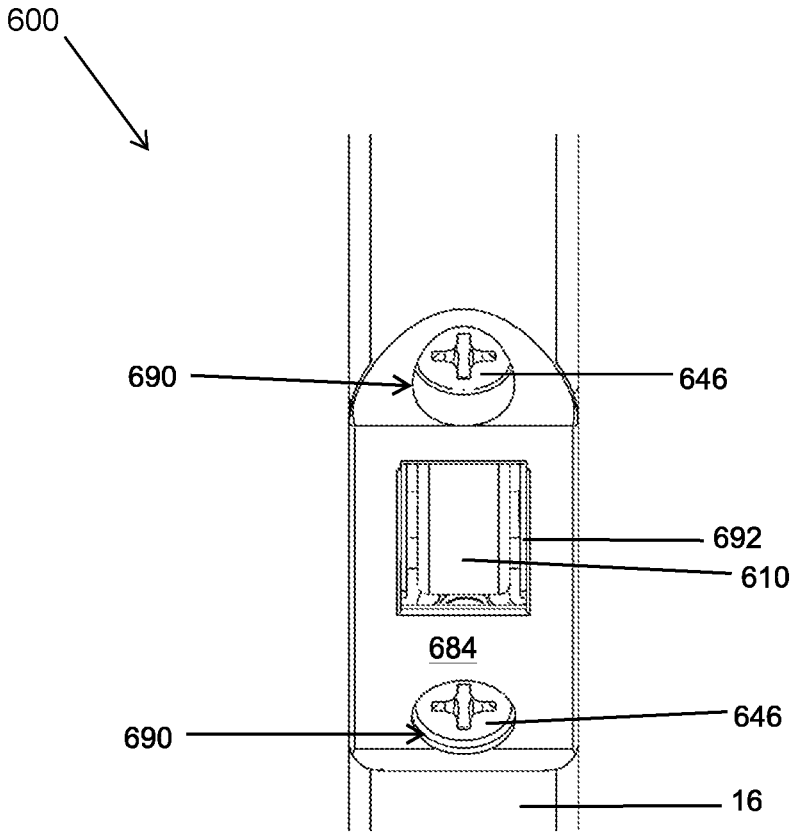
FIG. 45 is a bottom elevation view of a frame of a chair in accordance with one or more arrangements, the view showing the frame of the chair having a retractable wheel assembly with a wheel retracted.
Figure 46:
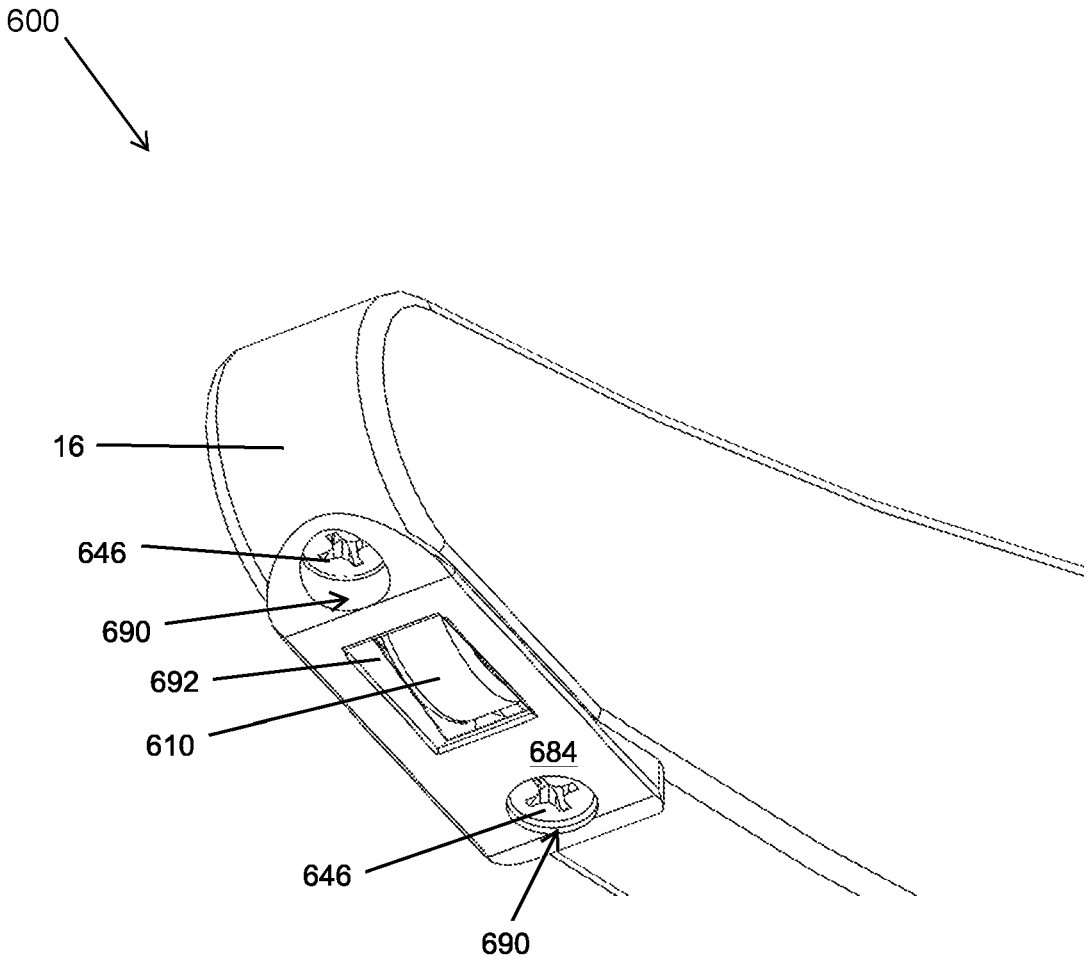
FIG. 46 is a bottom perspective view of a frame of a chair in accordance with one or more arrangements, the view showing the frame of the chair having a retractable wheel assembly with a wheel retracted.
Figure 47:
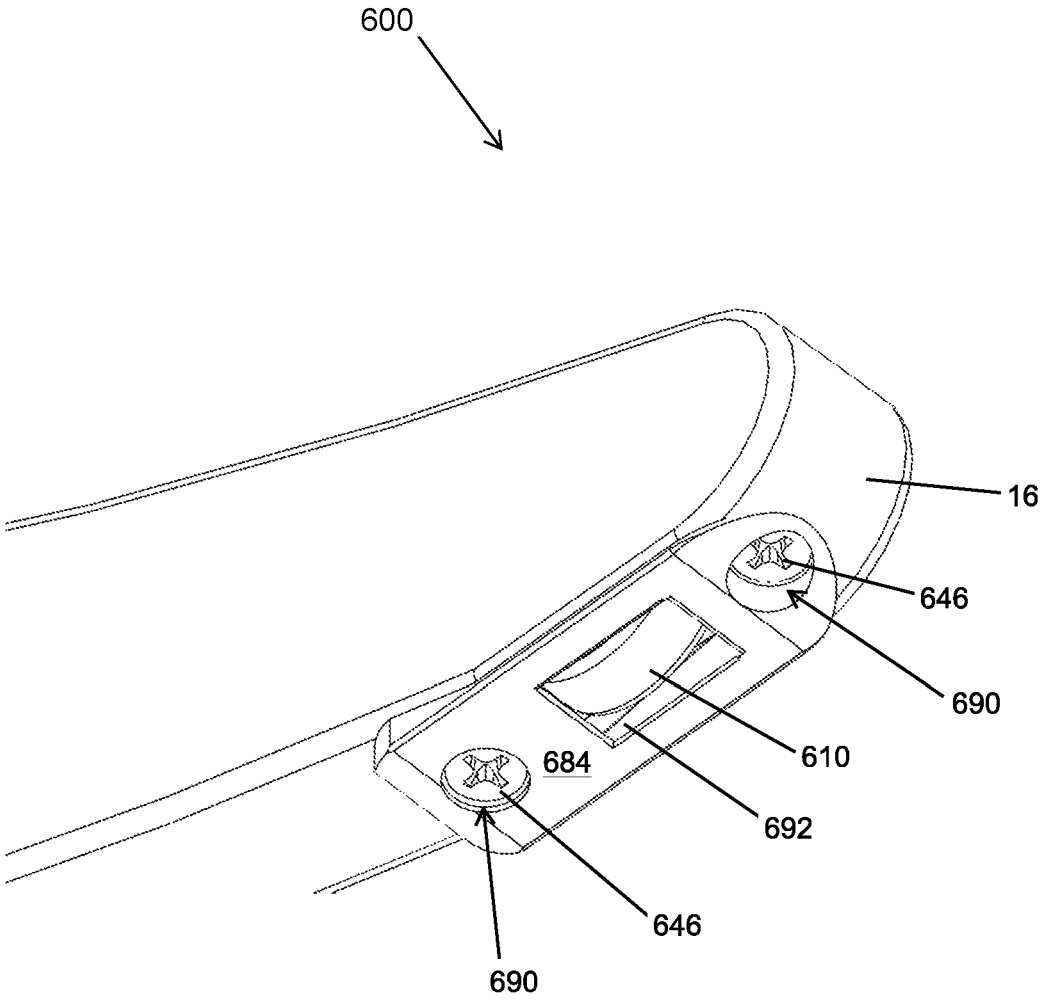
FIG. 47 is a bottom perspective view of a frame of a chair in accordance with one or more arrangements, the view showing the frame of the chair having a retractable wheel assembly with a wheel retracted.

With reference to FIG. 22B, as one example, lateral compression of spring 606 is represented by dotted line 609. That is, when a force is applied downward on system 10, wheel 610 is forced upward and spring 606 compresses in approximate perpendicular alignment to the center axis 607 of the length of spring 606. This lateral compression actually bends spring 606 out of straight-line alignment with the center axis 607 of spring 606. This extends the length of spring 606 as spring 606 bends out of straight-line alignment (which is depicted by dotted line 609). This lateral compression builds tension within spring 606 and actually causes the coils of spring 606 to stretch, with space forming between some of the adjacent coils of spring 606. This lateral compression allows wheel 610 to retract within system 10 as spring 606 bends out of parallel alignment with center axis 607.

In the arrangement shown, as one example, spring 606 extends through opening 626 of carrier 604 from one side 616 of carrier 604 to the other side 616 of carrier 604. In the arrangement shown in FIGS. 15-26, as one example, spring 606 also extends through the open center 632 of bearing 608 and bearing 608 is configured to generally rest at or near the middle of spring 606. In the arrangement shown as one example, retractable wheel assembly 600 includes bearing 608. Bearing 608 is formed of any suitable size, shape, and design and is configured to facilitate rotation of wheel 610 about spring 606 while spring 606 is stationary. In the arrangement shown, as one example, bearing 608 is a ball bearing, however any other type of bearing may be used as bearing 608, including a roller bearing, a linear bearing, a bush bearing, or any other kind of bearing. In the arrangement shown, as one example, open center 632 which is formed of any suitable size, shape, and design and is configured to allow spring 606 to extend through bearing 608.

In the arrangement shown, as one example, retractable wheel assembly 600 includes wheel 610. Wheel 610 is formed of any suitable size, shape, and design and is configured to facilitate rolling movement of system 10. Wheel 610 may be formed of any material, including a hard plastic material, a soft plastic material, any other non-metallic material, or a metallic material. In the arrangement shown, as one example, wheel 610 is a cylindrical wheel which is configured to extend around bearing 608 with an axis of rotation which is collinear with the center axis of spring 606.

Arm Covers 18

In the arrangement shown, system 10 includes arm covers 18 positioned on top of arms 246. Arm covers 18 are formed of any suitable size, shape, and design and are configured to connect with arms 246 and provide comfortable arm rests for an occupant seated in seat 12 while providing an aesthetically pleasing appearance. In the arrangement shown, as one example, arm covers 18 each have a generally elongated rectangular shape having a top 280, a bottom 282, and opposing sides 284 extending between a front end 286 and a backrest end 288. In this example arrangement, arm covers 18 each have a recessed cylindrical channel 290 formed in bottom 282 and extending from front end 286 to backrest end 288. In this example arrangement, recessed cylindrical channels 290 are configured to fit over arms 246.

In one or more arrangements, arm covers 18 are connected to arms 246 by a set of fasteners 292 (not shown) such as bolts which extend through holes (not shown) in arms 246 and connect with arm covers 18. As another example, in one or more arrangements, fasteners 292 may include connectors extending upward from arms 246 and are configured to be received and connect with receivers formed in bottom 282 of arm covers 18. For instance, bottom 282 may include keyhole shaped openings having a wide portion and a narrow portion. Such openings may be configured to receive a head of connectors of arms 246 and lock with the connectors by sliding arm covers 18 so the head is positioned in the narrow portion, thereby connecting arm covers 18 to arms 246. In one or more arrangements, the keyhole shaped opening may have a J-shape or L-shape, for example, to prevent arm covers 18 from being disconnected from arms 246 via movement or arm covers 18 in a single direction.

However, embodiments are so limited. Rather, it is contemplated that in various arrangements, arm covers 18 may be connected to arms 246 of frame 16 using various methods or means including but not limited to, for example, screws, bolts, clamps, pins, rivets, welding, snap connectors, interconnects (e.g., slide connectors, rotational connectors, or any other type of interconnect), friction fit connectors, adhesives, chemical bonding, and/or any other process or means that results in a permanent of semi-permanent connection.

Materials

In the arrangement shown, upper seat member 32 of seat assembly 26 of seat 12 and rear support member 102 of backrest support assembly 100 of backrest 14 and arm covers 18 are formed of a wooden material, which provides an aesthetically pleasing appearance. However, the embodiments are not so limited. Rather, it is contemplated that in various arrangements, upper seat member 32, rear support member 102, arm covers 18 and/or various other components of system 10 may be formed of various natural or synthetic materials including but not limited to metals, woods, plastics, composites, laminins, of any other material.

Reclining Mechanism 20

In one or more arrangements, system 10 includes a reclining mechanism. Reclining mechanism 20 is formed of any suitable size, shape, and design and is configured to facilitate connection of backrest 14 with frame 16 and facilitate movement of backrest 14 between an upright position and a reclined position. Some example reclining mechanisms 20 are shown and discussed in more detail in related U.S. patent application Ser. No. 17/955,866 filed on Sep. 29, 2022 and titled SEATING SYSTEM, the entirety of which is incorporated by reference herein. However, the arrangements are not so limited. Rather, it is contemplated that in one or more arrangements, system 10 may include various other reclining mechanism 20 implementations or may have reclining mechanism 20 omitted.

In Operation

In operation, reclining mechanism 20 facilitates backrest 14 movement from an upright to a reclined position. This guided movement of backrest 14 between upright and reclined positioned facilitates a more natural movement of an occupant between upright and reclined positions.

Further, the retractable wheel assembly 600 operates in the arrangement shown in FIGS. 15-26. As one example, bearing 608 and wheel 610 are vertically stationary due to wheel 610 resting against the floor or ground. In this configuration, as one example, when a force is applied to seat 12, such as when a user is seated in and/or using system 10, components of seat 12 transfer this force downward. When this force reaches retractable wheel assembly 600, carrier 604 generally exerts force downward on the ends of spring 606. When force is exerted downward on the ends of spring 606, spring 606 will want to move downward with this force, however when the middle of spring 606 meets the vertically stationary bearing 608, bearing 608 applies a force upward near the middle of spring 606 which causes spring 606 to expand. More specifically, the middle of spring 606 is forced upward when bearing 608 applies an upward force near the middle of spring 606 while the ends of spring 606 move downward due to the force applied to them by carrier 604. This causes spring 606 to undergo lateral compression as shown by dotted line 609. When the ends of spring 606 move downward, carrier 604 and frame 16 move downward as well to a retracted position. When frame 16 moves downward, the hollow area 620 of carrier 604 allows carrier 604 to move downward around bearing 608 and wheel 610, thereby retracting bearing 608 and wheel 610 into carrier 604 and frame 16. In the arrangement shown, as one example, once the force is removed from the seat 12 of system 10, components of system 10 are no longer forced downward and they return to the resting position. When components of system 10 are returned to their resting position, the downward force on the ends of spring 606 is removed and the ends of spring 606 generally move upward, which removes the upward force applied by bearing 608 near the middle of spring 606, causing spring 606 to extend to its resting state and bearing 608 and wheel 610 to once again extend downward from frame 16. When bearing 608 and wheel 610 are extended downward from frame 16 to a fully extended position, bearing 608 and wheel 610 may be referred to as being in a resting state. The movement of wheel 610 between a retracted position and an extended position occurs approximately parallel to the center axis 607 of the spring 606. When bearing 608 and wheel 610 extend downward from frame 16, a user is able to roll system 10 due to wheel 610.

Alternative Arrangement

With reference to FIGS. 27-55 an alternative arrangement of system 10 is presented. This alternative arrangement presented in FIGS. 27-35 is similar to the system 10 presented in FIGS. 1-26 and therefore, unless specifically stated otherwise herein, the prior teaching and disclosure shown in FIGS. 1-26 applies equally to the alternative arrangement shown in FIGS. 27-55. That is, the arrangement shown in FIGS. 27-55 is configured to be used with the same or similar seat 12, backrest 14, and reclining mechanism 20 with the primary difference relating to frame 16 and retractable wheel assembly 600 as is described herein.

Frame 16

In the arrangement shown in FIGS. 27-35, as one example, frame 16 is formed of any suitable size, shape, and design and is configured to operably connect with and support seat 12, backrest 14, and reclining mechanism 20 of system 10 to provide seating for an occupant of system 10. In the arrangement shown, as one example, frame 16 is a chair frame formed of a pair of first legs 480, a pair of second legs 482, and support members 484.

First Legs 480

In the arrangement shown in FIGS. 27-35, frame 16 includes a pair of first legs 480. First legs 480 are formed of any suitable size, shape, and design and are configured to help provide stable support of system 10 on a floor. In the arrangement shown, as one example, each first leg 480 is a generally elongated member which extends between a top end 488 and a bottom end 490. In the arrangement shown, as one example, first leg 480 is curved and starts at its top end 488, which is towards the front of system 10 and extends downward from its top end 488 to its bottom end 490 while curving such that the bottom end 490 is located at or near the back of system 10. In the arrangement shown, as one example, first legs 480 extend a width between opposing left and right sides 492 (or simply "sides 492"). In the arrangement shown, as one example, first legs 480 include an outer surface 494 and an inner surface 496 and the distance between the outer surface 494 and inner surface 496 is the thickness of first legs 480. First leg 480 may be formed of any material suitable for use as legs on a chair, including a metallic material, or a wooden material, a plastic material, or any other non-metallic material.

In the arrangement shown as one example, first legs 480 include arms 498. Arms 498 are formed of any suitable size, shape, and design and are configured to provide a surface for a user to rest their arms on. In the arrangement shown, as one example, arms 498 is a generally square member which extends a distance between a first end 500 and a second end 502. In the arrangement shown, as one example, arms 498 include an outer surface 504 and an inner surface 506 (not shown) which are co-planar with outer surface 494 and inner surface 496 of first legs 480, respectively.

In the arrangement shown, as one example, arms 498 include an arm cover 508. Arm cover 508 is formed of any suitable size, shape, and design and is configured to connect with arms 498 and provide comfortable arm rests for an occupant seated in seat 12 while providing an aesthetically pleasing appearance. In the arrangement shown, as one example, arm covers 508 each have a top 510, a bottom 512, and opposing sides 514 extending between a front end 516 and a back end 518. In the arrangement shown, as one example arm covers 508 are generally elongated and ovular in shape, with a width at the back end 518 that is larger than the width at front end 516. In this example arrangement, arm covers 508 are configured to fit over arms 498.

In one or more arrangements, arm covers 508 are connected to arms 498 by a set of fasteners (not shown) such as bolts which extend through holes (not shown) in arms 498 and connect with arm covers 508. As another example, in one or more arrangements, fasteners may include connectors extending upward from arms 498 and are configured to be received and connect with receivers formed in bottom 512 of arm covers 508. For instance, bottom 512 may include keyhole shaped openings having a wide portion and a narrow portion. Such openings may be configured to receive a head of connectors of arms 498 and lock with the connectors by sliding arm covers 508 so the head is positioned in the narrow portion, thereby connecting arm covers 508 to arms 498. In one or more arrangements, the keyhole shaped opening may have a J-shape or L-shape, for example, to prevent arm covers 508 from being disconnected from arms 498 via movement of arm covers 508 in a single direction.

However, embodiments are not so limited. Rather, it is contemplated that in various arrangements, arm covers 508 may be connected to arms 498 of first legs 480 using various methods or means including but not limited to, for example, screws, bolts, clamps, pins, rivets, welding, snap connectors, interconnects (e.g., slide connectors, rotational connectors, or any other type of interconnect), friction fit connectors, adhesives, chemical bonding, and/or any other process or means that results in a permanent of semi-permanent connection.

In the arrangement shown, as one example, as first legs 480 curve such that they move from the top end 488 near the front of system 10 to the bottom end 490 near the back of system 10, first legs 480 cross second legs 482 as second legs 482 extend from their top end 520 near the back of system 10 to their bottom end 522 near the front of system 10. In the arrangement shown, as one example, where first legs 480 and second legs 482 cross, the outer surface 494 of first legs 480 and the outer surface 526 of second legs 482 are co-planar and form a singular plane. Similarly, where first legs 480 and second legs 482 cross, the inner surface 496 of first legs 480 and the inner surface 528 of second legs 482 are co-planar and form a singular plane.

Second Legs 482

In the arrangement shown in FIGS. 27-35, frame 16 includes a pair of second legs 482. Second legs 482 are formed of any suitable size, shape, and design and are configured to help provide stable support of system 10 on a floor and to support backrest 14. In the arrangement shown, as one example, each second leg 482 is a generally elongated member which extends between a top end 520 and a bottom end 522. In the arrangement shown, as one example, second leg 482 is curved and starts at its top end 520, which is adjacent backrest 14, and extends downward from its top end 520 to its bottom end 522 while curving such that the bottom end 522 is located at or near the front of system 10. In the arrangement shown, as one example, second legs 482 extend a width between opposing left and right sides 524 (or simply "sides 524"). Second legs 482 may be formed of any material suitable for use as legs on a chair, including a metallic material, or a wooden material, a plastic material, or any other non-metallic material.

In the arrangement shown, as one example, second legs 482 have an outer surface 526 and an inner surface 528. In the arrangement shown, as one example, the outer surface 526 of second legs 482 is a generally flat and planar surface. In the arrangement shown, as one example, the inner surface 528 is a generally flat and planar surface with the exception of reclining mechanism 20. In the arrangement shown, as one example, reclining mechanism 20 is a shown within second legs 482 and is located near top end 520 of second legs 482. In the arrangement shown, as one example, reclining mechanism 20 is configured to guide backrest 14 as backrest 14 is moved between a reclined position and an upright position. While reclining mechanism 20 has been described according to the arrangement shown as one example, reclining mechanism 20 may be formed of any other shape or design.

Support Members 484

In the arrangement shown, as one example, frame 16 includes two sets of first legs 480 and second legs 482. In the arrangement shown, as one example, the two sets are connected by support members 484. Support members 484 are formed of any suitable size, shape, and design and are configured to connect the two sets of first legs 480 and second legs 482 and support seat 12. In the arrangement shown, as one example, support members are generally elongated rectangular members which extend laterally between the first set of first leg 480 and second leg 482 and the second set of first leg 480 and second leg 482. In the arrangement shown, as one example, support members connect to the two sets of first legs 480 and second legs 482 using fasteners which may be screws, bolts, pins, nails, or any other types of fastener which facilitates connection between the sets of first leg 480 and second leg 482 and support members 484.

Retractable Wheel Assembly 600

In or more arrangements shown, as examples, frame 16 includes one or more retractable wheel assemblies 600. Retractable wheel assembly 600 is formed of any suitable size, shape, and design and is configured to allow system 10 to roll over the ground when no user is seated in and/or using system 10 and retract when a user is seated in and/or using system 10 to ensure system 10 stays stationary for the user. In the arrangement shown, as one example, retractable wheel assembly 600 is partially or wholly housed within a portion of frame 16. More specifically, retractable wheel assembly 600 is partially or wholly housed within a wheel compartment 640 of frame 16. In the arrangement shown in FIGS. 36-55, as one example, retractable wheel assembly 600 includes a top member 642, a bottom member 644, one or more fasteners 646, a spring 648, an axle 650, a bearing 608, and wheel 610.

In the arrangement shown in FIGS. 36-55, as one example, frame 16 is formed of a solid material and wheel compartment 640 is formed into first legs 480 near bottom end 490 and into second legs 482 near bottom end 522. Wheel compartment 640 is formed of any suitable size, shape, and design and is configured to house retractable wheel assembly 600 and its components. In the arrangement shown, as one example, wheel compartment 640 is generally rectangular in shape with a first notch 652, which is a notch extending forward from the front end 656 of wheel compartment 640, and a second notch 654, which is a notch extending upward from the back end 658 and top side 660 of wheel compartment 640. However, wheel compartment 640 may be formed of any other shape or design, including being generally in the shape of an oval, circle, square, triangle, or any other shape or configuration. Additionally, wheel compartment 640 may be formed with or without either of first notch 652 or second notch 654.

In the arrangement shown, as one example, wheel compartment 640 may be formed when frame 16 is formed, such as by cutting, machining, or the like to form wheel compartment 640, or wheel compartment 640 may be retrofitted to frame 16 using a similar process. In the arrangement shown, as one example, a rotary tool is used to form first notch 652 and second notch 654, and the rotary tool may be used to form all or a portion of wheel compartment 640. By way of example and not limitation, when using a rotary tool to form wheel compartment 640, the operator of the rotary tool will begin forming wheel compartment 640 into the frame 16 until the majority of wheel compartment 640 is formed. The operator of the rotary tool may then move the rotary tool to near front end 656 and extend the rotary tool forward past front end 656 of wheel compartment 640 in order to form first notch 652. Similarly, the operator of the rotary tool may move the rotary tool near back end 658 and top side 660 of wheel compartment 640 and extend the rotary tool upward past the top side 660 of wheel compartment 640 in order to form second notch 654. Alternatively, in some embodiments, as one example, an operator may form first notch 652 by using a drill and drill bit to create a hole in the lower surface 684 of bottom member 644. As the operator uses the drill to guide the drill bit upwards into frame 16, first notch 652 is formed.

In the arrangement shown in FIGS. 36-55, as one example, retractable wheel assembly 600 includes top member 642. Top member 642 is formed of any suitable size, shape, and design and is configured to facilitate the connection of various components within retractable wheel assembly 600. In the arrangement shown, as one example, top member 642 has an upper side 664, a lower side 666, a front end 668, a rear end 670, and opposing left and right sides 672 (or simply "sides 672"). In the arrangement shown, as one example, top member 642 has a first flange 674, a second flange 676, an opening 678, and a hollow interior 680.

In the arrangement shown, as one example, top member 642 is generally in the shape of a half circle with a generally convexly curved upper side 664 and a generally flat lower side 666. In the arrangement shown, as one example, top member 642 has a first flange 674 extending outward from the front end 668 of top member 642 and first flange 674 extends at an angle upward as it extends outward from front end 668. First flange 674 is formed of any suitable size, shape, and design and is configured to facilitate engagement between top member 642 and wheel compartment 640. In the arrangement shown, as one example, first flange 674 extends outward from the forward front end 668 of top member 642 and into first notch 652 of wheel compartment 640. In the arrangement shown, as one example, when wheel 610 is in a retracted position, the top of first flange 674 makes contact with the top surface of first notch 652 which prevents first flange 674 and top member 642 from moving further upwards.

In the arrangement shown, as one example, top member 642 has a second flange 676 extending outward from the rear end 670 of top member 642 and second flange 676 angles upward as it extends rearward from the front 675 to the back 677 of second flange 676. Second flange 676 is formed of any suitable size, shape, and design and is configured to facilitate connection of top member 642 to other components of retractable wheel assembly 600 and help facilitate the movement of wheel 610 to a retracted position. In the arrangement shown, as one example, second flange 676 includes a hole 682 extending vertically through second flange 676.

In the arrangement shown, as one example, top member 642 includes an opening 678 and a hollow interior 680. Opening 678 of top member 642 is formed of any suitable size, shape, and design and is configured to allow axle 650 to pass through top member 642 from one side 672 to the other side 672 of top member 642. Hollow interior 680 is formed of any suitable size, shape, and design and is configured to allow at least a portion of bearing 608 and wheel 610 to be housed within top member 642.

In the arrangement shown, as one example, top member 642 is positioned wholly within wheel compartment 640 and is located directly above bottom member 644. In the arrangement shown, as one example, retractable wheel assembly 600 includes bottom member 644. Bottom member 644 is formed of any suitable size, shape, and design and is configured to provide a flat surface when wheel 610 is in a retracted position and also allow wheel 610 to extend below the lower surface 684 of bottom member 644 when wheel 610 is in a resting state. In the arrangement shown, as one example, bottom member 644 includes a lower surface 684, an upper surface 686, a rear portion 688, and one or more openings 690, and a slot 692.

In the arrangement shown, as one example, bottom member 644 is generally elongated and/or ovular in shape and has a generally flat lower surface 684. In the arrangement shown, as one example, upper surface 686 of bottom member 644 generally slopes upward as it extends from the rear end 694 toward forward end 696 of bottom member 644. In the arrangement shown, as one example, a portion of upper surface 686 near the forward end 696 of bottom member 644 extends into first notch 652 of wheel compartment 640.

In the arrangement shown, as one example, bottom member 644 includes a rear portion 688 at or near rear end 694 of bottom member 644. In the arrangement shown, as one example, rear portion 688 has a first surface 698 and a second surface 700. In the arrangement shown, as one example, first surface 698 is generally lower than second surface 700 and extends outward and rearward farther than second surface 700 does. In the arrangement shown, as one example, at least a portion of frame 16 is configured to rest on first surface 698. In other words, first surface 698 rests outside of wheel compartment 640 while second surface 700 and at least a portion of the remainder of bottom member 644 rest within wheel compartment 640. In the arrangement shown, as one example, bottom member 644 includes one or more openings 690 which extend vertically through lower surface 684, forward end 696 of bottom member 644, first surface 698, and second surface 700. In the arrangement shown, as one example, one or more openings 690 are concentric with one or more holes 682 of lower surface 684.

In the arrangement shown, as one example, bottom member 644 includes slot 692. Slot 692 is formed of any suitable size, shape, and design and is configured to allow bearing 608 and wheel 610 to extend below the lower surface 684 of bottom member 644 when wheel 610 is in a resting state. In the arrangement shown, as one example, slot 692 is a generally rectangular opening which extends from lower surface 684 to upper surface 686 of bottom member 644. However, slot 692 may be formed of any other suitable shape and configuration to allow wheel 610 to extend through bottom member 644, including slot 692 being generally in the shape of a circle, oval, square, triangle, or any other shape.

In the arrangement shown, as one example, top member 642 and bottom member 644 are held together by one or more fasteners 646. Fasteners 646 are formed of any suitable size, shape, and design and are configured to connect various components of retractable wheel assembly 600. In the arrangement shown, as one example, fasteners 646 are a bolt or screw which extend vertically up into wheel compartment 640 and through one or more openings 690 of bottom member 644 and one or more holes 682 of top member 642. Further, one of the one or more fasteners 646 extends through the middle of spring 648. In the arrangement shown, as one example, both fasteners 646 and spring 648 extend upward into wheel compartment 640, thereby facilitating connection and engagement between both fasteners 646 and wheel compartment 640 and between spring 648 and wheel compartment 640. Further, the removal of one or more fasteners 646, in the arrangement shown, as one example, may facilitate the easy cleaning of wheel compartment 640 and the various components of the retractable wheel assembly 600.

In the arrangement shown, as one example, retractable wheel assembly 600 includes spring 648. Spring 648 is formed of any suitable size, shape, and design and is configured to provide a means for wheel 610 to retract when a user is seated in and/or using system 10. In the arrangement shown, as one example, spring 648 is a helical compression spring, however spring 648 may be formed of any other type or configuration of spring. In the arrangement shown, as one example, spring 648 includes a center axis 649.

In the arrangement shown, as one example, spring 648 extends vertically with a lower end 702 of spring 648 resting against the second flange 676 of top member 642 and the upper end 704 of spring 648 resting against the top surface of second notch 654 of wheel compartment 640. In the arrangement shown, as one example, spring 648 is generally sized such that it naturally rests between second flange 676 of top member 642 and the top surface of second notch 654 without experiencing compression.

Figure 48:
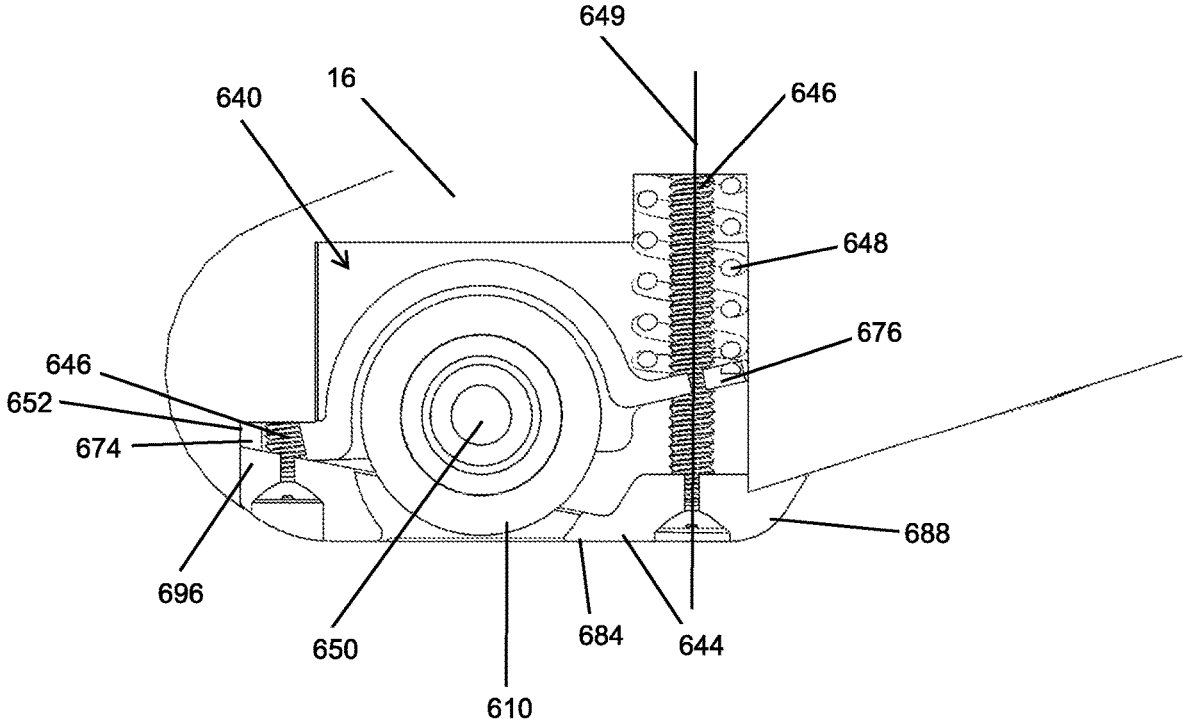
FIG. 48 is a section view of a frame of a chair in accordance with one or more arrangements, the view showing the frame of the chair having a retractable wheel assembly with a wheel retracted and a spring when it is linearly compressed.
Figure 49:
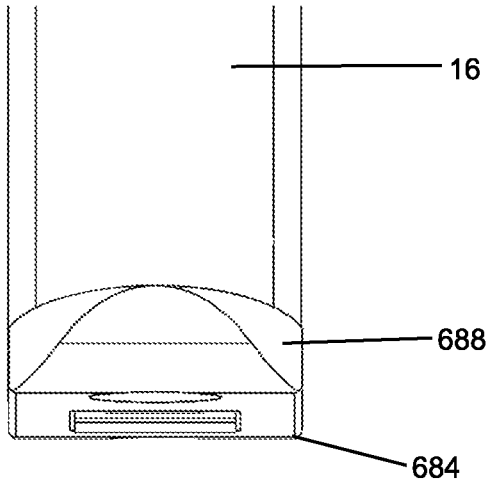
FIG. 49 is a rear elevation view of a frame of a chair in accordance with one or more arrangements.
Figure 50:
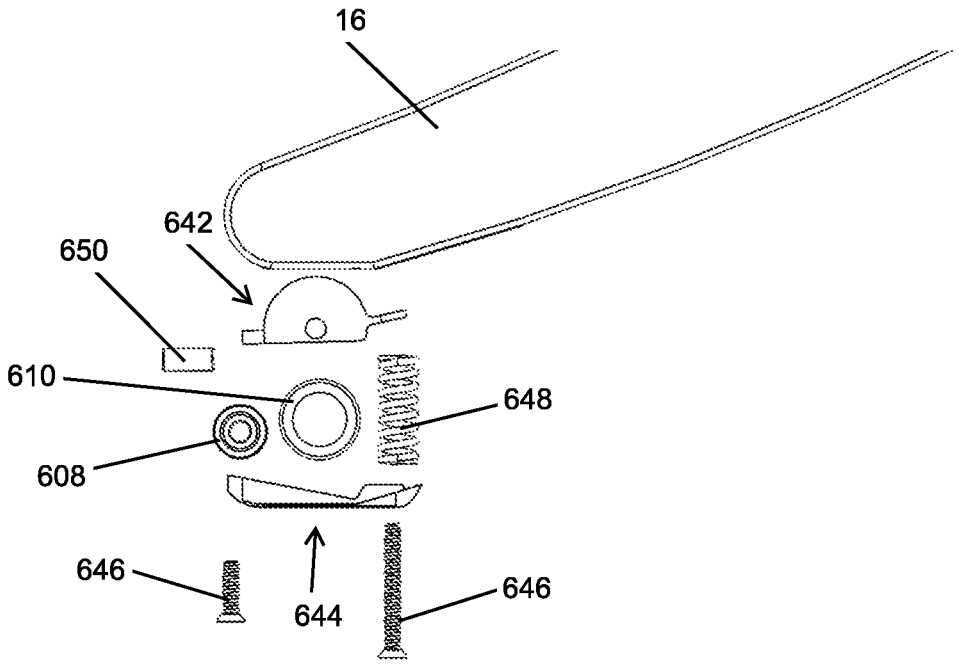
FIG. 50 is a side elevation exploded view of a frame of a chair in accordance with one or more arrangements, the view showing the frame of the chair having a retractable wheel assembly.
Figure 51:
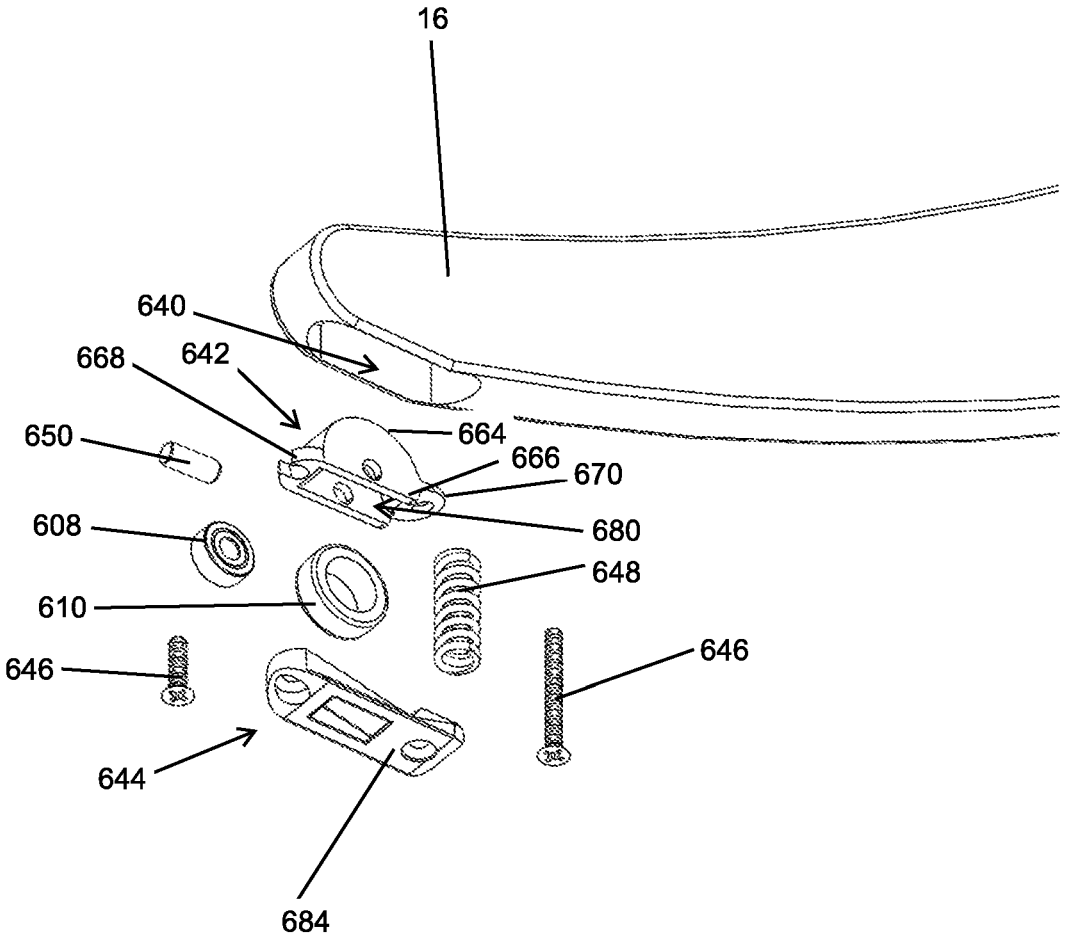
FIG. 51 is a front perspective exploded view of a frame of a chair in accordance with one or more arrangements, the view showing the frame of the chair having a retractable wheel assembly.
Figure 52:
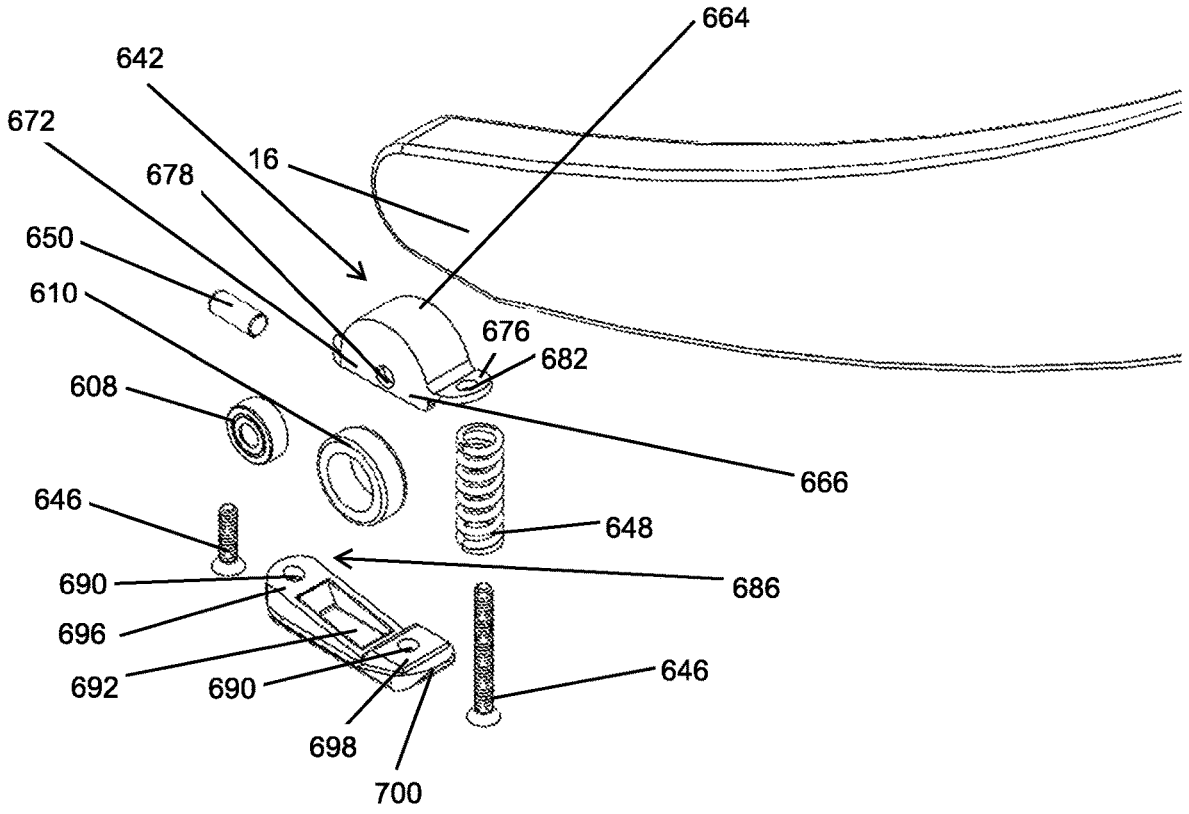
FIG. 52 is a back perspective exploded view of a frame of a chair in accordance with one or more arrangements, the view showing the frame of the chair having a retractable wheel assembly.
Figure 53:
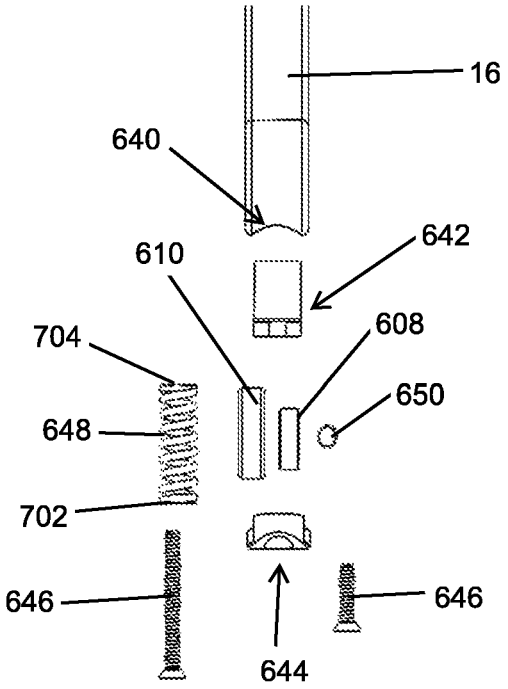
FIG. 53 is an elevation exploded view of a frame of a chair in accordance with one or more arrangements, the view showing the frame of the chair having a retractable wheel assembly.
Figure 54:
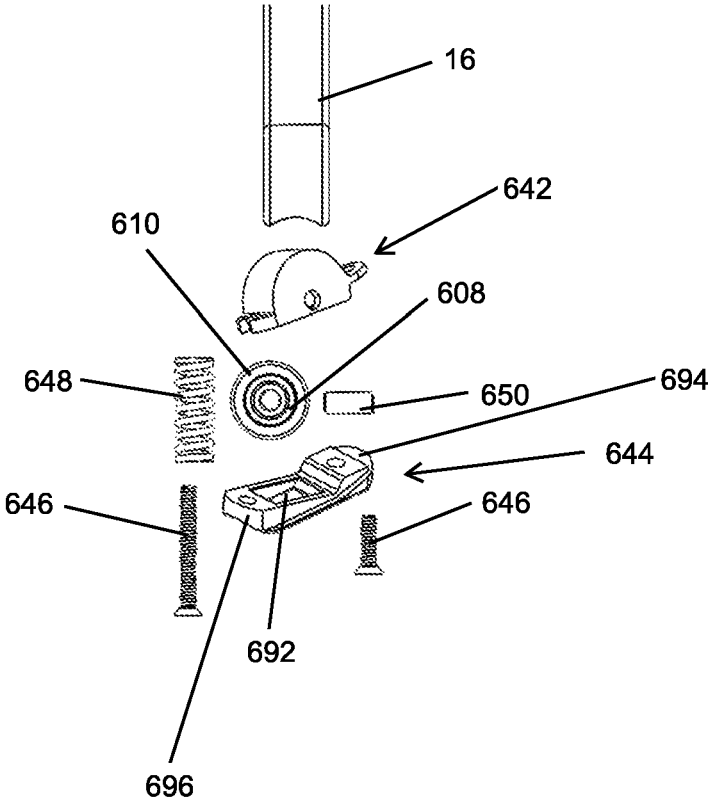
FIG. 54 is a perspective exploded view of a frame of a chair in accordance with one or more arrangements, the view showing the frame of the chair having a retractable wheel assembly.
Figure 55:
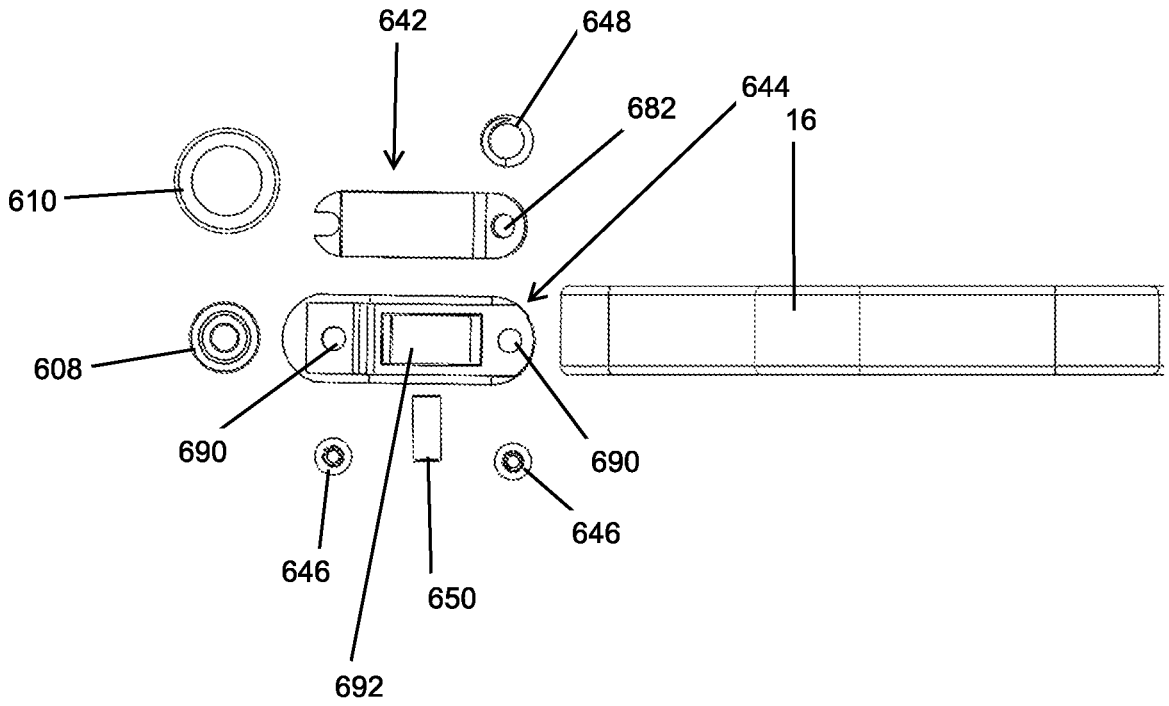
FIG. 55 is an elevation exploded view of a frame of a chair in accordance with one or more arrangements, the view showing the frame of the chair having a retractable wheel assembly.

In the arrangement shown as one example, spring 648 generally rests in an extended position and is compressed when a certain amount of downward force is exerted on system 10. With reference to FIG. 48, as one example, linear compression of spring 648 is shown. That is, when a force is applied downward on system 10, wheel 610 is forced upward and spring 648 compresses in approximate parallel alignment to the center axis 649 of spring 648. This linear compression shortens the length of spring 648 along the center axis 649 of spring 648. This linear compression builds tension within spring 648. This linear compression allows wheel 610 to move to a retracted position.

In the arrangement shown, as one example, retractable wheel assembly 600 includes bearing 608 and wheel 610 as described herein. In the arrangement shown, as one example, retractable wheel assembly 600 also includes axle 650. Axle 650 is formed of any suitable size, shape, and design and is configured to operably connect bearing 608 and wheel 610 to top member 642. In the arrangement shown, as one example, axle 650 is a generally cylindrical rod, however any other shape or configuration of axle 650 may be used. In the arrangement shown, as one example, axle 650 extends through opening 678 from one side 672 to the other side 672 of top member 642. In the arrangement shown, as one example, axle 650 also extends through the open center 632 of bearing 608 when bearing 608 is resting within the hollow interior 680 of top member 642.

In Operation

The operation of system 10 in the alternative arrangement presented in FIGS. 27-55 is similar to the operation of system 10 in the arrangements shown in FIGS. 1-26. However, the operation of the retractable wheel assembly 600, in the arrangement shown in FIGS. 27-55 as one example, includes minor differences. For example, when there is not a user sitting on the chair, bearing 608 and wheel 610 are vertically stationary due to wheel 610 resting against the floor or ground. In this configuration, as one example, when a force is applied to seat 12, such as when a user is seated in and/or using system 10, components of system 10 transfer this force downward. When this force reaches retractable wheel assembly 600, a downward force is applied to the upper end 704 of spring 648. When force is applied to the upper end 704 of spring 648, spring 648 undergoes linear compression, the force is transferred to the lower end 702 of spring 648, and the lower end 702 of spring 648 exerts a downward force on second flange 676 of top member 642. Because second flange 676 extends upward as it extends outward from the rear end 670 of top member 642, this downward force causes the back 677 of second flange 676 downward, which causes the front 675 of second flange 676 to move and angle upward relative to the back 677 of second flange 676. As the front 675 of second flange 676 is moved and angled upward, the top member 642 is moved upward. As top member 642 is moved upward, the front end 668 of top member 642 pivots. As top member 642 is moved upward, axle 650, which extends through opening 678 of top member 642 and through the open center 632 of bearing 608, is also moved upward. This movement of axle 650 also causes bearing 608 and wheel 610 to move upward into a retracted position. The movement of wheel 610 between a retracted position and an extended position occurs approximately perpendicular to the center axis 649 of the spring 648. In the arrangement shown, as one example, once the force is removed from the seat 12 of system 10, components of system 10 are no longer forced downward and they return to the resting position. When components of system 10 are returned to their resting position, the downward force on spring 648 is removed and spring 648 returns to its extended position, which removes the downward force applied to second flange 676 of top member 642. As the downward force is removed from second flange 676, the back 677 of second flange 676 will move and angle upward as the front 675 of second flange 676 moves downward, causing the remainder of top member 642, as well as axle 650, to move back down to their resting positions. When axle 650 is moved down to its resting position, bearing 608 and wheel 610 extend down past the lower surface 684 of bottom member 644 and a user is able to roll system 10 on wheels 610.

ADDITIONAL EMBODIMENTS

In one or more arrangements, retractable wheel assembly 600 has a front edge and a rear edge that align in a generally flat and flush manner with the opening in frame 16 of system 10. This flush alignment prevents retractable wheel assembly 600 from getting hung-up on carpet or other types of flooring and instead make is easier and smother to move system 10 along some types of flooring.

In some arrangements it may be desirable to remove retractable wheel assembly 600. To do so, engagement members 624 of carrier 604 are pressed inward. This releases the engagement between engagement members 624 and frame 16 which allows retraceable wheel assembly 600 to be removed from frame 16. Once removed, retractable wheel assembly 600 may be cleaned, repaired or replaced with a new retraceable wheel assembly 600.

Alternatively, in the event that a retraceable wheel assembly 600 is not desired, retraceable wheel assembly 600 may be removed and replaced with a component that does not have a wheel 610 therein. In this case, the wheelless component would have the same or similar configuration to retractable wheel assembly 600 without wheel 610, spring 606 and other components related to wheel 610. Instead, this wheelless component would include engagement members 624 that engage frame 16 and has a flat bottom plate 622 where the opening for wheel 610 is. This arrangement eliminates the retractable wheel assembly 600 where it is undesirable and allows system 10 to be used with the wheelless inserts, which may be flat and flush with frame 16 as is described herein, which prevents system 10 from catching or hanging up on carpet and other types of flooring.

From the above discussion it will be appreciated that the described system improves upon the state of the art. Specifically, one or more embodiments provide an improved seating system: that has a compact reclining mechanism concealed within the chair that is configured to support an occupant in upright and reclined positions; that has a retractable wheel system; that is strong, robust, and durable; that is comfortable; that is easy and intuitive to use; that is easy to manufacture; that is cost effective; that is high quality; that has a long useful life; and/or that is aesthetically pleasing among various other features and/or advantages.

It will be appreciated by those skilled in the art that other various modifications could be made to the device without parting from the spirit and scope of this disclosure. All such modifications and changes fall within the scope of the claims and are intended to be covered thereby.

What is claimed:

1. A chair seating system, comprising:
a frame;
a seat;
the seat operably connected to the frame;
a backrest;
the backrest operably connected to the frame;
one or more retractable wheel assemblies;
wherein the one or more retractable wheel assemblies have a wheel;
wherein the one or more retractable wheel assemblies have a top member;
wherein the one or more retractable wheel assemblies are configured to facilitate movement of the wheel between an extended position and a retracted position;
wherein the top member is configured to facilitate movement of the wheel when the top member pivots at a front end;
wherein the one or more retractable wheel assemblies are configured to facilitate movement of the wheel to the retracted position when a downward force is applied to the chair seating system; and
wherein the one or more retractable wheel assemblies are configured to facilitate movement of the wheel to the extended position in absence of the downward force.

2. The system of claim 1, wherein the wheel of the one or more retractable wheel assemblies extends below the frame when in the extended position.

3. The system of claim 1, wherein the wheel of the one or more retractable wheel assemblies is configured to retract into the frame when moved to the retracted position.

4. The system of claim 1, further comprising:
wherein the wheel of the one or more retractable wheel assemblies extends below the frame when in the extended position; and
wherein the wheel of the one or more retractable wheel assemblies is configured to retract into the frame when moved to the retracted position.

5. The system of claim 1, further comprising a spring configured to facilitate movement of the wheel to the extended position in absence of the downward force.

6. The system of claim 1, further comprising:
a spring;
wherein the spring is compressed when the downward force is applied to the chair seating system and the wheel is moved to the retracted position.

7. The system of claim 1, further comprising:
a spring;
wherein the wheel of the one or more retractable wheel assemblies extends below the frame when in a resting state;
wherein the spring of the one or more retractable wheel assemblies facilitates extension of the wheel.

8. The system of claim 1, further comprising a wheel compartment positioned within the frame and configured to receive the one or more retractable wheel assemblies.

9. The system of claim 1, wherein the backrest is configured to move between an upright position and a reclined position.

10. A chair seating system, comprising:
a frame;
a seat;
the seat operably connected to the frame;
a backrest;
the backrest operably connected to the frame;
one or more retractable wheel assemblies;
wherein the one or more retractable wheel assemblies have a wheel;
wherein the one or more retractable wheel assemblies are configured to facilitate movement of the wheel between an extended position and a retracted position;
wherein the one or more retractable wheel assemblies are configured to facilitate movement of the wheel to the retracted position when a downward force is applied to the chair seating system;
wherein the one or more retractable wheel assemblies are configured to facilitate movement of the wheel to the extended position in absence of the downward force; and
wherein the wheel is positioned within a top member and wherein the top member is configured to facilitate movement of the wheel when the top member pivots at a front end and a rear end moves upward.

11. The system of claim 1, further comprising a spring, wherein when the downward force is applied to the chair seating system, the spring is compressed and facilitates movement of the rear end of the top member of the one or more retractable wheel assemblies to the retracted position.

12. The system of claim 1, further comprising:
wherein the wheel of the one or more retractable wheel assemblies extends below the frame when in the extended position;
wherein the wheel of the one or more retractable wheel assemblies is configured to retract into the frame when moved to the retracted position; and
wherein retraction and extension of the wheel occurs approximately parallel to a center axis of a spring.

13. The system of claim 1, further comprising:
wherein the wheel of the one or more retractable wheel assemblies extends below the frame when in the extended position;
wherein the wheel of the one or more retractable wheel assemblies is configured to retract into the frame when moved to the retracted position; and
wherein retraction and extension of the wheel occurs approximately perpendicular to a center axis of a spring.

14. A chair seating system, comprising:
a frame;
a seat;
the seat operably connected to the frame;
a backrest;
the backrest operably connected to the frame;
a retractable wheel assembly;
wherein the retractable wheel assembly has a wheel;
wherein the retractable wheel assembly has a top member;
wherein the retractable wheel assembly has a spring;
wherein the retractable wheel assembly is configured to extend the wheel below the frame when in a resting state; and
wherein the top member is configured to facilitate movement of the wheel when the top member pivots at a front end.

15. The system of claim 14, wherein the wheel of the retractable wheel assembly is configured to retract into the frame when a downward force is applied to the chair seating system.

16. The system of claim 14, wherein the wheel of the retractable wheel assembly is configured to retract into the frame when a downward force is applied to the chair seating system;
wherein the spring of the retractable wheel assembly facilitates retraction of the wheel.

17. The system of claim 14, wherein the wheel of the retractable wheel assembly extends below the frame when in a resting state;

wherein the spring of the retractable wheel assembly facilitates extension of the wheel.

18. The system of claim 14, further comprising a wheel compartment positioned within the frame.

19. The system of claim 14, further comprising a wheel compartment positioned within the frame, and configured to receive the retractable wheel assembly.

20. The system of claim 14, wherein the retractable wheel assembly is configured to retract the wheel into the frame when a downward force is applied to the chair seating system;

wherein the retractable wheel assembly is configured to extend the wheel below the frame in absence of the downward force.

21. The system of claim 14, wherein the backrest is configured to move between an upright position and a reclined position.

22. A chair seating system, comprising:

a frame;

a seat;

the seat operably connected to the frame;

a backrest;

the backrest operably connected to the frame;

a retractable wheel assembly;

wherein the retractable wheel assembly has a wheel;

wherein the retractable wheel assembly has a spring;

wherein the retractable wheel assembly is configured to extend the wheel below the frame when in a resting state; and wherein the wheel is positioned within a top member and wherein the top member is configured to facilitate movement of the wheel when the top member pivots at a front end and a rear end moves upward.

23. The system of claim 14, wherein when a downward force is applied to the chair seating system, the spring is compressed and retracts the retractable wheel assembly by facilitating movement of the rear end of the top member of the retractable wheel assembly.

24. The system of claim 14, further comprising:

wherein the wheel of the retractable wheel assembly is configured to retract into the frame when moved to a retracted position; and wherein retraction and extension of the wheel occurs approximately parallel to a center axis of the spring.

25. The system of claim 14, further comprising:

wherein the wheel of the retractable wheel assembly is configured to retract into the frame when moved to a retracted position; and wherein retraction and extension of the wheel occurs approximately perpendicular to a center axis of the spring.

26. A chair seating system, comprising:

a frame;

a seat;

the seat operably connected to the frame;

a backrest;

the backrest operably connected to the frame;

the frame having a wheel compartment;

a retractable wheel assembly;

wherein the retractable wheel assembly has a wheel;

wherein the retractable wheel assembly has a spring;

wherein the spring has a center axis;

wherein the spring extends through a center of the wheel;

wherein the frame is configured to receive the retractable wheel assembly;

wherein the wheel of the retractable wheel assembly is configured to retract into the frame when a downward force is applied to the chair seating system; and wherein the downward force applied to the chair seating system upwardly bends the spring extending through the wheel, thereby causing the wheel to retract into the frame.

27. The system of claim 26, wherein the wheel of the retractable wheel assembly extends below the frame when in a resting state.

28. The system of claim 26, wherein the spring of the retractable wheel assembly facilitates extension of the wheel.

29. The system of claim 26, further comprising:

wherein the wheel of the retractable wheel assembly extends below the frame when in a resting state;

wherein the spring of the retractable wheel assembly facilitates extension of the wheel.

30. The system of claim 26, wherein the retractable wheel assembly is positioned within the wheel compartment of the frame.

31. The system of claim 26, wherein the retractable wheel assembly is configured to facilitate extension of the wheel below the frame; and retraction of the wheel into the frame when the downward force is applied to the chair seating system.

32. The system of claim 26, wherein the backrest is configured to move between an upright position and a reclined position.

33. A chair seating system, comprising:

a frame;

a seat;

the seat operably connected to the frame;

a backrest;

the backrest operably connected to the frame;

the frame having a wheel compartment;

a retractable wheel assembly;

wherein the retractable wheel assembly has a wheel;

wherein the retractable wheel assembly has a spring;

wherein the frame is configured to receive the retractable wheel assembly;

wherein the wheel of the retractable wheel assembly is configured to retract into the frame when a downward force is applied to the chair seating system; and wherein the wheel is positioned within a top member and wherein the top member is configured to facilitate movement of the wheel when the top member pivots at a front end and a rear end moves upward.

34. The system of claim 26, further comprising:

wherein the wheel of the retractable wheel assembly extends below the frame when in an extended position;

wherein the wheel of the retractable wheel assembly is configured to retract into the frame when moved to a retracted position; and wherein retraction and extension of the wheel occurs approximately perpendicular to a center axis of the spring.

35. A chair seating system, comprising:

a frame;

a seat;

the seat operably connected to the frame;

a backrest;

the backrest operably connected to the frame;

the frame having a wheel compartment;

a retractable wheel assembly;

wherein the retractable wheel assembly has a wheel;
wherein the retractable wheel assembly has a spring;
wherein the spring has a center axis;
wherein the spring extends through a center of the wheel;
wherein the frame is configured to receive the retractable wheel assembly;
wherein the retractable wheel assembly is configured to facilitate extension of the wheel below the frame; and
wherein upward bending of the spring of the retractable wheel assembly is configured to facilitate retraction of the wheel into the frame when a downward force is applied to the chair seating system.

36. The system of claim 35, wherein the wheel of the retractable wheel assembly extends below the frame when in a resting state.

37. The system of claim 35, wherein the spring of the retractable wheel assembly facilitates retraction of the wheel.

38. The system of claim 35, further comprising:
wherein the wheel of the retractable wheel assembly extends below the frame when in a resting state;
wherein the spring of the retractable wheel assembly facilitates extension of the wheel.

39. The system of claim 35, wherein the retractable wheel assembly is configured to position the wheel within the wheel compartment of the frame when retracted.

40. The system of claim 35, wherein the backrest is configured to move between an upright position and a reclined position.

41. A chair seating system, comprising
a frame;
a seat;
the seat operably connected to the frame;
a backrest;
the backrest operably connected to the frame;
the frame having a wheel compartment;
a retractable wheel assembly;
wherein the retractable wheel assembly has a wheel;
wherein the retractable wheel assembly has a spring;
wherein the frame is configured to receive the retractable wheel assembly;
wherein the retractable wheel assembly is configured to facilitate extension of the wheel below the frame;
wherein the retractable wheel assembly is configured to facilitate retraction of the wheel into the frame when a downward force is applied to the chair seating system; and
wherein the wheel is positioned within a top member and wherein the top member is configured to facilitate movement of the wheel when the top member pivots at a front end and a rear end moves upward.

42. The system of claim 35,
wherein retraction and extension of the wheel occurs approximately perpendicular to the center axis of the spring.

43. The system of claim 14, wherein when the downward force is applied to the chair seating system, the spring is linearly compressed and facilitates movement of the one or more retractable wheel assemblies to a retracted position.

* * * * *